US005187053A

United States Patent [19]

Hayashi

[11] Patent Number: 5,187,053

[45] Date of Patent: Feb. 16, 1993

[54] SILVER HALIDE COLOR PHOTOGRAPHIC MATERIAL HAVING IMPROVED COLOR REPRODUCIBILITY AND HIGH SENSITIVITY TO RED LIGHT

[75] Inventor: Yasuhiro Hayashi, Ashigara, Japan

[73] Assignee: Fuji Photo Film Co., Ltd., Kanagawa, Japan

[21] Appl. No.: 436,859

[22] Filed: Nov. 15, 1989

[30] Foreign Application Priority Data

Nov. 16, 1988 [JP] Japan ..... 63-289703

[51] Int. Cl.[5] ..... G03C 1/34; G03C 1/46; G03C 1/12; G03C 7/38

[52] U.S. Cl. ..... 430/505; 430/550; 430/558; 430/572; 430/584; 430/588; 430/600; 430/603

[58] Field of Search ..... 430/505, 550, 572, 544, 430/558, 600, 603, 584, 588

[56] References Cited

U.S. PATENT DOCUMENTS

| | | | |
|---|---|---|---|
| 4,762,775 | 8/1988 | Ogawa et al. | 430/505 |
| 4,851,326 | 7/1989 | Ishikawa et al. | 430/380 |
| 4,857,449 | 8/1989 | Ogawa et al. | 430/546 |
| 4,892,807 | 1/1990 | Hirabayashi et al. | 430/505 |
| 4,917,994 | 4/1990 | Martinez et al. | 430/543 |
| 4,920,042 | 4/1990 | Waki et al. | 430/380 |
| 4,939,080 | 7/1990 | Hioki et al. | 430/576 |
| 4,945,038 | 7/1990 | Momoki et al. | 430/576 |
| 4,959,298 | 9/1990 | Mitsui et al. | 430/496 |

FOREIGN PATENT DOCUMENTS

| | | | |
|---|---|---|---|
| 1245153 | 10/1986 | Japan | 430/505 |
| 63-279242 | 11/1988 | Japan . | |

*Primary Examiner*—Lee C. Wright
*Attorney, Agent, or Firm*—Sughrue, Mion, Zinn, Macpeak & Seas

[57] ABSTRACT

A silver halide color photographic material comprising a support having thereon at least three silver halide emulsion layers which have different color sensitivities from each other, wherein at least one of the silver halide emulsion layers contains at least one magenta coupler represented by general formula (I) shown below, at least one of the silver halide emulsion layers contains at least one compound represented by general formula (II) shown below, at least one of the silver halide emulsion layers contains at least one compound represented by general formula (III) shown below and the pH of the layers of the silver halide color photographic material is from 5.0 to 6.5:

(I)

(II)

(III)

wherein $R^1$, X, Za, Zb, Zc, Q, M, Z, $R_4$, $R_5$, $V_1$, $V_2$, $V_3$, $V_4$, $V_5$, $V_6$, $B_7$, $V_8$, and $X_n$ are defined in the specification.

22 Claims, No Drawings

SILVER HALIDE COLOR PHOTOGRAPHIC MATERIAL HAVING IMPROVED COLOR REPRODUCIBILITY AND HIGH SENSITIVITY TO RED LIGHT

FIELD OF THE INVENTION

The present invention relates to a silver halide color photographic material. More particularly, it relates to a silver halide color photographic material which is improved in color reproducibility, which has high sensitivity particularly in a red-sensitive layer, which has photographic properties which are so improved that there are substantially no differences between lots or batches of the product, and which exhibits less change in sensitivity and fog during storage for a long period of time.

BACKGROUND OF THE INVENTION

In silver halide color photographic materials, particularly those for prints, recently it has been required to provided materials which have high sensitivity and which can be rapidly developed by rapid development processing. Further, it has become desirable to be able to provide a supply of prints having high quality without employing highly skilled labor. In order to respond to these requirements, it is important to maintain production stability of photographic light-sensitive materials, as well as to improve photographic properties thereof. More specifically to minimize differences in photographic properties between lots during the production of photographic light-sensitive materials and to keep the change in photographic properties as small as possible during storage of the photographic light-sensitive materials after the production for a long period of time are significant. Moreover, in photographic light-sensitive materials for prints it is particularly required that clear cyan, magenta and yellow colored dyes of less subsidiary absorption are formed to provide color photographic images of good color reproducibility.

Differences in photographic properties between lots during the production of photographic light-sensitive materials and changes in photographic properties, particularly, sensitivity and fog during storage of the photographic light-sensitive materials for a long period of time poses significant practical problems to the use of such materials. These problems lead to very severe defects under the recent conditions wherein high quality is especially required.

It is believed that changes in photographic properties largely depend on the properties of the sensitizing dye used, although it also depends partly on the inherent properties of the silver halide emulsion. Specifically, the changes depend on the change in the amount of sensitizing dyes adsorbed onto the silver halide grains when an emulsion for coating is stored for a long period of time at the production of the photographic light-sensitive materials or the change in the amount of sensitizing dyes adsorbed onto the silver halide grains due to desorption during the storage of the photographic light-sensitive material for a long period of time after its production.

It has been found that when a certain type of coupler (the compound represented by the general formula (I) described hereinafter) is present in a silver halide emulsion layer, the above described problems occur remarkably, not only in the silver halide emulsion layer containing the coupler, but also in other silver halide emulsion layers, in particular, in the red-sensitive emulsion layer.

Magenta couplers having a pyrazoloazole skeleton represented by the general formula (I) described hereinafter, particularly those as described in JP-A-59-171956 corresponding to U.S. Patent 4,540,654, JP-A-59-162548 corresponding to U.S. Patent 4,500,630, JP-A-60-33552 and JP-A-60-43659 (the term "JP-A" as used herein means an "unexamined published Japanese patent application") are preferred from the standpoint of color reproduction because they exhibit less subsidiary absorption in the wavelength range around 430 nm, in comparison with the pyrazolone type magenta couplers generally employed in color photographic light-sensitive materials for prints. However, it has become apparent that these pyrazoloazole type magenta couplers cause the formation of severe fog and an increase in fog during their storage for a long time after production.

While several investigations on antifogging agents have been made in order to solve these problems, satisfactory results have not been obtained. It has been proposed in JP-A-61-245153 that an improvement has been made by hardening the layer with a chlorotriazine type hardening agent, and adjusting the pH of the photographic light-sensitive material to a range of from 5.0 to 6.0. In this reference, however, there is no disclosure on the prevention of fog in other layers, particularly in a red-sensitive emulsion layer, although there is the description relating to a green-sensitive emulsion layer.

Other attempts to reduce the difference in photographic properties between lots of the product and to improve preservability of the photographic light-sensitive material for a long period of time have been made, and improvements have been reported for methods involving the addition of water-soluble bromides (as described in JP-A-52-151026), the addition of iridium salts (as described in JP-A-54-23520), the addition of selective hardening agents (as described in JP-A-60-202436), the addition of super sensitizing agents (as described in JP-A-61-203447) and the improved addition method of spectral sensitizing dyes (as described in JP-A-58-7629).

In addition, in JP-A-60-225147 the addition of silver chlorobromide having (100) planes and (111) planes is proposed in order to improve spectral sensitivity and preservability with the lapse of time, and to reduce the difference between emulsion lots.

However, it is very difficult to reduce the difference between lots of the product and to improve the preservability for a long period of time to a satisfactory extent without causing adverse affects on the inherent photographic properties such as sensitivity, fog, contrast, image quality, etc. in case of applying these method individually or in combination. In particular, it can not be achieved to restrain the fog in a red-sensitivie emulsion layer.

SUMMARY OF THE INVENTION

Therefore, an object of the present invention is to provide a silver halide color photographic material which is improved in color reproducibility, which has high sensitivity particularly in a red-sensitive layer, which has photographic properties which are so improved that there are substantially no differences between lots or batches of the product, and which exhibits restrained change in sensitivity and fog during preservation for a long period of time.

Other objects of the present invention will become apparent from the following detailed description and examples.

It has been found that these and other objects of the present invention are accomplished with a silver halide color photographic material comprising a support having thereon at least three silver halide emulsion layers which have different color sensitivities from each other, wherein at least one of the silver halide emulsion layers contains at least one magenta coupler represented by general formula (I) described below, at least one of the silver halide emulsion layers contains at least one compound represented by general formula (II) described below, at least one of the silver halide emulsion layers contains at least one compound represented by general formula (III) described below and the pH of the layers of the silver halide color photographic material is 5.0 to 6.5:

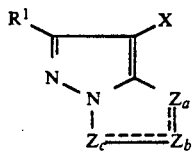

(I)

wherein $R^1$ represents a hydrogen atom or a substituent which includes the same group represented by $R^{11}$ descrbed hereinafter; X represents a hydrogen atom or a group capable of being released upon a coupling reaction with an oxidation product of an aromatic primary amine developing agent; Za, Zb and Zc each represents a methine group, a substituted methine group, =N— or —NH—, one of the Za—Zb bond and the Zb—Zc bond is a double bond and the other is a single bond; when the Zb—Zc bond is a carbon-carbon double bond, it may form a part of a condensed aromatic ring; $R^1$ or X forms a part of a polymer including a dimer or higher polymer; and when Za, Zb or Zc is a substituted methine group, the substituted methine group forms a part of a polymer including a dimer or higher polymer,

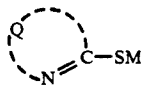

(II)

wherein Q represents an atomic group necessary to form a 5-membered or 6-membered heterocyclic ring which may be condensed with a benzene ring; and M represents a hydrogen atom, an alkali metal atom, an ammonium group or a precursor thereof,

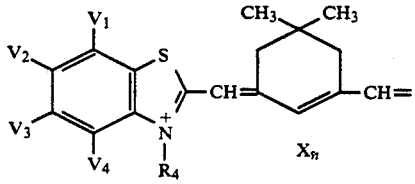

(III)

-continued

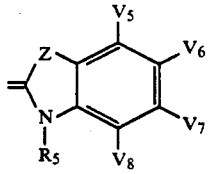

wherein Z represents an oxygen atom or a sulfur atom; $R_4$ and $R_5$ each represents an unsubstituted or substituted alkyl group; $V_1$, $V_2$, $V_3$, $V_4$, $V_5$, $V_6$, $V_7$ and $V_8$ each represents a hydrogen atom, a halogen atom, an alkyl group, an acyl group, an acyloxy group, an alkoxycarbonyl group, a carbamoyl group, a sulfamoyl group, a carboxy group, a cyano group, a hydroxy group, an amino group, an acylamino group, an alkoxy group, an alkylthio group, an alkylsulfonyl group, a sulfonic acid group, or an aryl group, provided that adjacent groups represented by $V_1$ to $V_8$ can not bond to each other to form a condensed ring, and further provided that Y is not larger than −0.08 when Z represents an oxygen atom or Y is not larger than −0.15 when Z represents a sulfur atom, wherein Y represents the total of $\sigma_{p1}$, $\sigma_{p2}$, $\sigma_{p3}$, $\sigma_{p4}$, $\sigma_{p5}$, $\sigma_{p6}$, $\sigma_{p7}$ and $\sigma_{p8}$, which are the Hammett's $\sigma_p$ values of $V_1$ to $V_8$ respectively; X represents a charged ion to neutralize the electrical charge of the compound; and n represents a value necessary to neutralize the electrical charge of the compound.

The silver halide color photographic material is excellent in color reproducibility, has high sensitivity particularly in a red-sensitive layer, exhibits and no difference in photographic properties between lots or batches of the product, and exhibits less change in sensitivity and fog during storage for a long period of time.

DETAILED DESCRIPTION OF THE INVENTION

The magenta coupler represented by general formula (I) which can be employed in the present invention will be described in detail in the following.

The term "polymer" as used with respect to the magenta dye forming coupler represented by general formula (I) means a compound containing at least two groups derived from the compound represented by general formula (I) in its molecule, and includes a bis coupler and a polymer coupler. The polymer coupler may be either a homopolymer composed of only a monomer having a moiety represented by general formula (I) (preferably a monomer having a vinyl group, hereinafter referred to as a vinyl monomer) or a copolymer composed of a vinyl monomer described above and a non-color forming ethylenic monomer which does not undergo coupling with the oxidation product of an aromatic primary amine developing agent.

Of the magenta dye forming couplers represented by general formula (I), preferred couplers are those represented by the following general formula (Ia), (Ib), (Ic), (Id), (Ie) (If) or (Ig):

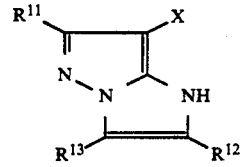

(Ia)

-continued (I-b)

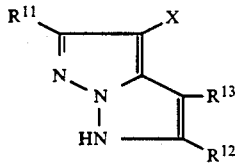

(Ic)

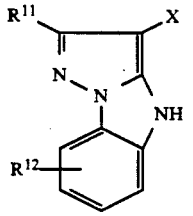

(Id)

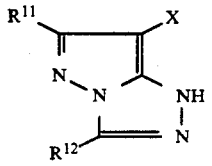

(Ie)

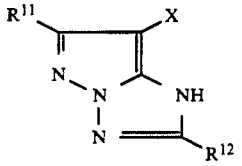

(If)

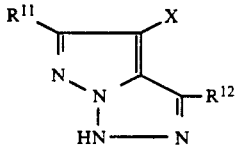

(Ig)

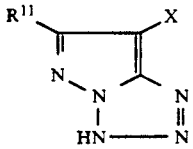

In general formula (Ia), (Ib), (Ic), (Id), (Ie), (If) or (Ig), $R^{11}$, $R^{12}$ and $R^{13}$, which may be the same or different, each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or aryloxycarbonyl group; and X represents a hydrogen atom, a halogen atom, a carboxy group or a group capable of being released upon coupling which is bonded to the carbon atom at the coupling position of the coupler through an oxygen atom, a nitrogen atom or a sulfur atom, and preferably represents a hydrogen atom or a group capable of being released upon coupling bonded to the coupling position through a sulfur atom. Also, $R^{11}$, $R^{12}$, $R^{13}$ or X may be a divalent group to form a bis coupler. Further, the coupler represented by general formula (Ia), (Ib), (Ic), (Id), (Ie), (If) or (Ig) may be in the form of a polymer coupler in which the coupler moiety exists at the main chain or the side chain of the polymer, and particularly a polymer coupler derived from a vinyl monomer having the coupler moiety represented by the general formulae (Ia) to (Ig) described above is preferred. In this case, $R^{11}$, $R^{12}$, $R^{13}$ or X represents a vinyl group or a linking group.

In more detail, $R^{11}$, $R^{12}$ and $R^{13}$ each represents a hydrogen atom, a halogen atom (e.g., chlorine, or bromine), an alkyl group (e.g., methyl, propyl, tert-butyl, trifluoromethyl, tridecyl, 3-(2,4-di-tert-amylphenoy)-propyl, allyl, 2-dodecyloxyethyl, 3-phenoxypropyl, 2-hexylsulfonylethyl, cyclopentyl, or benzyl), an aryl group (e.g., phenyl, 4-tert-butylphenyl, 2,4-di-tert-amylphenyl, or 4-tetradecanamidophenyl), a heterocyclic group (e.g., 2-furyl, 2-thieny1,2-pyrimidinyl, or 2-benzothiazolyl), a cyano group, an alkoxy group (e.g., methoxy, ethoxy, 2-methoxyethoxy, 2-dodecyloxyethoxy, or 2-methanesulfonylethoxy), an aryloxy group (e.g., phenoxy, 2-methylphenoxy, or 4-tert-butylphenoxy), a heterocyclic oxy group (e.g., 2-benzimidazolyloxy), an acyloxy group (e.g., acetoxy, or hexadecanoyloxy), a carbamoyloxy group (e.g., N-phenylcarbamoyloxy, or N-ethylcarbamoyloxy), a silyloxy group (e.g., trimethylsilyloxy), a sulfonyloxy group (e.g., dodecylsulfonyloxy), an acylamino group (e.g., acetamido, benzamido, tetradecanamido, α-(2,4-di-tert-amylphenoxy)butylamido, γ-(3-tert-butyl-4-hydroxyphenoxy)butylamido, or α-[4-(4-hydroxyphenylsulfonyl)phenoxy]decanamido), an anilino group (e.g., phenylamino, 2-chloroanilino, 2-chloro-5-tetradecanamidoanilino, 2-chloro-5-dodecyloxycarbonylanilino, N-acetylanilino, or 2-chloro-5-[α-(3-tert-butyl-4-hydroxyphenoxy)dodecanamido]anilino), a ureido group (e.g., phenylureido, methylureido, or N,N-dibutylureido), an imido group (e.g., N-succinimido, 3-benzylhydantoinyl, or 4-(2-ethylhexanoylamino)phthalimido), a sulfamoylamino group (e.g., N,N-dipropylsulfamoylamino, or N-methyldecylsulfamoylamino), an alkylthio group (e.g., methylthio, octylthio, tetradecylthio, 2-phenolxyethylthio, 3-phenoxypropylthio, or 3-(4-tert-butylphenoxy)propylthio), an arylthio group (e.g., phenylthio, 2-butoxy-5-tert-octylphenylthio, 3-pentadecylphenylthio, 2-carboxyphenylthio, or 4-tetradecanamidophenylthio), a heterocyclic thio group (e.g., 2-benzothiazolylthio), an alkoxycarbonylamino group (e.g., methoxycarbonylamino, or tetradecyloxycarbonylamino), an aryloxycarbonylamino group (e.g., phenoxycarbonylamino, or 2,4-di-tert-butylphenoxycarbonylamino), a sulfonamido group (e.g., methanesulfonamido, hexadecanesulfonamido, benzenesulfonamido, p-toluenesulfonamido, octadecanesulfonamido, or 2-methyloxy-5-tert-butylbenzenesulfonamido), a carbamoyl group (e.g., N-ethylcarbamoyl, N-N-dibutylcarbamoyl, N-(2-dodecyloxyethyl)carbamoyl, N-methyl-N-dodecylcarbamoyl, or N-[3-(2,4-di-tert-amylphenoxy)propyl]carbamoyl), an acyl group (e.g., acetyl, (2,4,-di-tert-amylphenoxy)acetyl, or benzoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, or N,N-diethylsulfamoyl), a sulfonyl group (e.g., methanesulfonyl, octanesulfonyl, benzenesulfonyl, or toluenesulfonyl), a sulfinyl group (e.g., octanesulfinyl, dodecylsulfinyl, or phenylsulfinyl), an alkoxycarbonyl group (e.g., methoxycarbonyl, butyloxycarbonyl, dodecyloxycarbonyl, or octadecyloxycarbonyl) or an aryloxycarbonyl group (e.g., phenyloxycarbonyl, or 3-pentadecylphenyloxycarbonyl); and X represents a hydrogen atom; a halogen atom (e.g., chlorine, bromine, or iodine); a carboxy group; a group bonded to the coupling position through an oxygen atom (e.g., acetoxy, propanoyloxy, benzoyloxy, 2, 4-dichlorobenzoyloxy, ethoxyoxazoyloxy, pyruvinyloxy, cinnamoyloxy, phenoxy, 4-cyanophenoxy, 4-methanesulfonamidophenoxy, 4-methanesulfonylphenoxy, α-naphthoxy, 3-pentadecylphenoxy, benzyloxycarbonyloxy, ethoxy, 2-cyanoethoxy, benzyloxy, 2-phenetryloxy, 2-phenoxyethoxy, 5-phenyltetrazolyloxy, or 2-benzothiazolyloxy); a group bonded to the coupling position through a nitrogen atom (e.g., benzenesulfonamido, N-ethyltoluenesulfonamido, heptafluorobutanamido, 2,3,4,5,6-pentafluorobenzamido, octanesulfonamido, p-cyanophenylureido, N,N-diethylsulfamoylamino, 1-piperidyl, 5,5-dimethyl-2,4-dioxo-3-oxazolidinyl, 1-benzyl-5-ethoxy-3-hydantoinyl, 2N-1,1-dioxo-3-(2H)-oxo-1,2-benzisothiazolyl, 2-oxo-1,2-dihydro-1-pyridinyl, imidazolyl, pyrazolyl, 3,5-diethyl-1,2,4-triazol-1 yl, 5- or 6-bromobenzotriazol-1-yl, 5-methyl-1,2,3,4-tetrazol-1-yl, benzimidazolyl, 3-benzyl-1-hydantoinyl, 1-benzyl-5-hexadecyloxy-3-hydantoinyl, or 5-methyl-1-tetrazolyl); an arylazo group (e.g., 4-methoxyphenylazo, 4-pivaloylaminophenylazo, 2-naphthylazo, or 3-methyl-4-hydroxyphenylazo); or a group bonded to the coupling position through a sulfur atom (e.g., phenylthio, 2-carboxyphenylthio, 2-methoxy-5-tert-octylphenylthio, 4-methanesulfonylphenylthio, 4-octanesulfonamidophenylthio, 2-butoxyphenylthio, 2-(2-hexanesulfonylethyl)-5-tert-octylphenylthio, benzylthio, 2-cyanoethylthio, 1-ethoxycarbonyltridecylthio, 5-phenyl-2,3,4,5-tetrazolylthio, 2-benzothiazolylthio, 2-dodecylthio-5-thiophenylthio, or 2-phenyl-3-dodecyl-1,2,4-triazolyl-5-thio).

In the coupler represented by general formula (Ia) or (Ib), $R^{12}$ and $R^{13}$ may combine with each other to form a 5-membered, 6-membered or 7-membered ring.

When $R^{11}$, $R^{12}$, $R^{13}$ or X represents a divalent group to form a bis coupler, $R^{11}$, $R^{12}$ or $R^{13}$ preferably represents a substituted or unsubstituted alkylene group (e.g., methylene, ethylene, 1,10-decylene, or $—CH_2CH_2—O—CH_2CH_2—$), a substituted or unsubstituted phenylene group, (e.g., 1,4-phenylene, 1,3-phenylene,

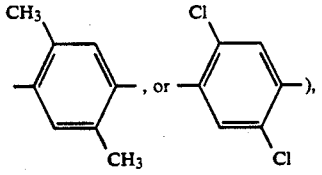

an $—NHCO—R^{14}—CONH—$ group (wherein $R^{14}$ represents a substituted or unsubstituted alkylene or phenylene group, e.g., $—NHCOCH_2CH_2CONH—$,

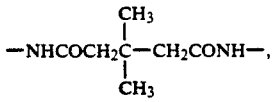

-continued

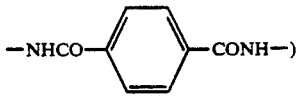

or an $—S—R^{15}—S—$ group (wherein $R^{15}$ represents a substituted or unsubstituted alkylene group, e.g., $—S—CH_2CH_2—S—$, or

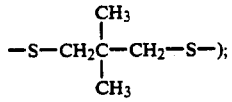

and X represents a divalent group appropriately formed from the monovalent group for X described above.

The linking group represented by $R^{11}$, $R^{12}$, $R^{13}$ or X in the cases wherein the coupler moiety represented by general formula (Ia), (Ib), (Ic), (Id), (Ie), (If) or (Ig) is included in a vinyl monomer includes an alkylene group (including a substituted or unsubstituted alkylene group, e.g., methylene, ethylene, 1,10-decylene, or $—CH_2CH_2OCH_2CH_2—$), a phenylene group (including a substituted or unsubstituted phenylene group, e.g., 1,4-phenylene, 1,3-phenylene,

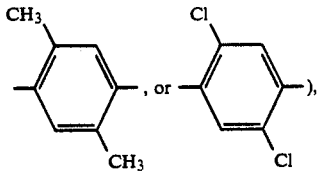

—NHCO—, —CONH—, —O—, —OCO—, and an aralkylene group (e.g.,

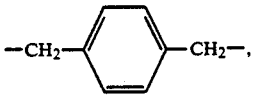

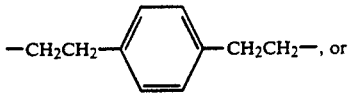

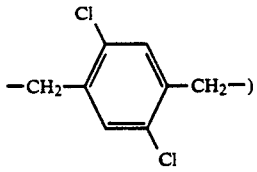

or a combination thereof.

Specific examples of preferred linking groups are set forth below.

—NHCO—, $—CH_2CH_2—$,

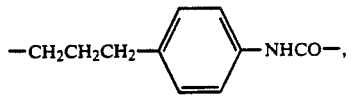

-continued

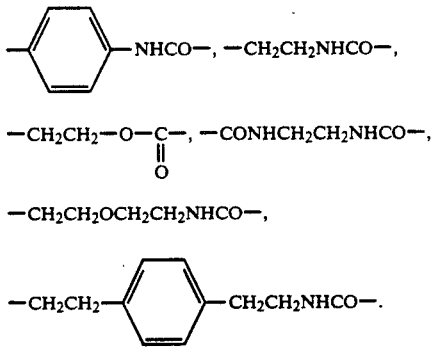

Further, a vinyl group in the vinyl monomer wherein the coupler moiety represented by general formula (Ia), (Ib), (Ic), (Id), (Ie), (If) or (Ig) is included may further have a substituent in addition to the coupler moiety represented by general formula (Ia), (Ib), (Ic), (Id), (Ie), (If) or (Ig). Preferred examples of the substituents include a hydrogen atom, a chlorine atom or a lower alkyl group having from 1 to 4 carbon atoms, for example, methyl, or ethyl.

Among the couplers represented by general formula (Ia), (Ib), (Ic), (Id), (Ie), (If) or (Ig), the couplers represented by general formulae (Ia), (Id) or (Ie) are preferred for the purpose of the present invention. Further, the couplers represented by general formula (Ie) are more preferred.

A monomer containing the coupler moiety represented by general formula (Ia), (Ib), (Ic), (Id), (Ie), (If) or (Ig) may form a copolymer together with a non-color forming ethylenic monomer which does not undergo coupling with an oxidation product of an aromatic primary amine developing agent.

Examples of non-color forming ethylenic monomers which do not undergo coupling with an oxidation product of an aromatic primary amine developing agent include an acrylic acid such as acrylic acid, α-chloroacrylic acid, and α-alkylacrylic acid (e.g., methacrylic acid), an ester or an amide derived from an acrylic acid (e.g., acrylamide, n-butylacrylamide, tert-butylacrylamide, diacetoneacrylamide, methacrylamide, methyl acrylate, ethyl acrylate, n-propyl acrylate, n-butyl acrylate, tert-butyl acrylate, isobutyl acrylate, 2-ethylhexyl acrylate, n-octyl acrylate, lauryl acrylate, methyl methacrylate, ethyl methacrylate, n-butyl methacrylate, or β-hydroxy methacrylate), methylenedibisacrylamide, a vinyl ester (e.g., vinyl acetate, vinyl propionate, or vinyl laurate), acrylonitrile, methacrylonitrile, an aromatic vinyl compound (e.g., styrene or a derivative thereof, vinyltoluene, divinylbenzene, vinylacetophenone, or sulfostyrene), itaconic acid, citraconic acid, crotonic acid, vinylidene chloride, a vinyl alkyl ether (e.g., vinyl ethyl ether), maleic acid, maleic anhydride, a maleic acid ester, N-vinyl-2-pyrrolidone, N-vinylpyridine, or 2- or 4-vinylpyridine.

Two or more kinds of non-color forming ethylenically unsaturated monomers can be used together. For example, a combination of n-butyl acrylate and methyl acrylate, styrene and methacrylic acid, methacrylic acid and acrylamide, or methyl acrylate and diacetoneacrylamide can be used.

As is well known in the field of polymer color couplers, the non-color forming ethylenically unsaturated monomer which is copolymerized with a solid water-insoluble monomer coupler can be selected in such a manner that the copolymer formed has good physical properties and/or chemical properties, for example, solubility, compatibility with a binder such as gelatin in a photographic colloid composition, flexibility, or heat stability.

The polymer couplers used in the present invention may be water-soluble couplers or water-insoluble couplers, but polymer coupler latexes are particularly preferred as such polymer couplers.

Specific examples of the pyrazoloazole type magenta couplers represented by general formula (I) which can be used in the present invention and methods for syntheses thereof are described, for example, in JP-A-59-162548, JP-A-60-43659, JP-A-59-171956, JP-A-60-172982, JP-A-60-33552 and U.S. Pat. No. 3,061,432.

Of the pyrazoloazole type magenta couplers represented by general formula (I), pyrazolotriazole type couplers are preferred, and those having a branched chain alkyl group (including a substituted branched chain alkyl group) at the 2-, 3- or 6-position and a halogen atom as a group capable of being released, and those having an alkyl group or an aryl group at the 2- or 3-position, an alkoxy group or an aryloxy group at the 6-position and a group capable of being released bonded to the coupling position through a sulfur atom are particularly preferred.

Specific examples of representative magenta couplers and vinyl monomers for preparing polymer couplers according to the present invention are set forth below by compounds (M-1) to (M-58), but the present invention should not be construed as being limited thereto.

(M-1)

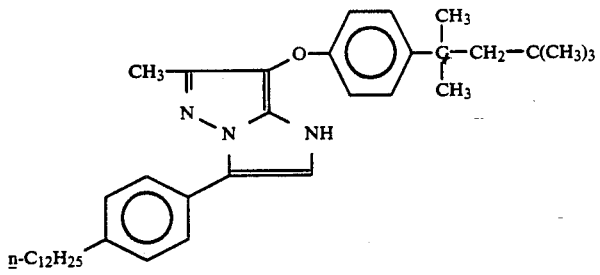

-continued
(M-2)
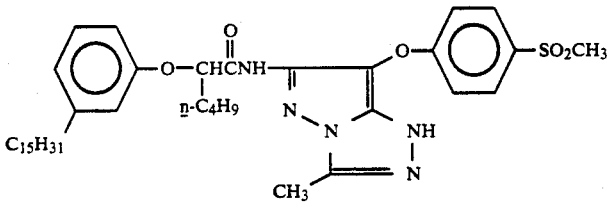
(M-3)
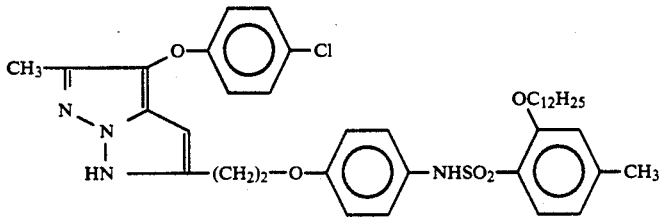
(M-4)
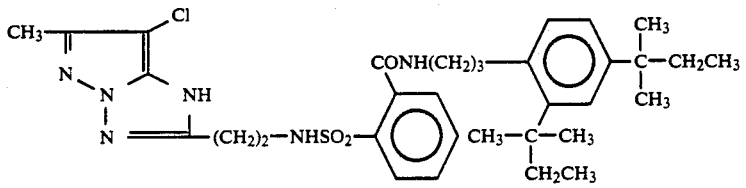
(M-5)
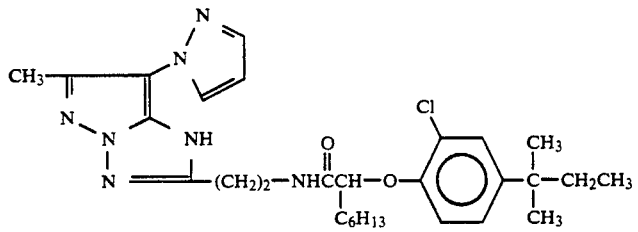
(M-6)
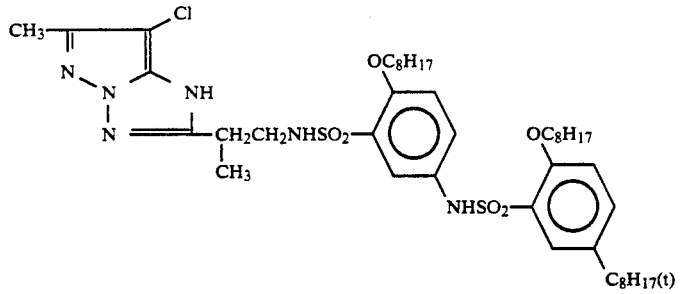
(M-7)
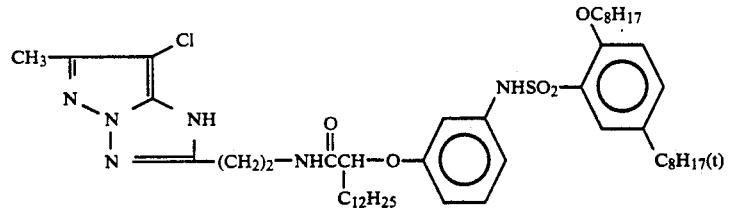
(M-8)
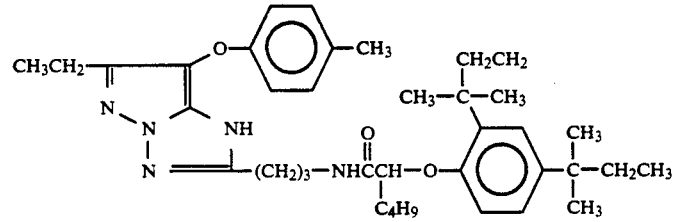

-continued
(M-9)
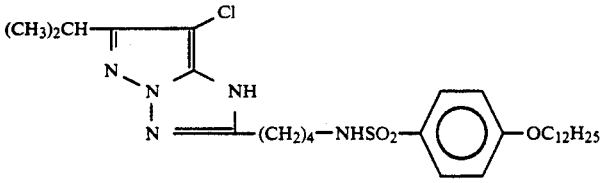
(M-10)
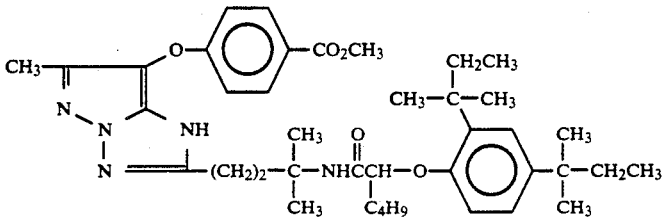
(M-11)
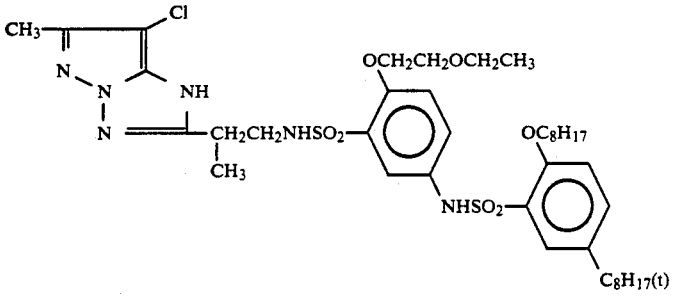
(M-12)
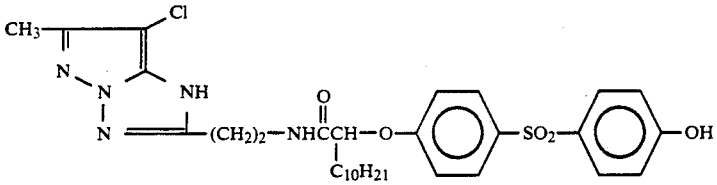
(M-13)
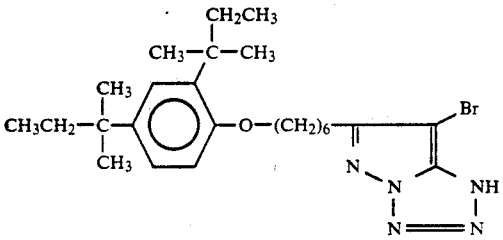
(M-14)
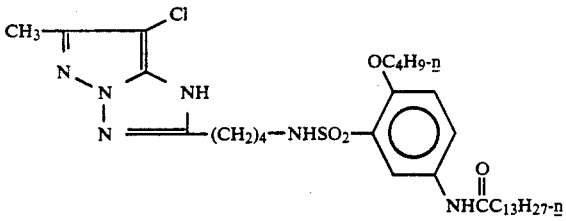
(M-15)
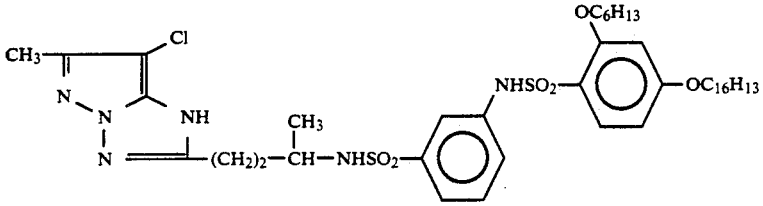

-continued
(M-16)
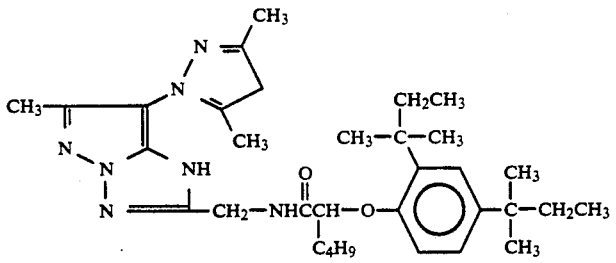
(M-17)
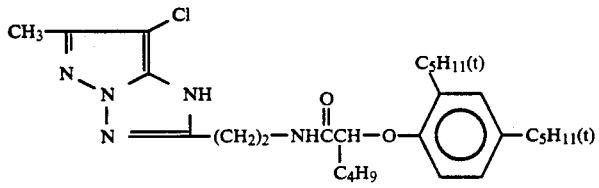
(M-18)
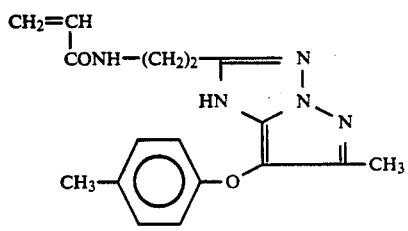
(M-19)
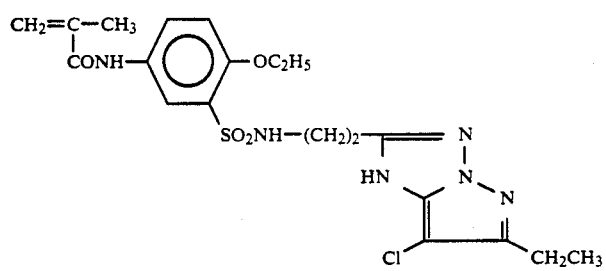
(M-20)
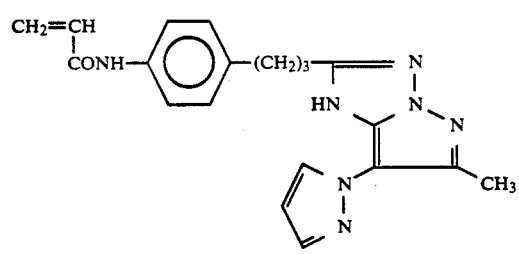
(M-21)
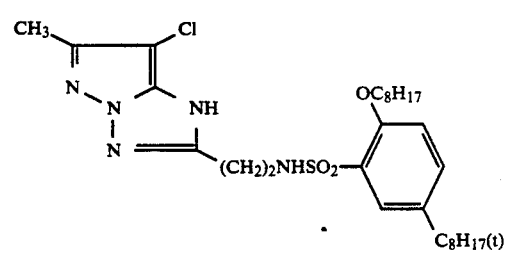

-continued
(M-22)
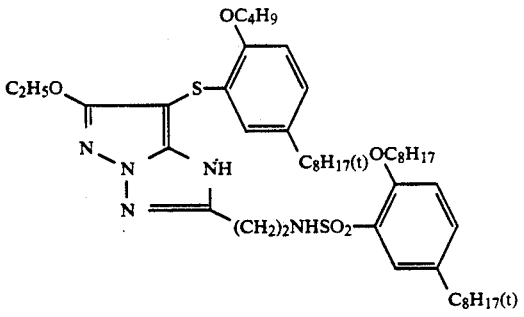
(M-23)
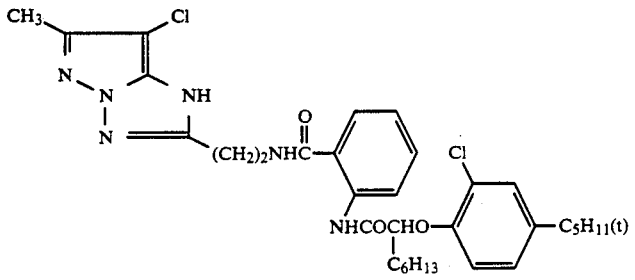
(M-24)
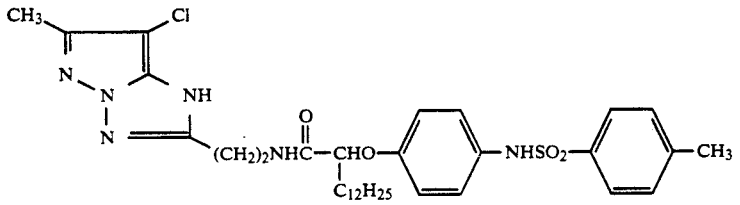
(M-25)
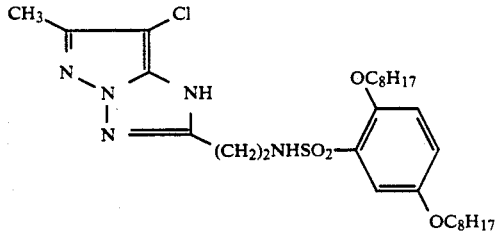
(M-26)
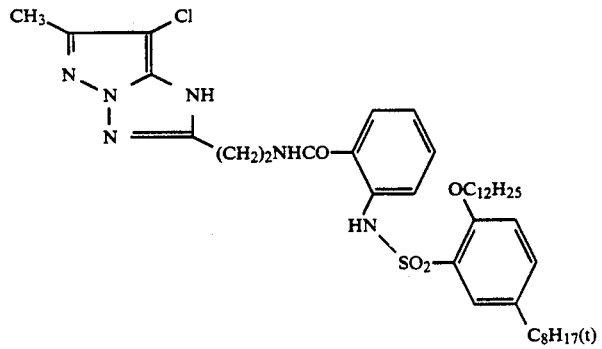

-continued
(M-27)
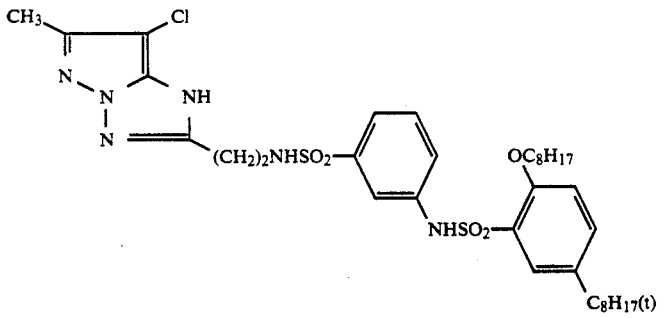
(M-28)
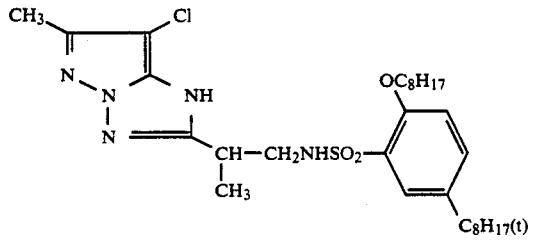
(M-29)
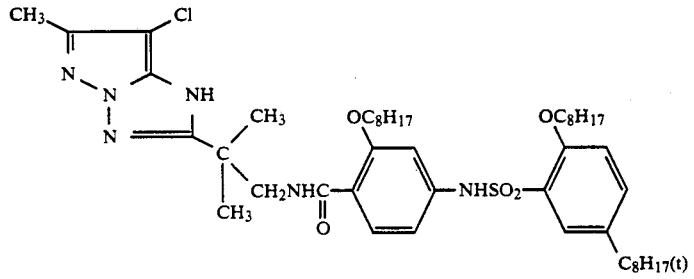
(M-30)
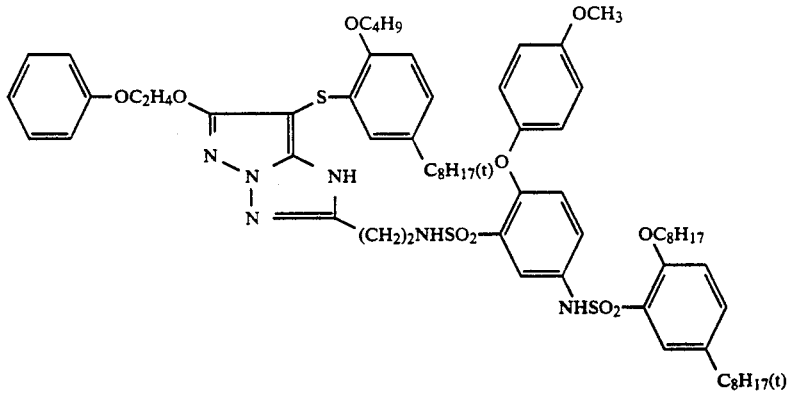
(M-31)
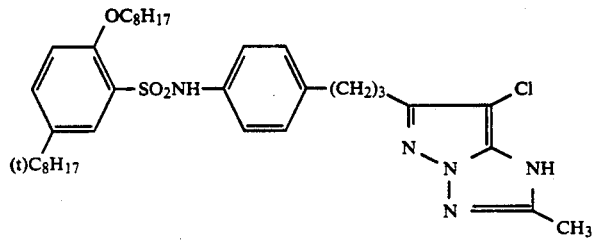

-continued
(M-32)
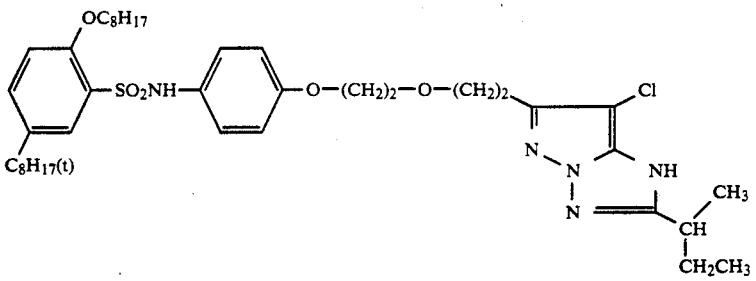
(M-33)
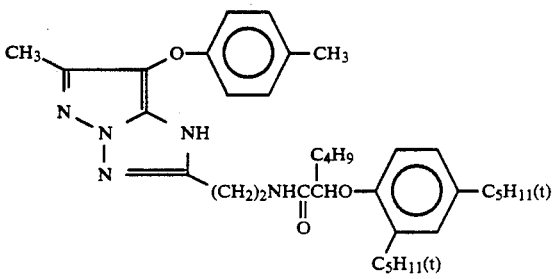
(M-34)
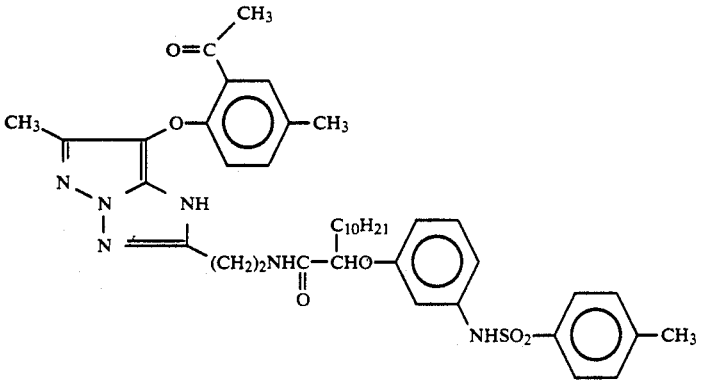
(M-35)
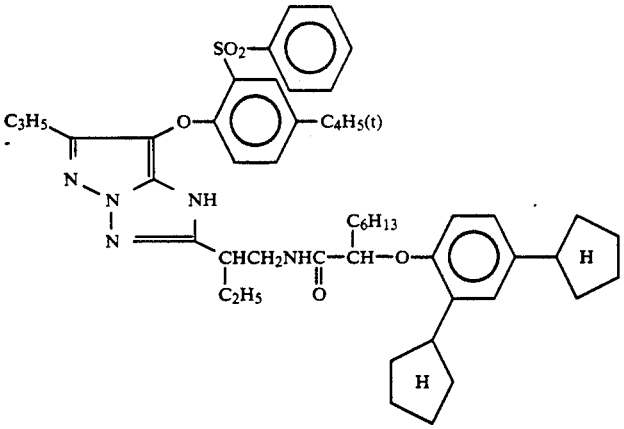
(M-36)
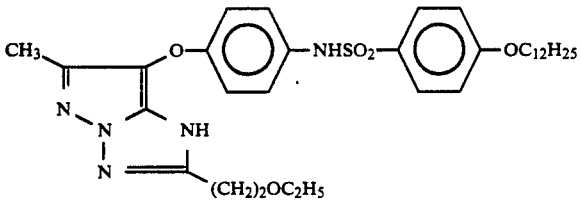

-continued
(M-37)
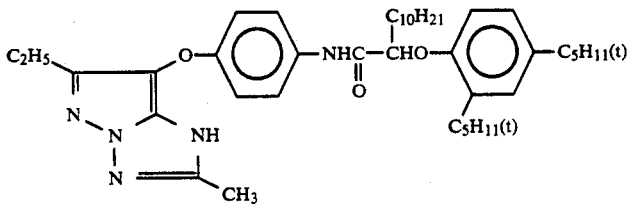
(M-38)
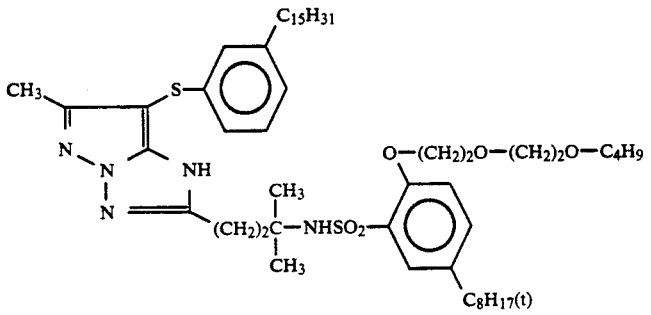
(M-39)
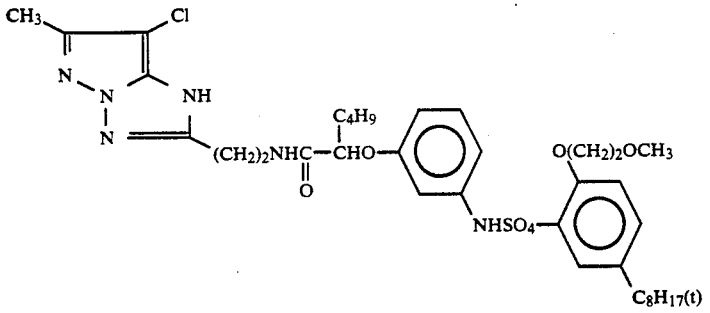
(M-40)
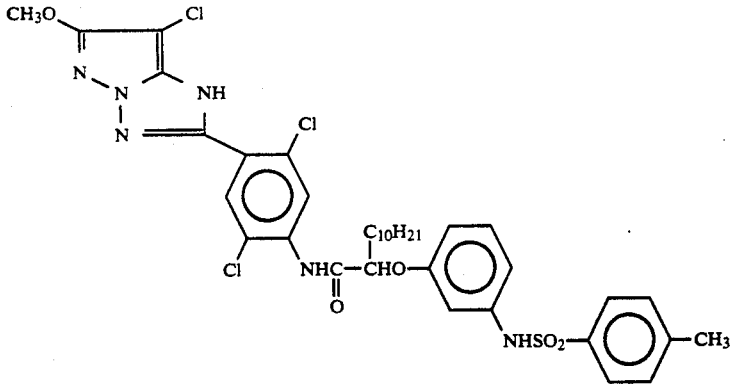
(M-41)
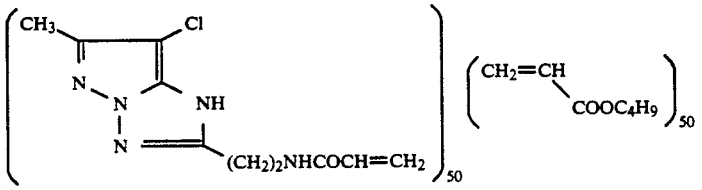

-continued
(M-42)
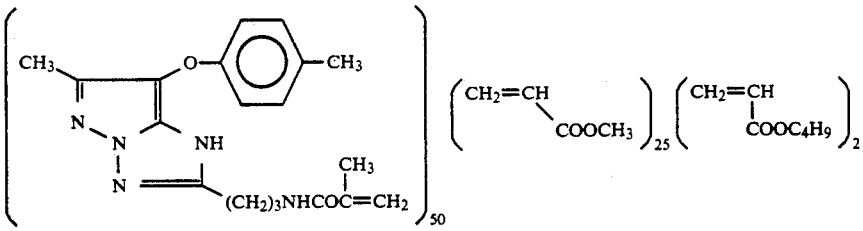
(M-43)
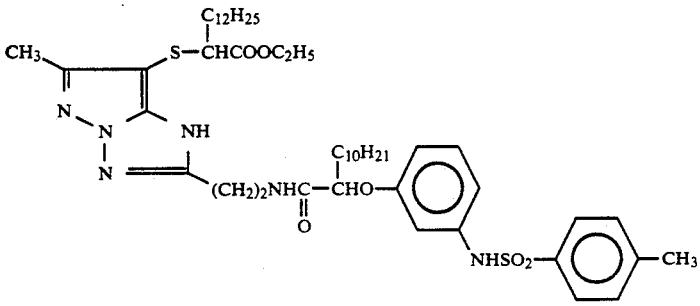
(M-44)
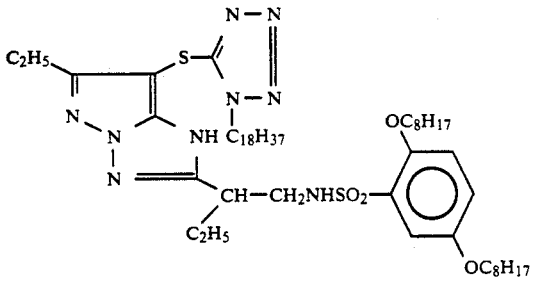
(M-45)
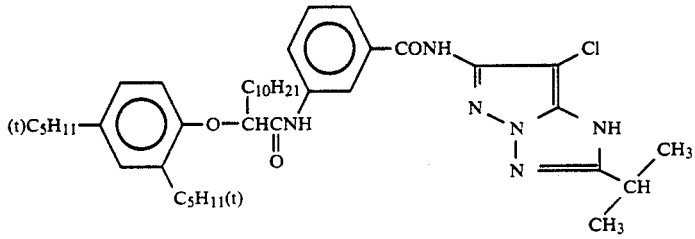
(M-46)
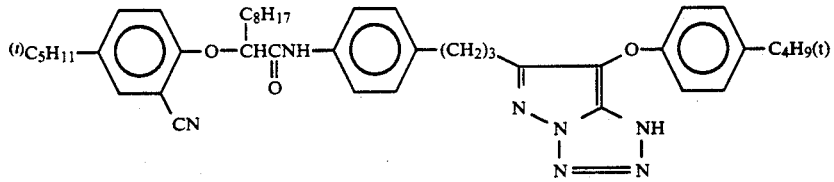
(M-47)
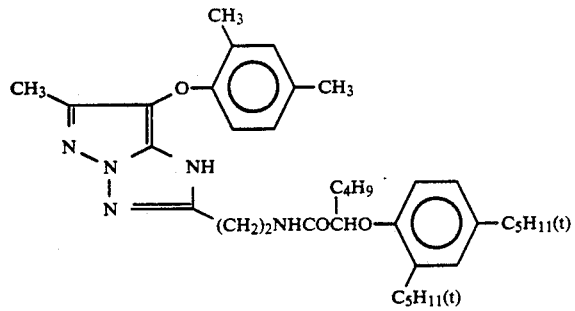

-continued
(M-48)
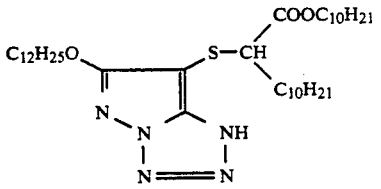
(M-49)
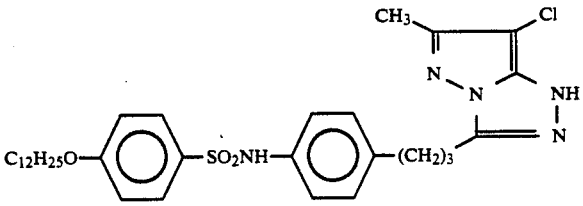
(M-50)
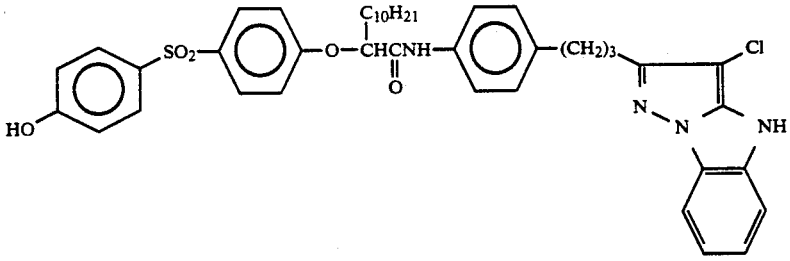
(M-51)
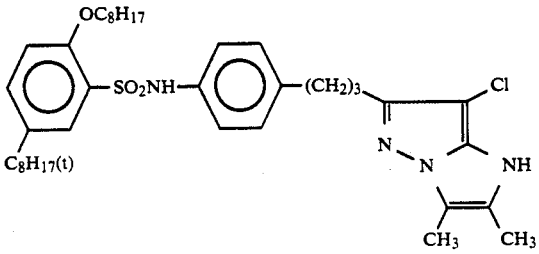
(M-52)
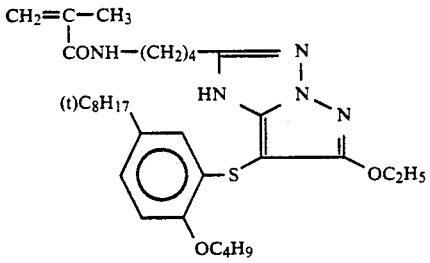
(M-53)
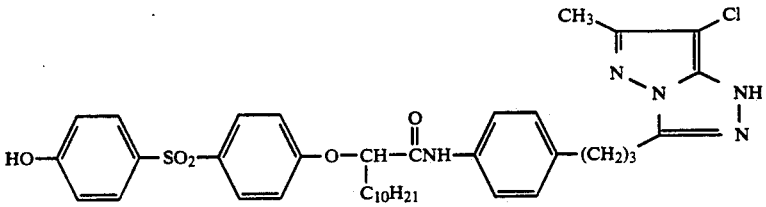
(M-54)
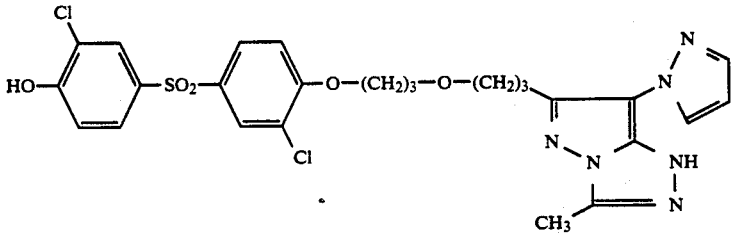

-continued (M-55)

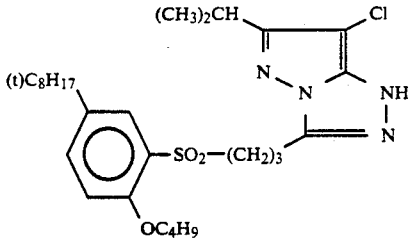

(M-56)

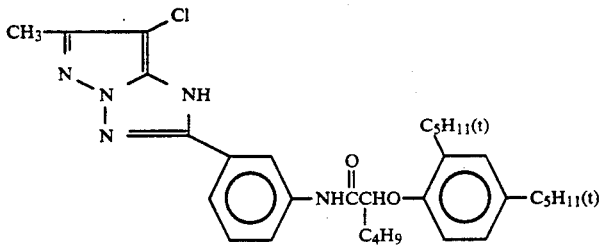

(M-57)

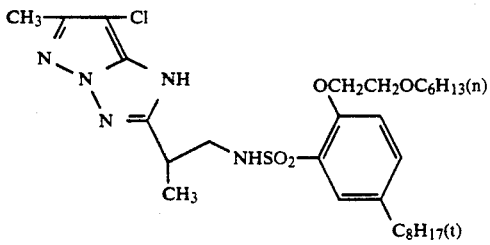

(M-58)

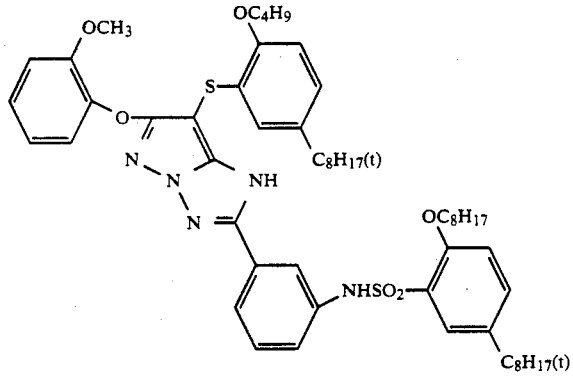

The magenta dye forming coupler represented by general formula (I) according to the present invention is incorporated into an emulsion layer in an amount from about $1\times10^{-3}$ mol to about 1 mol, preferably from about $5\times10^{-2}$ mol to about $5\times10^{-1}$, per mol of silver halide present in the emulsion layer. Two or more kinds of magenta dye forming couplers according to the present invention may be incorporated into the same emulsion layer.

The magenta dye forming coupler according to the present invention is preferably incorporated into a green-sensitive emulsion layer.

Now, the compound represented by general formula (II) used in the present invention will be described in detail below.

The heterocyclic ring, which may be condensed with a benzene ring, formed with Q in the general formula (II) includes imidazole, tetrazole, thiazole, thiadiazole, oxazole, selenazole, benzimidazole, naphthimidazole, benzothiazole, naphthothiazole, benzoselenazole, naphthoselenazole, benzoxazole, pyridine, pyrimidine, or quinoline. The heterocyclic ring may be substituted.

Particularly preferred heterocyclic rings according to the present invention include tetrazole, thiadiazole, benzimidazole, benzoxazole, or benzothiazole.

Preferred mercapto tetrazole compounds of formula (II) are selected from the compounds represented by the following general formula (B):

(B)

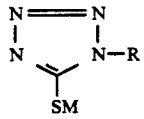

wherein R represents an alkyl group, an alkenyl group or an aryl group which each has preferably 8 or less carbon atoms including carbon numbers included in substituents thereof; and M represents a hydrogen atom, an alkali metal atom, an ammonium group or a precursor thereof.

Examples of the alkali metal atom include a sodium atom, and a potassium atom. Examples of the ammonium group include a trimethylammonium chloride group, and dimethylbenzyl ammonium chloride group. The term "precursor" as used herein means a group which, under an alkaline condition, can provide M=H or M=alkali metal. Examples of the precursor include an acetyl group, a cyanoethyl group, and a methanesulfonylethyl group, and a group forming sodium salt or potassium salt under alkaline condition, for example, by an addition of NaOH or KOH.

Examples of the alkyl group or alkenyl group represented by R include an unsubstituted or substituted, cyclic alkyl or alkenyl group. Examples of substituents for the substituted alkyl group include a halogen atom, an alkoxy group, an aryl group, an acylamino group, an alkoxycarbonylamino group, a ureido group, a hydroxy group, an amino group, a heterocyclic group, an acyl group, a sulfamoyl group, a sulfonamido group, a thioureido group, a carbamoyl group, a carboxylic acid group, a sulfonic acid group, and a salt thereof.

Examples of the above described ureido group, thioureido group, sulfamoyl group, carbamoyl group, and amino group include an unsubstituted, N-alkyl-substituted or N-aryl-substituted group. Examples of the above described aryl group include a phenyl group and a substituted phenyl group. Examples of the substituents for the substituted phenyl group include an alkyl group and those described with reference to the above described substituted alkyl group.

Preferred mercapto thiadiazole compounds of formula (II) are selected from compounds represented by the following general formula (E):

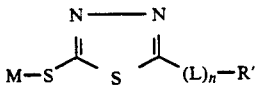

(E)

wherein L represents a divalent connecting group; R′ represents a hydrogen atom, an alkyl group, an alkenyl group or an aryl group; M represents a hydrogen atom, an alkali metal atom, an ammonium group or a precursor thereof; and n represents 0 or 1.

Specific examples of the above described divalent linking group represented by L include

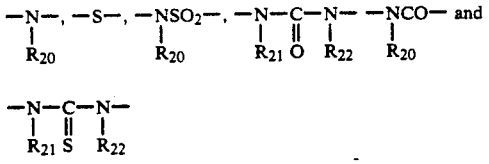

(wherein $R_{20}$, $R_{21}$ and $R_{22}$ each represents a hydrogen atom, an alkyl group or an aralkyl group).

The alkyl group, alkenyl group and aryl group represented by R′ have the same meaning as there described for R in the general formula (B) described above, and M has the same meaning as those described in the general formula (B) hereinbefore, respectively.

Further, preferred mercapto benzimidazole, mercapto oxazole and mercapto thiazole compounds of formula (II) are selected from the compounds represented by the following general formula (D):

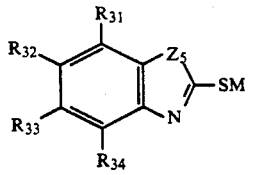

(D)

wherein $Z_5$ represents —O—,

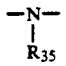

or —S—; $R_{31}$, $R_{32}$, $R_{33}$, $R_{34}$ and $R_{35}$ each represents a hydrogen atom or a substituent; and M represents a hydrogen atom, an alkali metal atom, an ammonium group or a precursor thereof.

Specific examples of the substituent represented by $R_{31}$, $R_{32}$, $R_{33}$, $R_{34}$ or $R_{35}$ include a halogen atom (e.g., fluorine, chlorine, or bromine), a substituted or unsubstituted alkyl group (e.g., methyl, trifluoromethyl, ethyl, 2-ethylhexyl, 2-ethylbutyl, or 3-methylpentyl), a substituted or unsubstituted aryl group (e.g., phenyl, or 4-chlorophenyl), a substituted or unsubstituted alkoxy or aryloxy group (e.g., methoxy, phenoxy, 2-ethylhexyloxy, 3,3-dimethylbutoxy group, or 3-methylpentyloxy), a substituted or unsubstituted sulfonyl group (e.g., methanesulfonyl, p-toluenesulfonyl, 2-ethylhexylsulfonyl, or 2-methylpentylsulfonyl), a substituted or unsubstituted sulfonamido group (e.g., methanesulfonamido, p-toluenesulfonamido, or 2-ethylhexanesulfonamido), a substituted or unsubstituted sulfamoyl group (e.g., diethylsulfamoyl, 4-chlorophenylsulfamoyl, 1,3-dimethylbutylsulfamoyl, 2-ethylhexylsulfamoyl, or 1-methylheptylsulfamoyl), a substituted or unsubstituted carbamoyl group (e.g., ethylcarbamoyl, 4-cyanophenylcarbamoyl, 2-ethylhexylcarbamoyl, or 1-methylhexylcarbamoyl), a substituted or unsubstituted amido group (e.g., acetamido, benzamido, 2-ethylhexanamido, 2-phenoxybutanamido, or 3,5,5-trimethylhexanamido), a substituted or unsubstituted ureido group (e.g., 3-methylureido, morpholinocarbonylamino, 3-(2-ethylhexyl)ureido, 3-(1,3-dimethylbutyl)ureido, 3-(1,5-dimethylhexyl)ureido, or 3-(2-methylheptyl)ureido), a substituted or unsubstituted aryloxycarbonylamino or alkoxycarbonylamino group (e.g., ethoxycarbonylamino, phenoxycarbonylamino, or 2-ethylhexyloxycarbonylamino), a substituted or unsubstituted aryloxycarbonyl or alkoxycarbonyl group (e.g., methoxycarbonyl, phenoxycarbonyl, 2-ethylhexyloxycarbonyl, 1-methyloctyloxycarbonyl, 2,4-diethylheptyloxycarbonyl, or 1-ethylpentyloxycarbonyl), a substituted or unsubstituted arylcarbonyloxy or alkylcarbonyloxy group (e.g., acetyloxy, benzoyloxy, or 2-ethylhexanoyloxy), a substituted or unsubstituted arylaminocarbonyloxy or alkylaminocarbonyloxy group (e.g., phenylaminocarbonyloxy, or 2-ethylhexylaminocarbonyloxy), a cyano group, a substituted or unsubstituted arylthio or alkylthio group (e.g., methylthio, ethylthio, phenylthio, 2-ethylhexylthio, 2,4,4-trimethylpentylthio, or 3-methylpentylthio), a substituted or unsubstituted carbonyl group (e.g., acetyl, benzoyl, 2-ethylhexanoyl), a substituted or unsubstituted amino group (e.g., unsubstituted amino, methylamino, diethylamino, or anilino), a carboxy group, a sulfo group, a hydroxy group, and a nitro group.

In general formula (D) above, $R_{31}$, $R_{32}$, $R_{33}$ and $R_{34}$ may be the same or different. M has the same meaning as described in general formula (B) hereinbefore.

It is preferred that at least one of $R_{31}$, $R_{32}$, $R_{33}$ and $R_{34}$ is a group containing a substituted or unsubstituted alkyl group having from 1 to 13 carbon atoms or a substituted or unsubstituted aryl group connected to the carbon atom of the benzene ring of formula (D) directly or through a divalent linking group. Particularly preferred divalent linking groups include an amido bond, a sulfonamido bond, a ureido bond, an ether bond, a thioether bond, a sulfonyl bond, a carbonyl bond, or a urethane bond.

Specific examples of the compound represented by general formula (II) according to the present invention are set forth below, but the present invention should not be construed as being limited thereto.

(B-1)

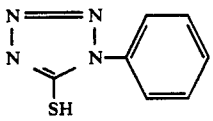

(B-2)

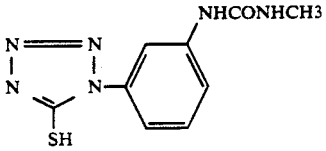

(B-3)

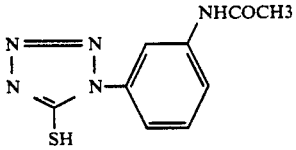

(B-4)

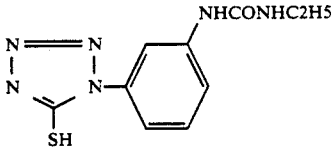

(B-5)

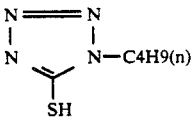

(B-6)

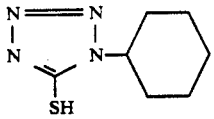

(B-7)

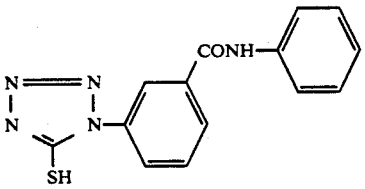

(B-8)

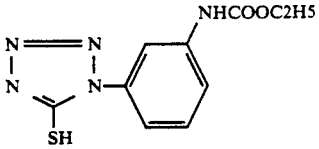

-continued (B-9)

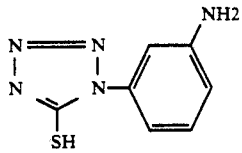

(B-10)

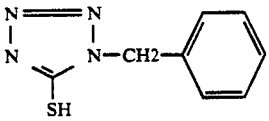

(B-11)

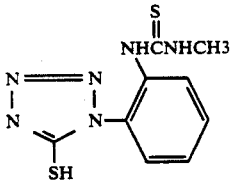

(B-12)

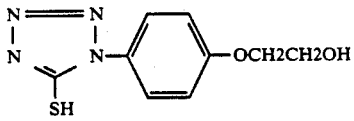

(E-1)

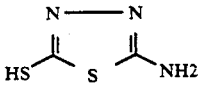

(E-2)

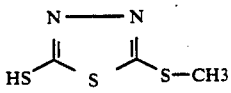

(E-3)

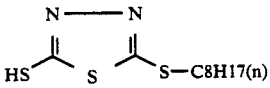

(E-4)

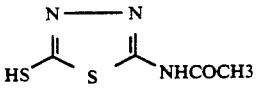

(E-5)

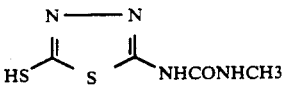

(E-6)

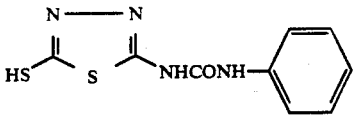

(D-1)

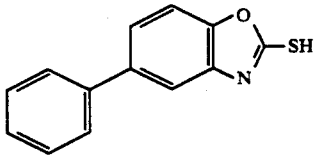

(D-2)

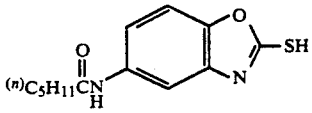

-continued
(D-3)
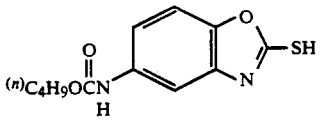
(D-4)
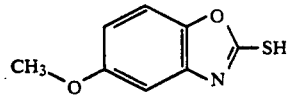
(D-5)
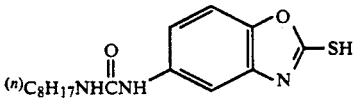
(D-6)
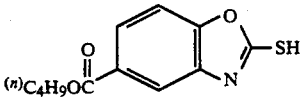
(D-7)
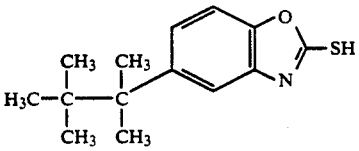
(D-8)
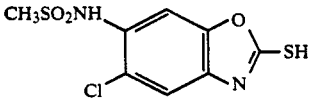
(D-9)
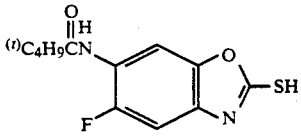
(D-10)
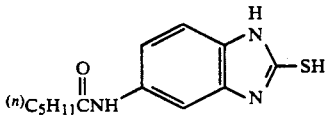
(D-11)
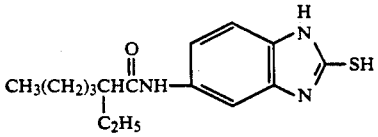
(D-12)
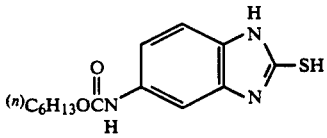
(D-13)
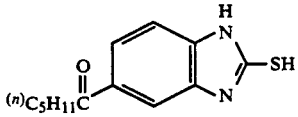
(D-14)
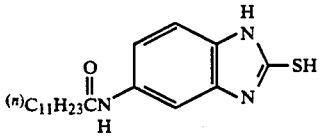
-continued
(D-15)
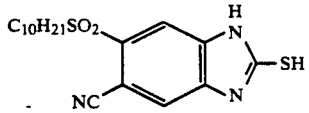
(D-16)
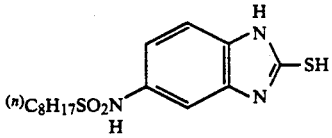
(D-17)
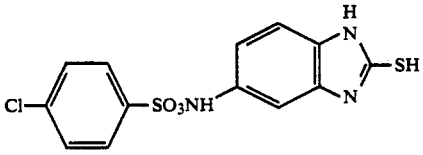
(D-18)
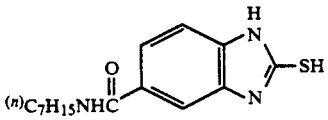
(D-19)
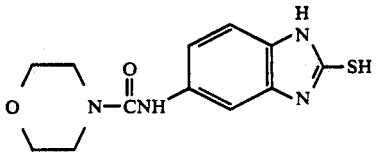
(D-10)
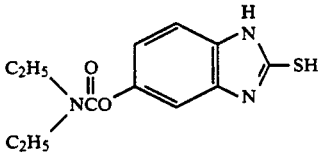
(D-21)
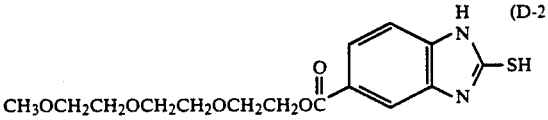
(D-22)
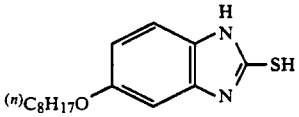
(D-23)
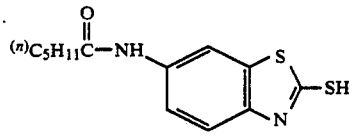
(D-24)
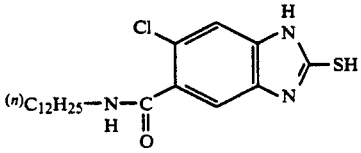
(D-25)
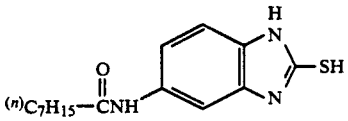

-continued (D-24)

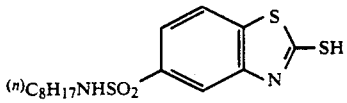

(D-27)

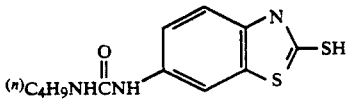

(D-28)

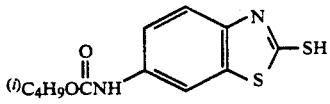

(D-29)

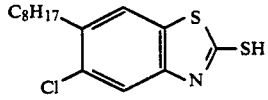

(D-30)

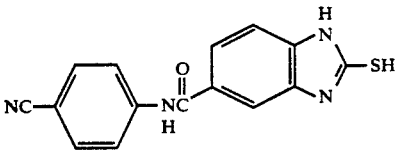

(D-31)

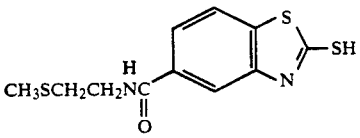

(D-32)

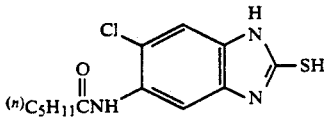

(D-33)

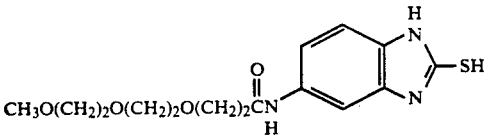

(D-34)

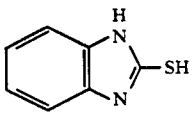

(D-35)

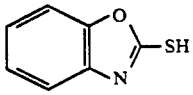

(D-36)

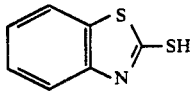

(D-37)

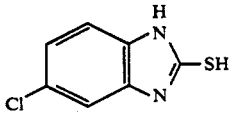

-continued (D-38)

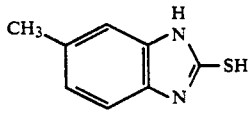

(D-39)

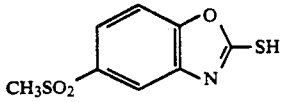

(D-40)

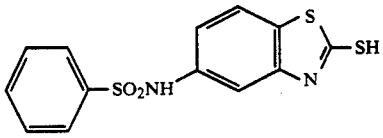

(D-41)

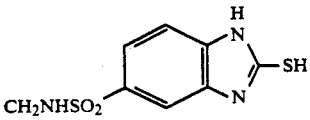

(D-42)

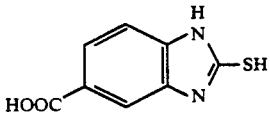

(D-43)

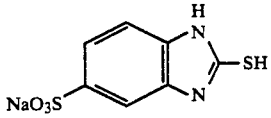

(D-44)

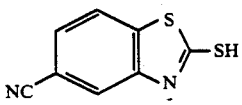

The compounds represents by general formula (II) used in the present invention can be easily synthesized with reference to synthesis methods as described, for example, in J. Van Allan, B. D. Deacon, *Org. Synth.*, Vol. IV, page 569 (1963), J. Bunner, *Ber.*, Vol. 9, page 465 (1876), L. B. Sebrell, C. E. Boord, *J. Am. Chem. Soc.*, Vol. 45, page 2390 (1923).

The amount of the compound represented by general formula (II) to be incorporated is preferably about $1\times10^{-5}$ to about $5\times10^{-2}$ mol, more preferably from about $1\times10^{-4}$ to about $1\times10^{-2}$ mol, per mol of silver halide.

The compounds represented by general formula (II) can be used individually or in a combination of two or more thereof to exhibit sufficiently the effect according to the present invention.

Particularly preferred combinations are those of at least one compound represented by general formula (E) and at least one compound represented by general formula (D). The molar ratio of the compounds in the combination when two compounds are employed is preferably from 1:9 to 9:1, more preferably from 2:8 to 8:2, and most preferably from 3:7 to 7:3.

The addition of the compound represented by general formula (II) to a silver halide emulsion may be made at any point in the production of the silver halide emulsion, that is, just after grain formation, or before, during or after chemical ripening. Particularly, it is preferred to conduct the addition thereof after the chemical ripening of the emulsion and after the completion of the addition of the compound represented by general formula (III) to the emulsion.

The compound represented by general formula (II) is preferably incorporated into a red-sensitive emulsion layer. It is preferred that the compound is also incorporated into other light-sensitive emulsion layers (for example, a green-sensitive emulsion layer, a blue-sensitive emulsion layer or an infrared-sensitive emulsion layer).

The color photographic light-sensitive material of the present invention comprises a support having coated thereon at least three silver halide emulsion layers which have different spectral sensitivities from each other. One representative example of these layers is a combination of a blue-sensitive emulsion layer, a green-sensitive emulsion layer and a red-sensitive emulsion layer. Although the order of these layers is preferably that described above from the support, it can be varied appropriately depending on the purpose.

Another combination of three light-sensitive layers having different color sensitivities from each other is a combination including an infrared-sensitive emulsion layer, for example, a combination of an infrared-sensitive emulsion layer, a red-sensitive emulsion layer and a green-sensitive emulsion layer. The photographic light-sensitive material having a such type of layer construction is suitable for scanning exposure utilizing a laser.

Now, the compound represented by general formula (III) used in the present invention will be described in detail below.

In general formula (III), Z represents an oxygen atom or a sulfur atom.

A preferred alkyl group represented by $R_4$ or $R_5$ includes an unsubstituted alkyl group having 18 or less carbon atoms (e.g., methyl, ethyl, propyl, butyl, pentyl, hexyl, heptyl, octyl, decyl, dodecyl, or octadecyl), or a substituted alkyl group having 18 or less carbon atoms with the substituents being, for example, a carboxy group; a sulfo group; a cyano group; a halogen atom (e.g., fluorine, chlorine, or bromine); a hydroxy group; an alkoxycarbonyl group having 8 or less carbon atoms (e.g., methoxycarbonyl, ethoxycarbonyl, phenoxycarbonyl, or benzyloxycarbonyl); an alkoxy group having 8 or less carbon atoms (e.g., methoxy, ethoxy, benzyloxy, or phenethyloxy); a monocyclic aryloxy group having 15 or less carbon atoms (e.g., phenoxy, or p-tolyloxy); an acyloxy group having 8 or less carbon atoms (e.g., acetyloxy, or propionyloxy); an acyl group having 8 or less carbon atoms (e.g., acetyl, propionyl, or benzoyl); a carbamoyl group (e.g., carbamoyl, N,N-dimethylcarbamoyl, morpholinocarbonyl, or piperidinocarbonyl); a sulfamoyl group (e.g., sulfamoyl, N,N-dimethylsulfamoyl, morpholinosulfonyl, or piperidinosulfonyl); and an aryl group having 15 or less carbon atoms (e.g., phenyl, 4-chlorophenyl, 4-methylphenyl, or α-naphthyl).

A preferred group for $R_4$ or $R_5$ is an unsubstituted alkyl group (e.g., methyl, ethyl, propyl, butyl, pentyl, hexyl, heptyl, or octyl), or a sulfoalkyl group (e.g., 2-sulfoethyl, 3-sulfopropyl, or 4-sulfobutyl).

It is particularly preferred that at least one of $R_4$ and $R_5$ is an unsubstituted alkyl group having from 5 to 8 carbon atoms.

$V_1$, $V_2$, $V_3$, $V_4$, $V_5$, $V_6$, $V_7$ and $V_8$ each preferably represents a hydrogen atom, a halogen atom (e.g., fluorine, chlorine, or bromine), an unsubstituted alkyl group having 10 or less carbon atoms (e.g., methyl, or ethyl), a substituted alkyl group having 18 or less carbon atoms (e.g., benzyl, α-naphthylmethyl, 2-phenylethyl, or trifluoromethyl), an acyl group having 8 or less carbon atoms (e.g., acetyl, or benzoyl), an acyloxy group having 8 or less carbon atoms (e.g., acetyloxy), an alkoxycarbonyl group having 8 or less carbon atoms (e.g., methoxycarbonyl, ethoxycarbonyl, or benzyloxycarbonyl), a carbamoyl group (e.g., carbamoyl, N,N-dimethylcarbamoyl, morpholinocarbonyl, or piperidinocarbonyl), a sulfamoyl group (e.g., sulfamoyl, N,N-dimethylsulfamoyl, morpholinosulfonyl, or piperidinosulfonyl), a carboxy group, a cyano group, a hydroxy group, an amino group, an acylamino group having 8 or less carbon atoms (e.g., acetylamino), an alkoxy group having 10 or less carbon atoms (e.g., methoxy, ethoxy, or benzyloxy), an alkylthio group having 10 or less carbon atoms (e.g., ethylthio), an alkylsulfonyl group having 5 or less carbon atoms (e.g., methylsulfonyl), a sulfonic acid group, or an aryl group having 15 or less carbon atoms (e.g., phenyl, or tolyl).

More preferably, $V_1$ to $V_8$ each represents a hydrogen atom, an unsubstituted alkyl group (e.g., methyl), or an alkoxy group (e.g., methoxy), with the proviso that $V_1$, $V_2$, $V_3$, $V_4$, $V_5$, $V_6$, $V_7$ and $V_8$ are not a hydrogen atom at the same time.

Of $V_1$ to $V_8$, any two of these groups which are connected to adjacent carbon atoms can not form a condensed ring.

When the Hammett's $\sigma_p$ values of the group represented by $V_1$ to $V_8$ are denoted as $\sigma_{pi}$ (i=1 to 8) respectively, and Y is $\sigma_{p1}+\sigma_{p2}+\sigma_{p3}+\sigma_{p4}+\sigma_{p5}+\sigma_{p6}+\sigma_{p7}+\sigma_{p8}$, Y is not larger than −0.08 ($Y \leqq -0.08$) in case of Z being an oxygen atom, or Y is not larger than −0.15 ($Y \leqq -0.15$) in case of Z being a sulfur atom. Y is preferably not larger than −0.15 ($Y \leqq -0.15$) when Z is an oxygen atom, and not larger than −0.30 ($Y \leqq -0.30$) when Z is a sulfur atom. In a particularly preferred case, $-0.90 \leqq Y \leqq -0.17$ when Z is an oxygen atom, and $-1.05 \leqq Y \leqq -0.34$ when Z is a sulfur atom.

The $\sigma_p$ values used are those described in *Kagaku no Ryoiki,* Extra Issue No. 122, pages 96 to 103, *Yakubutsu no Kozokasseisokan-Drug Design to Sayokisa Kenkyu eno Shishin,* edited by Kozokasseisokan Konwakai and Corwin Hansch (published by Nankodo Co.) and Albert Leo, *Substituent Constants for Correlation Analysis in Chemistry and Biology,* pages 69 to 161 (published by John Wiley & Sons Publishers). A method for measurement of $\sigma_p$ value is described in *Chemical Reviews,* Vol. 17, pages 125 to 136 (1935).

The $\sigma_p$ values of hydrogen atom, methyl group and methoxy group are 0, −0.17 and −0.27 respectively.

$X_n$ in general formula (III) represents either an anion or cation to neutralize the ionic charge of the compound, and n may be a value of 0 or greater.

Representative cations include inorganic or organic ammonium ions or alkali metal ions, while representative anions include inorganic or organic anions, for example, a halogen ion (such as a fluoride ion, a chloride ion, a bromide ion, or an iodide ion); a substituted arylsulfonate ion (such as a p-toluenesulfonate ion, or a p-chlorobenzenesulfonate ion); an aryldisulfonate ion (such as a 1,3-benzenedisulfonate ion, a 1,5-naphthalenedisulfonate ion, or a 2,6-naphthalenedisulfonate ion); an alkylsulfonate ion (such as a methyl sulfate ion); a sulfate ion; a thiocyanate ion; a perchlorate ion; a tetrafluoroborate ion; a picrate ion; an acetate ion; and a trifluoromethanesulfonate ion. An iodide ion is preferred.

Specific examples of the dyes represented by general formula (III) according to the present invention are set forth below, but the present invention should not be construed as being limited thereto.

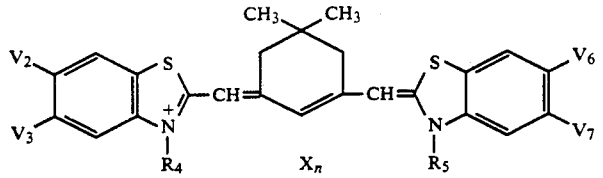

| Compound No. | $R_4$ | $R_5$ | $V_2$ | $V_3$ | $V_6$ | $V_7$ | X | n |
|---|---|---|---|---|---|---|---|---|
| 1 | $(CH_2)_3CH_3$ | $C_2H_5$ | $CH_3$ | H | $CH_3$ | H | $I^-$ | 1 |
| 2 | $(CH_2)_4CH_3$ | $C_2H_5$ | $CH_3$ | H | $CH_3$ | H | $I^-$ | 1 |
| 3 | $(CH_2)_5CH_3$ | $C_2H_5$ | $CH_3$ | H | $CH_3$ | H | $I^-$ | 1 |
| 4 | $(CH_2)_6CH_3$ | $C_2H_5$ | $CH_3$ | H | $CH_3$ | H | $I^-$ | 1 |
| 5 | $(CH_2)_7CH_3$ | $C_2H_5$ | $CH_3$ | H | $CH_3$ | H | $I^-$ | 1 |
| 6 | $(CH_2)_4CH_3$ | 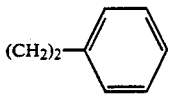 | $CH_3$ | $CH_3$ | $CH_3$ | H | $I^-$ | 1 |
| 7 | 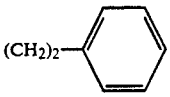 | $C_2H_5$ | $CH_3$ | $CH_3$ | $CH_3$ | H | $I^-$ | 1 |
| 8 | $(CH_2)_4CH_3$ | $C_2H_5$ | $CH_3$ | $CH_3$ | H | H | $I^-$ | 1 |
| 9 | $(CH_2)_4CH_3$ | $C_2H_5$ | H | H | $CH_3$ | $CH_3$ | $I^-$ | 1 |
| 10 | $(CH_2)_4CH_3$ | $(CH_2)_4CH_3$ | $CH_3$ | H | $CH_3$ | H | $I^-$ | 1 |
| 11 | $(CH_2)_4CH_3$ | $C_2H_5$ | $OCH_3$ | H | $OCH_3$ | H | $Br^-$ | 1 |
| 12 | $(CH_2)_4CH_3$ | $C_2H_5$ | $OCH_3$ | $OCH_3$ | H | H | $Cl^-$ | 1 |
| 13 | $(CH_2)_4CH_3$ | $(CH_2)_3SO_3^-$ | $OCH_3$ | H | $OCH_3$ | H | — | — |
| 14 | $(CH_2)_3CH_3$ | $(CH_2)_4SO_3^-$ | $OCH_3$ | H | $OCH_3$ | H | — | — |
| 15 | $(CH_2)_4CH_3$ | $CH_2CO_2H$ | $CH_3$ | H | $CH_3$ | H | 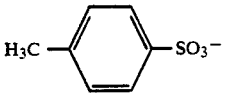 | 1 |
| 16 | $(CH_2)_4CH_3$ | $(CH_2)_3SO_3^-$ | $CH_3$ | H | $CH_3$ | H | — | — |
| 17 | $(CH_2)_4CH_3$ | $(CH_2)_4SO_3^-$ | $CH_3$ | H | $CH_3$ | H | — | — |
| 18 | $(CH_2)_5CH_3$ | $(CH_2)_2SO_3^-$ | $CH_3$ | $CH_3$ | H | H | 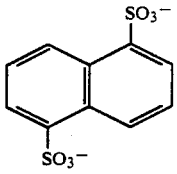 | 1 |
| 19 | $(CH_2)_3CH_3$ | $(CH_2)_2OCH_3$ | $CH_3$ | H | $CH_3$ | H | $I^-$ | 1 |
| 20 | $(CH_2)_4CH_3$ | $(CH_2)_2CN$ | H | $CH_3$ | H | $CH_3$ | $I^-$ | 1 |
| 21 | $(CH_2)_4CH_3$ | 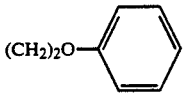 | H | $CH_3$ | H | $CH_3$ | $Br^-$ | 1 |

(22)

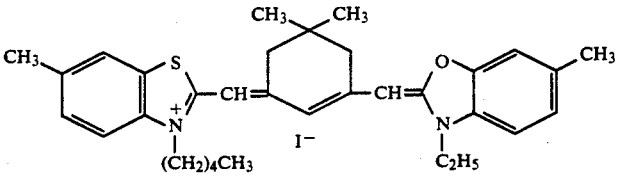

-continued

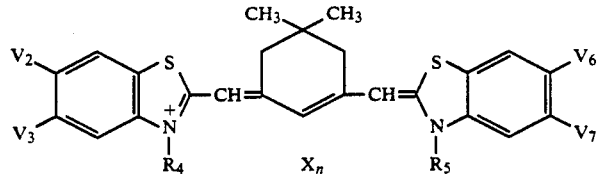

| Compound No. | $R_4$ | $R_5$ | $V_2$ | $V_3$ | $V_6$ | $V_7$ | X | n |
|---|---|---|---|---|---|---|---|---|
| (23) | 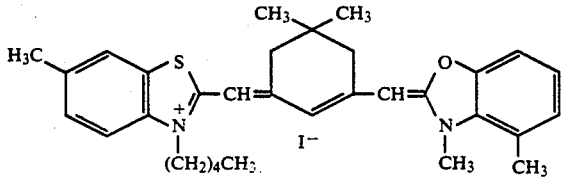 | | | | | | | |

The compounds represented by general formula (II) used in the present invention can be synthesized according to methods as described, for example, in F. M. Hamer, *Heterocyclic Comopunds-Cyanine Dyes and Related Compounds,* Chapter IX, pages 270 to 287 (John Wiley & Sons Publishers, New York, London, 1946) and D. M. Sturmer, *Heterocyclic Compounds-Special Topics in Heterocyclic Chemistry,* Chapter 8, Section 4, pages 482 to 515 (John Wiley & Sons Publishers, New York, London, 1977).

By adding the compound represented by general formula (III) according to the present invention to a silver halide emulsion, red-sensitivity is imparted to the silver halide emulsion. Any conventional method well known in the art may be used to add the compound represented by general formula (III) to the silver halide emulsion. It is normally dissolved in a water-soluble solvent, such as methanol, ethanol, pyridine, methyl cellosolve, or acetone or a mixture thereof, and then added to the silver halide emulsion. Also it can be dissolved in a mixture of the above described organic solvent and water and the mixture can be added to the silver halide emulsion.

The addition of the dye of formula (III) may be made during any phase of the production process for the silver halide emulsion. However, it is preferable to make the addition either prior to or after the addition of stabilizers and antifogging agents, and during or after the completion of the chemical ripening of the emulsion.

There are no particular restrictions on the amount of compound (III) according to the present invention which is added. In general, the amount is from about $1\times10^{-6}$ to about $1\times10^{-3}$ mol per mol of silver halide, preferably from about $1\times10^{-5}$ to about $3\times10^{-4}$ mol per mol of silver halide.

It is also possible to use super sensitizing agents. Examples of suitable super sensitizing agents are described, for example, in *Photographic Science and Engineering,* Vol. 13, pages 13 to 17 (1969), ibid., Vol. 18, pages 418 to 430 (1974), and *The Theory of the Photographic Process* edited by James, Fourth Edition, page 259, Macmillan Co., (1977). It is known to achieve a high sensitivity by appropriately selecting sensitizing dyes and super sensitizing agents.

In general, any type of super sensitizing agent may be used, but the compounds represented by the following general formula (IV) are particularly preferred:

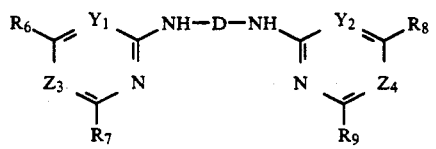

(IV)

wherein D represents a divalent aromatic group; $R_6$ $R_7$, $R_8$ and $R_9$ each represents a hydrogen atom, a hydroxy group, an alkoxy group, an aryloxy group, a halogen atom, a heterocyclic group, a mercapto group, an alkylthio group, an arylthio group, a heterocyclic thio group, an amino group, an alkylamino group, a cyclohexylamino group, an aryl amino group, a heterocyclic amino group, an aralkylamino group or an aryl group; $Y_1$ and $Z_3$ each represents —N= or —CH=, provided that at least one of $Y_1$ and $Z_3$ must represent —N=; and $Y_2$ and $Z_4$ have the same meaning as defined for $Y_1$ and $Z_3$, respectively.

The compound represented by general formula (II) will now be described in more detail.

D represents a divalent aromatic group (which may be a monocyclic aromatic group, a condensed aromatic group containing at least two aromatic nuclei, or a group wherein at least two aromatic nuclei are directly joined or joined via an atom or a group of atoms, and include, for example, biphenyl, naphthalene, stilbene, or bibenzyl). Those groups represented by the following groups $D_1$ or $D_2$ are particularly preferred.

$D_1$;

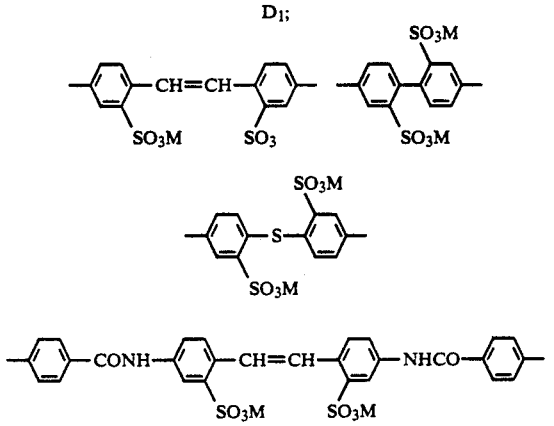

-continued

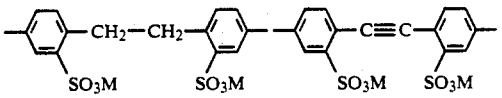

In the above formulae, M represents a hydrogen atom or a cation which imparts water solubility (for example, an alkali metal ion (e.g., Na, or K), or an ammonium ion).

$D_2$;

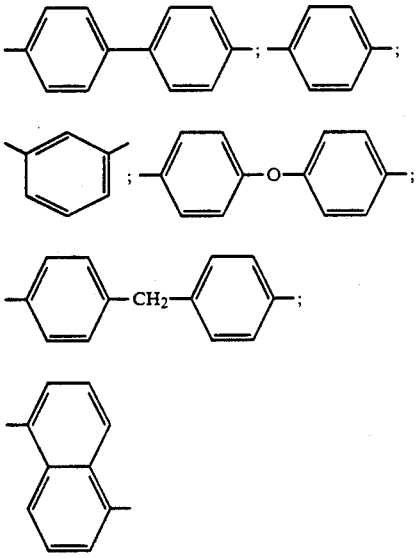

In the general formula $D_2$, at least one of $R_6$, $R_7$, $R_8$ and $R_9$ has a substituent containing $SO_3M$ in which M is as defined above.

$R_6$, $R_7$, $R_8$ and $R_9$ each represents a hydrogen atom, a hydroxyl group, an alkoxy group (e.g., methoxy, ethoxy), an aryloxy group (e.g., phenoxy, naphthoxy, p-methylphenoxy, p-sulfophenoxy), a halogen atom (e.g., chlorine, bromine), a heterocyclic group (e.g., morpholinyl, piperidyl), a mercapto group, an alkylthio group (e.g., methylthio, ethylthio), an arylthio group (e.g., phenylthio, tolylthio), a heterocyclylthio group (e.g., benzothiazoylthio, benzoimidazoylthio, phenyltetrazoylthio), an amino group, an alkylamino group (e.g., methylamino, ethylamino, propylamino, dimethylamino, diethylamino, dodecylamino, β-hydroxyethylamino, di-β-hydroxyethylamino, β-sulfoethylamino), a cyclohexylamino group, an arylamino group (e.g., anilino, o-sulfoanilino, m-sulfoanilino, p-sulfoanilino, o-chloroanilino, m-chloroanilino, p-chloroanilino, o-anisidino, m-anisidino, p-anisidino, o-toluidino, m-toluidino, p-toluidino, o-carboxyanilino, m-carboxyanilino, p-carboxyanilino, hydroxyanilino, sulfonaphthylamino, o-aminoanilino, m-aminoanilino, p-aminoanilino, o-acetamino-anilino), a heterocyclylamino group (e.g., 2benzothiazolylamino, 2-pyridylamino), an aralkylamino group (e.g., benzylamino), or an aryl group (e.g., phenyl).

Particularly preferred among compounds represented by general formula (IV) are those wherein at least one of $R_6$ to $R_9$ is an aryloxy group, heterocyclylthio group or heterocyclylamino group.

Specific examples of compounds represented by general formula (IV) will be set forth below, but the present invention should not be construed as being limited thereto.

(IV-1) Disodium 4,4'-bis[2,6-di(benzothiazolyl-2-thio)-pyrimidine-4-ylamino]stilbene-2,2'-di-sulfonate (IV-2) Disodium 4,4'-bis[2,6-di(benzothiazolyl-2-amino) pyrimidine-4-ylamino]stilbene-2,2-disulfonate (IV-3) Disodium 4,4'-bis[2,6-di(1-phenyltetrazolyl-5-thio)pyrimidine-4-ylamino]stilbene-2,2'-disulfonate (IV-4) Disodium 4,4'-bis[2,6-di(benzoimidazolyl-2-thio)pyrimidine-4-ylamino]stilbene-2,2'-disulfonate (IV-5) Disodium 4,4'-bis[2-chloro-6-(2-naphthyloxy)-pyrimidine-4-ylamino]biphenyl-2,2'-disulfonate (IV-6) Disodium 4,4'-bis[2,6-di(naphthyl-2-oxy)pyrimidine-4-ylamiono]stilbene-2,2'-disulfonate (IV-7) Disodium 4,4'-bis[2,6-di(naphthyl-2-oxy)pyrimidine-4-ylamino]bibenzyl-2,2'-disulfonate (IV-8) Disodium 4,4'-bis[2,6-diphenoxypyrimidine-4-ylamino]stilbene-2,2'-disulfonate (IV-9) Disodium 4,4'-bis[2,6-diphenylthiopyrimidine-4-ylamino]stilbene-2,2'-disulfonate (IV-10) Disodium 4,4'-bis[2,6-dichloropyrimidine-4-ylamino]stilbene-2,2'-disulfonate (IV-11) Disodium 4,4'-bis[2,6-dianilinopyrimidine-4-ylamino]stilbene-2,2'-disulfonate (IV-12) Disodium 4,4'-bis[4,6-di(naphthyl-2-oxy)triazine-2-ylamino]stilbene-2,2'-disulfonate (IV-13) Disodium 4,4'-bis[4,6-dianilinotriazine-2-ylamino]stilbene-2,2'-disulfonate (IV-14) Disodium 4,4'-bis(2,6-dimercaptopyrimidine-4-ylamino)biphenyl-2,2'-disulfonate (IV-15) Disodium 4,4'-bis[4,6-di(naphthyl-2-oxy)-pyrimidine-2-ylamino]stilbene-2,2'-disulfonate (IV-16) Disodium 4,4'-bis[4,6-di(benzothiazolyl-2-thio)-pyrimidine-2-ylamino]stilbene-2,2'-disulfonate (IV-17) Disodium 4,4'-bis[4,6-di(1-phenyltetrazolyl-2-amino)pyrimidine-2-ylamino]stilbene-2,2'-disulfonate (IV-18) Disodium 4,4'-bis[4,6-di(naphthyl-2-oxy)-pyrimidine-2-ylamino]bibenzyl-2,2'-disulfonate The compound of the general formula (III) and the compound of the general formula (IV) may be simultaneously or separately incorporated in the silver halide emulsion regardless of whichever is added first. Alternatively, the two compounds may be incorporated in the silver halide emulsion in the form of a solution mixture.

The amount of the compound (IV) to be incorporated is in the range of about $1\times10^{-6}$ to about $1\times10^{-1}$ mol, preferably about $5\times10^{-5}$ to about $1\times10^{-2}$ mol per mol of silver halide. The molar ratio of the amount of the compound (III) to be incorporated to that of the compound (IV) is preferably selected in the range of about 1/50 to about 10/1.

The pH of the layers of the silver halide color photographic material according to the present invention means the pH of all of the photographic layers obtained by applying all of the coating solutions to a support and does not necessarily coincide with the pH of each coating solution.

The pH of the layers can be measured by the method as described in JP-A-61-245153. More specifically, (1) 0.05 ml of pure water is dropped on the surface of the emulsion layer side of a silver halide color photographic material, and (2) after 3 minutes, the pH of the layers is measured by an electrode for measuring the pH of the layers (GS-165F manufactured by Toadenpa Co.).

The color photographic material of the present invention exhibits a pH of the layers, determined by the above described measuring method, of from 5.0 to 6.5.

If necessary the pH of the layers can be adjusted to achieve the above pH range by, for example, using an acid (for example, sulfuric acid, or citric acid) or an alkali (for example, sodium hydroxide, or potassium hydroxide).

When the pH of the layers is less than 5.0, some problems, for example, obstruction of the hardening function of the coating solutions used to form the layers, or reduction in sensitivity may tend to occur. On the other hand, when the pH of the layers exceeds 6.5 a problem of fog formation, particularly, in the red-sensitive layer increases during storage of the photographic light-sensitive material before processing, may tend to occur.

For the silver halide emulsion layers of the color photographic material according to the present invention, any of silver bromide, silver iodobromide, silver iodochlorobromide, silver chlorobromide, and silver chloride can be used as the silver halide.

In particular, for the purpose of conducting a rapid processing, silver chlorobromide containing 90 mol % or more, more preferably 98 mol % or more of silver chloride is preferred. Although such silver chlorobromide may contain a slight amount of silver iodide, it is preferred that it does not contain silver iodide at all.

There is no particular restriction on the average grain size (the grain size being defined as the diameter of the grains when the grain has a spherical or a nearly spherical form and as the length of the edge when the grain has a cubic form, and being the average based on the projected area of the grains) of the silver halide grains in the photographic emulsions, but it is preferred that the grain size be not more than about 2 μm, and particularly from about 0.2 μm to about 1.5 μm.

The silver halide grains in the photographic emulsion layers may have a regular crystal form such as cubic, tetradecahedral, octahedral, etc., or an irregular crystal form such as spherical, tabular, etc., or may have a composite form of these crystal forms. Also, a mixture of grains having various crystal forms may be used. Of these emulsions, the use of a photographic emulsion of regular crystal form is preferred.

Further, a silver halide emulsion wherein tabular silver halide grains having a diameter/thickness ratio of at least 5 accounts for at least 50% of the total projected area of the silver grains may be used in the present invention.

The silver halide emulsion employed in at least one layer of the light-sensitive layers is preferably a monodispersed silver halide emulsion having a coefficient of variation (a value which is obtained by dividing a statistical standard deviation with an average grain size and is indicated in terms of a percent) of not more than 15%, more preferably not more than 10%.

Such a monodispersed emulsion may be a single emulsion having the coefficient of variation described above, or an emulsion composed of a mixture of two or more kinds of monodispersed emulsions prepared separately and having different average grain sizes and each having a coefficient of variation of not more than 15%, preferably not more than 10%. The difference in grain size and the mixing ratio of these monodispersed emulsions to be mixed can be appropriately selected. However, emulsions having a difference in average grain size ranging from not less than 0.2 μm to not more than 1.0 μm are preferably employed.

The definition as to the coefficient of variation and the methods of measurement therefor are described in T. H. James, *The Theory of The Photographic Process*, Third Edition, page 39, The Macmillan Company (1966).

The silver halide grains used in the present invention may have a composition or structure inside the grain which is different from that on the surface layer thereof. Also, the silver halide grains may be of the type that latent images are formed mainly on the surface thereof or of the type that latent images are formed mainly in the interior thereof. The latter type grains are particularly useful for direct positive emulsions.

During the formation or physical ripening of the silver halide grains, a cadmium salt, a zinc salt, a thallium salt, a lead salt, an iridium salt or a complex salt thereof, a rhodium salt or a complex salt thereof, an iron salt or a complex salt thereof, etc., may coexist in the system.

Silver halide emulsions are usually chemically sensitized. For the chemical sensitization of the emulsion, conventional methods can be applied, details of which are described in JP-A-62-215272, page 12, from left lower column, line 18 to right lower column, line 16.

Further, silver halide emulsions are usually spectrally sensitized. For the spectral sensitization, methine dyes are ordinarily employed, details of which are described in JP-A-62-215272, from page 22, right upper column, line 3 from the bottom to page 38 and Attachment (B) to Amendment therefor filed on Mar. 16, 1987.

The silver halide emulsions used in the present invention can contain various kinds of compounds for preventing the occurrence of fog or for stabilizing photographic performance during the production, storage and/or photographic processing of color photographic materials. Examples of such compounds include many compounds known as antifoggants or stabilizers such as azoles (e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (in particular, 1-phenyl-5-mercaptotetrazole), mercaptopyrimidines, or mercaptotriazines; thioketo compounds such as oxazolinethione; azaindenes (e.g., triazaindenes, tetraazaindenes (in particular, 4-hydroxy-substituted 1,3,3a,7-tetraazaindene), or pentaazaindenes; benzenethiosulfonic acid; benzenesulfinic acid, or benzenesulfonic acid amide.

Couplers to be used in the present invention will be described hereinafter. Various color couplers can be incorporated in the present light-sensitive material. The term "color coupler" as used herein means a compound which can undergo a coupling reaction with an oxidation product of an aromatic primary amine developing agent to form a dye. Specific examples of useful color couplers include naphtholic or phenolic compounds, pyrazolone or pyrazoloazole compounds and open-chain or heterocyclic ketomethylene compounds. Specific examples of these cyan, magenta and yellow couplers which can be used in the present invention are described in the patents cited in *Research Disclosure* No. 17643 (December 1978), VII-D and *Research Disclosure* No. 18717 (November 1979).

The color coupler to be used in the present invention may preferably contain a ballast group or is polymerized to exhibit nondiffusibility. Two-equivalent couplers substituted by an eliminatable group are more effective to reduce the coated amount of silver than four-equivalent couplers which contain a hydrogen atom in the coupling active position. Couplers which develop a dye having a proper diffusivity, colorless couplers, DIR couplers which undergo a coupling reaction to release a development inhibitor, or couplers which undergo a coupling reaction to release a development accelerator may be used in the present invention.

Typical examples of yellow couplers which may be used in the present invention include oil protect type acylacetamide couplers. Specific examples of such oil protect type acrylacetamide couplers are described in U.S. Pat. Nos. 2,407,210, 2,875,057, and 3,265,506. In the present invention, two-equivalent yellow couplers may preferably be used. Typical examples of such two equivalent yellow couplers include oxygen atom-releasing type yellow couplers as described in U.S. Pat. Nos. 3,408,194, 3,447,928, 3,933,501, and 4,022,620, and nitrogen atom-releasing type yellow couplers as described in JP-B-58-10739, U.S. Pat. Nos. 4,401,752, and 4,326,024, *Research Disclosure* No. 18053 (April 1979), British Patent No. 1,425,020, and West German Patent Application Disclosure Nos. 2,219,917, 2,261,361, 2,329,587, 2,433,812, JP-A-62-240965. α-Pivaloylacetanilide couplers are excellent in fastness of developed dye, particularly to light. On the other hand, α-benzoylacetanilide couplers can provide a high color density.

As a suitable cyan coupler for the present invention there may be used an oil protect type naphthol or phenol coupler. Typical examples of such a coupler include naphthol couplers as described in U.S. Pat. No. 2,474,293. Preferred examples of such a coupler include oxygen atom-releasing type two-equivalent naphthol couplers as described in U.S. Pat. Nos. 4,052,212, 4,146,396, 4,228,233, and 4,296,200. Specific examples of such a phenol coupler are described in U.S. Pat. Nos. 2,369,929, 2,801,171, 2,772,162, and 2,895,826. Cyan couplers which are fast to heat and moisture may be preferably used in the present invention. Typical examples of such cyan couplers include phenol cyan couplers containing an ethyl group or higher group in the meta-position of the phenol nucleus as described in U.S. Pat. No. 3,772,002, 2,5-diacylamino-substituted phenol couplers as described in U.S. Pat. Nos. 2,772,162, 3,758,308, 4,126,396, 4,334,011, and 4,327,173, West German Patent Disclosure (OPI) No. 3,329,729, and U.S. Pat. No. 4,500,635, and phenol couplers containing a phenylureide group in the 2-position and an acylamino group in the 5-position as described in U.S. Pat. Nos. 3,446,622, 4,333,999, 4,451,559, and 4,427,767.

Cyan couplers and yellow couplers which can be preferably employed in the present invention are those represented by the following general formula (VI), (VII) or (X):

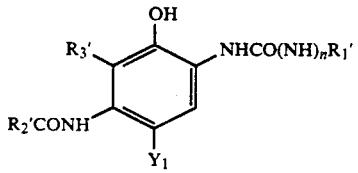

(VI)

-continued

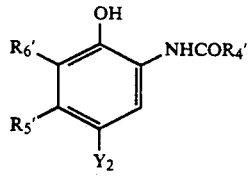

(VII)

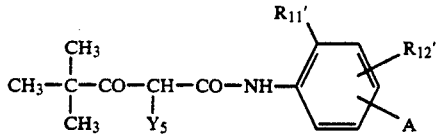

(X)

wherein $R_1'$, $R_2'$, and $R_4'$ each represents a substituted or unsubstituted aliphatic, aromatic or heterocyclic group; $R_3'$, $R_5'$, and $R_6'$ each represents a hydrogen atom, a halogen atom, an aliphatic group, an aromatic group, or an acylamino group or, when taken together, $R_3'$ and $R_2'$ represent a non-metallic atomic group necessary for forming a nitrogen-containing 5-membered or 6-membered ring; $Y_1$ and $Y_2$ each represents a hydrogen atom or a group capable of being released upon a coupling reaction with an oxidation product of a developing agent; n represents 0 or 1; $R_{11}'$ represents a halogen atom or an alkoxy group; $R_{12}'$ represents a hydrogen atom, a halogen atom or an alkoxy group; A represents $—NHCOR_{13}'$, $—NHSO_2R_{13}'$, $—SO_2NHR_{13}'$, $—COOR_{13}'$ or

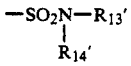

(wherein $R_{13}'$ and $R_{14}'$ each represents an alkyl group); and $Y_5$ represents a group capable of being released.

In general formula (VI) or (VII), when $Y_1$ or $Y_2$ represents a group capable of being released (hereinafter referred to as "releasing group"), the releasing group includes a group capable of connecting the coupling-active carbon atom of the coupler skeleton to an aliphatic group, an aromatic group, a heterocyclic group, an aliphatic, aromatic, or heterocyclic sulfonyl group, or an aliphatic, aromatic, or heterocyclic carbonyl group via an oxygen atom, a nitrogen atom, a sulfur atom, or a carbon atom; a halogen atom; or an aromatic azo group. The aliphatic, aromatic, or heterocyclic group contained in the releasing group may be substituted with one or more substituents acceptable for $R_1'$ as described hereafter. When two or more substituents are present, these substituents may be either the same or different. Further, the substituent or substituents may further be substituted by one or more substituents acceptable for $R_1'$.

With reference to the groups of $R_1'$, $R_2'$, $R_3'$, $R_4'$ and $R_6'$ in the cyan coupler represented by general formula (VI) or (VII), examples of an aliphatic group containing from 1 to 32 carbon atoms include a methyl group, a butyl group, a tridecyl group, a cyclohexyl group, or an allyl group; examples of the aryl group include a phenyl group, or a naphthyl group; and examples of the heterocyclic group include a 2-pyridyl group, a 2-imidazolyl group, a 2-furyl group, or a 6-quinolyl group. These groups may be substituted with one or more groups selected from an alkyl group, an aryl group, a heterocyclic group, an alkoxy group (e.g., methoxy, or 2-methoxyethoxy), an aryloxy group (e.g., 2,4-di-tert-amylphenoxy, 2-chlorophenoxy, or 4-cyanophenoxy), an alkenyloxy group (e.g., 2-propenyloxy), an acyl group (e.g., acetyl, or benzoyl), an ester group (e.g., butoxycarbonyl, phenoxycarbonyl, acetoxy, benzoyloxy, butoxysulfonyl, or toluenesulfonyloxy), an amido group (e.g., acetylamino, methanesulfonamido, or dipropylsulfamoylamino), a carbamoyl group (e.g., dimethylcarbamoyl, or ethylcarbamoyl), a sulfamoyl group (e.g., butylsulfamoyl), an imido group (e.g., succinimido, or hydantoinyl), a ureido group (e.g., phenylureido, or dimethylureido), an aliphatic or aromatic sulfonyl group (e.g., methanesulfonyl, or phenylsulfonyl), an aliphatic or aromatic thio group (e.g., ethylthio, or phenylthio), a hydroxyl group, a cyano group, a carboxyl group, a nitro group, a sulfo group, and a halogen atom.

Where $R_3'$ in general formula (VI) or $R_2'$ in general formula (VII) represents a substituent which can be substituted, they may be substituted with one or more substituents described with respect to $R_1'$.

$R_5'$ in general formula (VII) preferably represents an aliphatic group, for example, a methyl group, an ethyl group, a propyl group, a butyl group, a pentadecyl group, a tert-butyl group, a cyclohexyl group, a cyclohexylmethyl group, a phenylthiomethyl group, a dodecyloxyphenylthiomethyl group, a butanamidomethyl group, or a methoxymethyl group.

$Y_1$ and $Y_2$ in the general formulae (VI) and (VII) each represents a hydrogen atom or a coupling releasing group (including a coupling releasing atom; hereinafter the same). Examples of the releasing group include a halogen atom (e.g., fluorine, chlorine, or bromine), an alkoxy group (e.g., ethoxy, dodecyloxy, methoxyethylcarbamoylmethoxy, carboxypropyloxy, or methylsulfonylethoxy), an aryloxy group (e.g., 4-chlorophenoxy, 4-methoxyphenoxy, or 4-carboxyphenoxy), an acyloxy group (e.g., acetoxy, tetradecanoyloxy, or benzoyloxy), a sulfonyloxy group (e.g., methanesulfonyloxy, or toluenesulfonyloxy), an amido group (e.g., dichloroacetylamino, heptafluorobutyrylamino, methanesulfonylamino, or toluenesulfonylamino), an alkoxycarbonyloxy group (e.g., ethoxycarbonyloxy, or benzyloxycarbonyloxy), an aryloxycarbonyloxy group (e.g., phenoxycarbonyloxy), an aliphatic, or aromatic thio group (e.g., ethylthio, phenylthio, or tetrazolylthio), an imido group (e.g., succinimido, or hydantoinyl), or an aromatic azo group (e.g., phenylazo). These releasing groups may contain a photographically useful group.

Preferable examples of the cyan couplers represented by general formula (VI) or (VII) described above are described below.

$R_1'$ in formula (VI) preferably represents an aryl group or a heterocyclic group and more preferably an aryl group substituted with a halogen atom, an alkyl group, an alkoxy group, an aryloxy group, an acylamino group, an acyl group, a carbamoyl group, a sulfonamido group, a sulfamoyl group, a sulfonyl group, sulfamido group, an oxycarbonyl group, or a cyano group.

When $R_3'$ and $R_2'$ in general formula (VI) do not jointly form a ring, $R_2'$ preferably represents a substituted or unsubstituted alkyl or aryl group and particularly preferably a substituted aryloxy-substituted alkyl group; and $R_3$ preferably represents a hydrogen atom.

$R_4'$ in general formula (VII) preferably represents a substituted or unsubstituted alkyl or aryl group and particularly preferably a substituted aryloxy-substituted alkyl group.

$R_5'$ in general formula (VII) preferably represents an alkyl group containing from 2 to 15 carbon atoms or a methyl group having a substituent containing 1 or more carbon atoms. As the substituent, an arylthio group, an alkylthio group, an acylamino group, an aryloxy group, and an alkyloxy group are preferable.

$R_5'$ in general formula (VII) more preferably represents an alkyl group containing from 2 to 15 carbon atoms and particularly preferably an alkyl group containing from 2 to 4 carbon atoms.

$R_6'$ in general formula (VII) preferably represents a hydrogen atom or a halogen atom and particularly preferably a chlorine atom or a fluorine atom.

$Y_1$ and $Y_2$ in general formulae (VI) and (VII) preferably each represents a hydrogen atom, a halogen atom, an alkoxy group, an aryloxy group, an acyloxy group, or a sulfonamido group.

$Y_2$ in general formula (VII) preferably represents a halogen atom and particularly preferably a chlorine atom or a fluorine atom.

When n in general formula (VI) represents 0, $Y_1$ more preferably represents a halogen atom and particularly preferably a chlorine atom or a fluorine atom.

The substituents for $R_{12}'$, $R_{13}'$ and $R_{14}'$ in general formula (X) are the same as those defined for $R_1'$.

Preferable releasing groups represented by $Y_5$ include those represented by the following general formulae (Xa) to (Xg):

$$-OR_{20}' \quad \text{(Xa)}$$

wherein $R_{20}'$ represents an optionally substituted aryl or heterocyclic group, (Xb)

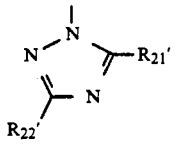

(Xc)

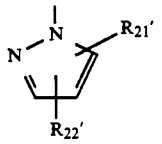

wherein $R_{21}'$ and $R_{22}'$, which may be the same or different, each represents a hydrogen atom, a halogen atom, a carboxylic acid ester group, an amino group, an alkyl group, an alkylthio group, an alkoxy group, an alkylsulfonyl group, an alkylsulfinyl group, a carboxylic acid group, a sulfonic acid group, or an unsubstituted or substituted phenyl or heterocyclic group, (Xd)

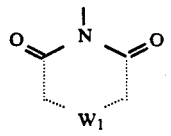

wherein $W_1$ represents a non-metallic atom group necessary for forming a 4-membered, 5-membered, or 6-membered ring together with

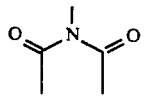

in the formula.

Of the groups represented by general formula (Xd), those represented by the following general formulae (Xe) to (Xg) are preferable:

(Xe)

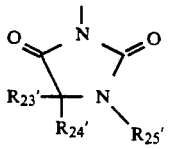

(Xf)

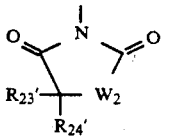

-continued (Xg)

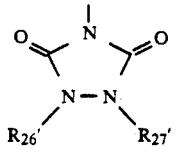

wherein $R_{23}'$ and $R_{24}'$ each represents a hydrogen atom, an alkyl group, an aryl group, an alkoxy group, an aryloxy group or a hydroxyl group; $R_{25}'$, $R_{26}'$ and $R_{27}'$ each represents a hydrogen atom, an alkyl group, an aryl group, an aralkyl group or an acyl group; and $W_2$ represents an oxygen atom or a sulfur atom.

Specific examples of these couplers are described in JP-A-63-11939.

Preferred cyan coupler compounds (C-1) to (C-22) and yellow coupler compounds (Y-1) to (Y-8) are set forth below, but the present invention should not be construed as being limited thereto.

(C-1)

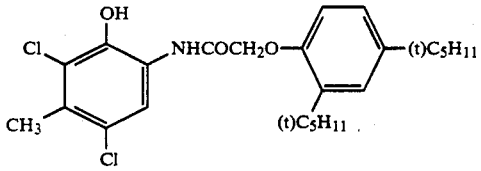

(C-2)

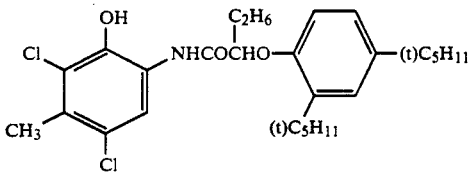

(C-3)

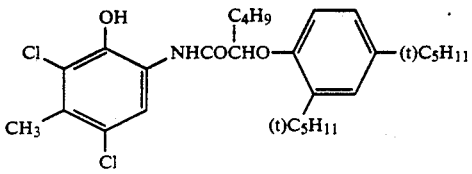

(C-4)

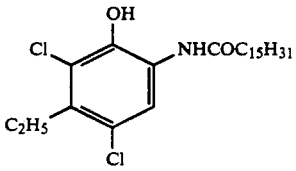

(C-5)

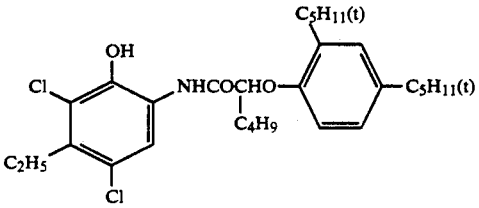

-continued
(C-6)
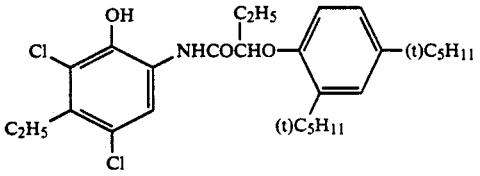
(C-7)
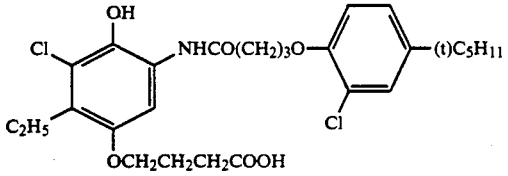
(C-8)
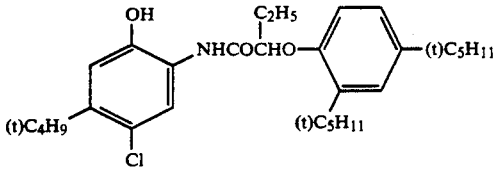
(C-9)
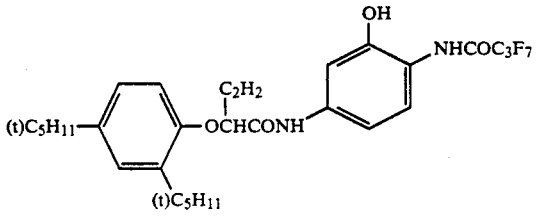
(C-10)
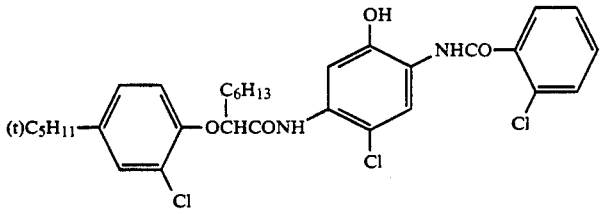
(C-11)
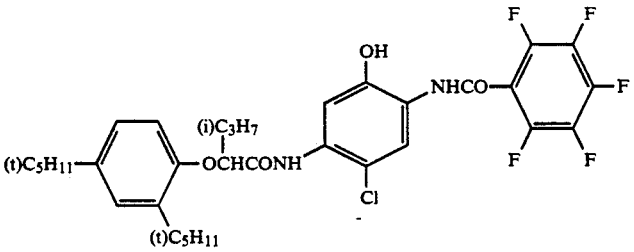
(C-12)
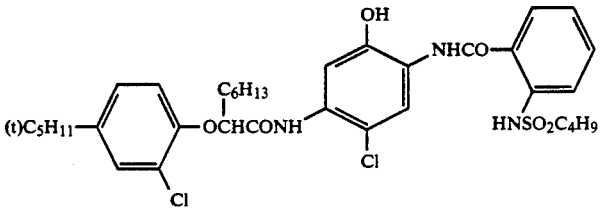

-continued
(C-13)
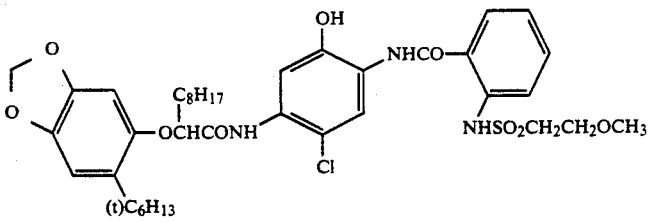
(C-14)
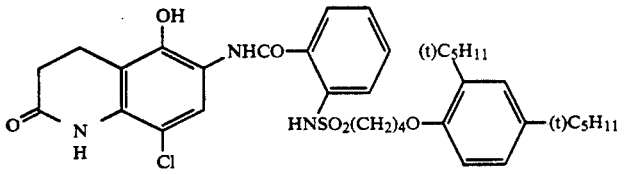
(C-15)
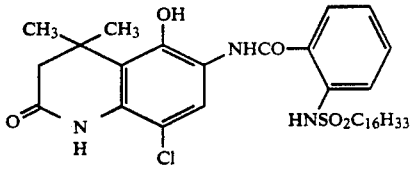
(C-16)
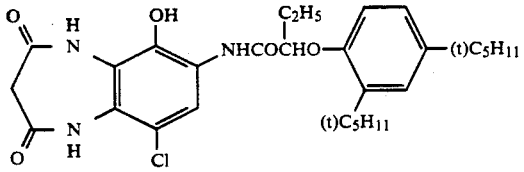
(C-17)
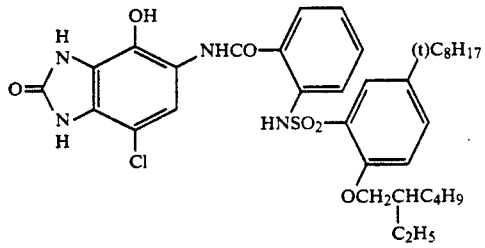
(C-18)
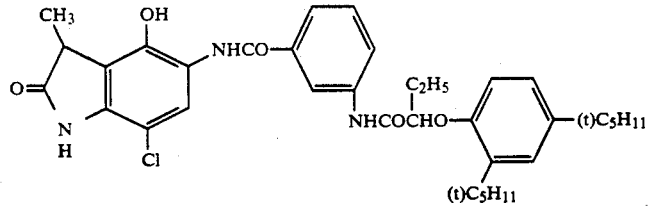
(C-19)
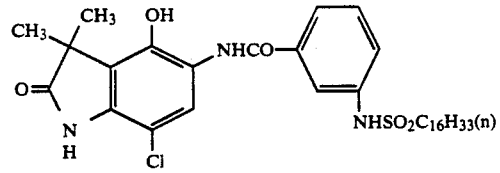
(C-20)
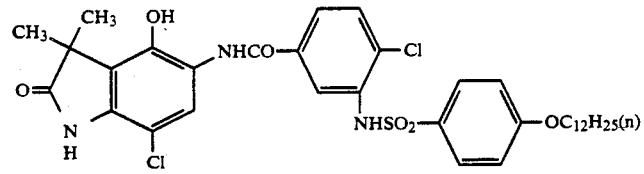

-continued
(C-21)
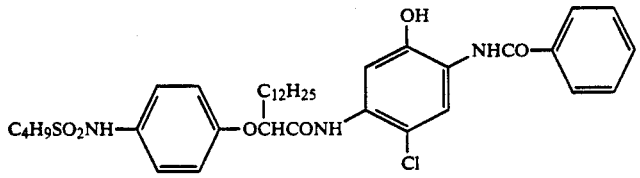
(C-22)
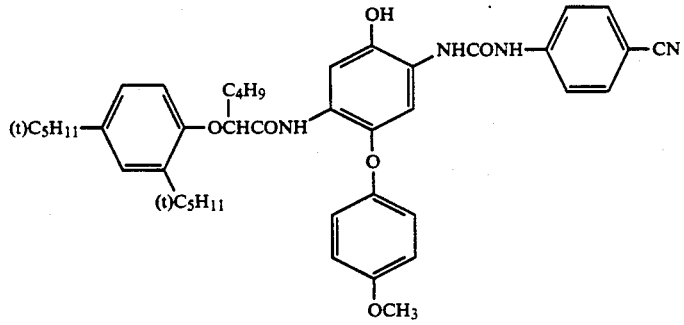
(Y-1)
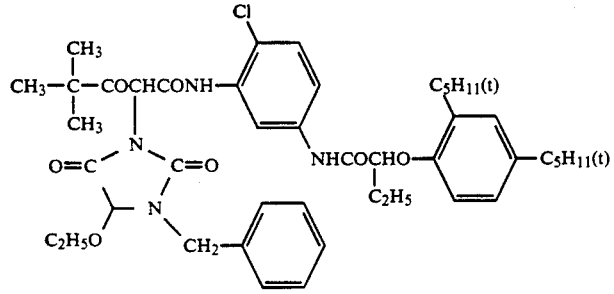
(Y-2)
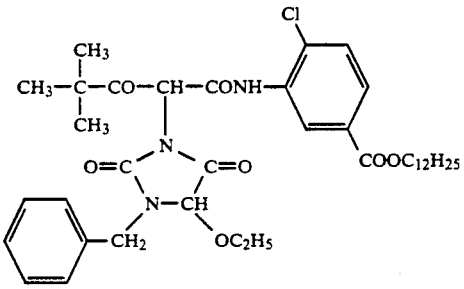
(Y-3)
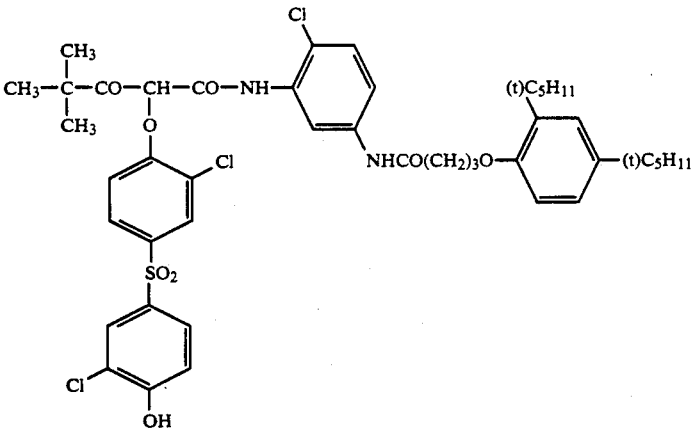

-continued (Y-4)

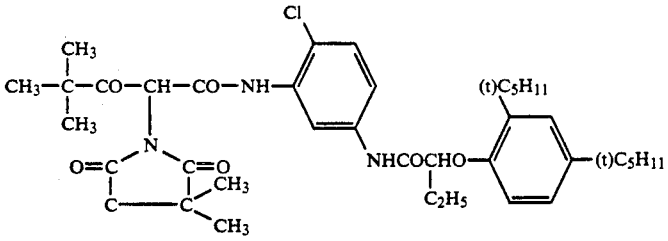

(Y-5)

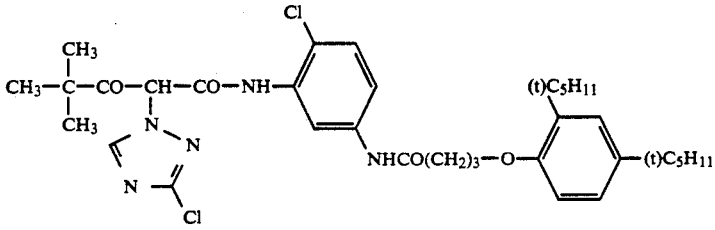

(Y-6)

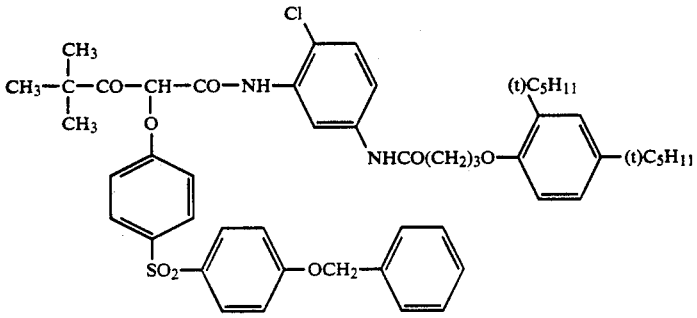

(Y-7)

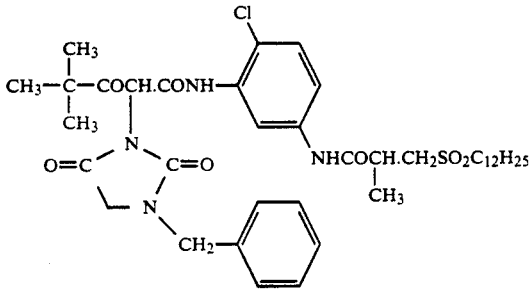

(Y-8)

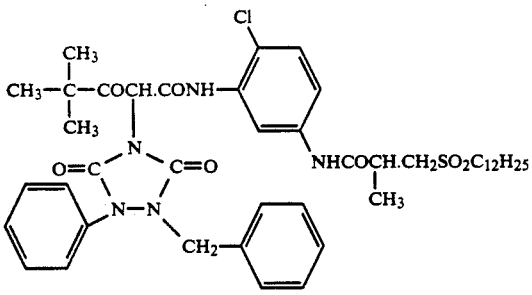

The coupler represented by general formulae (VI), (VII) or (X) is incorporated into a silver halide emulsion layer constituting a light-sensitive layer in an amount of usually from 0.1 to 1.0 mole, preferably from 0.1 to 0.5 mole, per mol of the silver halide.

In the present invention, the above-described couplers may be added to a light-sensitive layer by applying various known techniques. Usually, they can be added according to an oil droplet-in-water dispersion method known as an oil-protected method. For example, a coupler is first dissolved in a solvent, and then emulsified and dispersed in a gelatin aqueous solution containing a surfactant. Alternatively, water or a gelatin aqueous solution may be added to a coupler solution containing a surfactant, followed by phase inversion to obtain an oil-droplet-in-water dispersion. An alkali-soluble coupler may also be dispersed according to a so-called Fischer's dispersion method. The coupler dispersion may be subjected to distillation, noodle washing, or ultrafiltration to remove a low-boiling organic solvent and then mixed with a photographic emulsion.

As the dispersion medium for these couplers, it is preferred to employ an organic solvent having a high boiling point which has a dielectric constant of about 2 to about 20 (at 25° C.) and a reflective index of about 1.3 to about 1.7 (at 25° C.) and/or a water-insoluble polymer compound.

Preferred examples of the organic solvent having a high boiling point used in the present invention include those represented by the following general formula (A), (B), (C), (D), or (E):

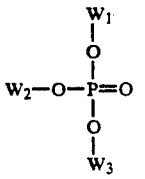

(A)

$W_1—COO—W_2$ (B)

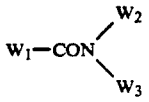

(C)

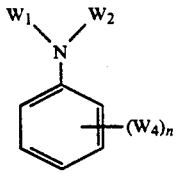

(D)

$W_1—O—W_2$ (E)

wherein $W_1$, $W_2$ and $W_3$ each represents a substituted or unsubstituted alkyl group, a substituted or unsubstituted cycloalkyl group, a substituted or unsubstituted alkenyl group, a substituted or unsubstituted aryl group or a substituted or unsubstituted heterocyclic group; $W_4$ represents $W_1$, —O—$W_1$ or —S—$W_1$; n represents an integer from 1 to 5, and when n is two or more, two or more $W_4$'s may be the same or different; $W_1$ and $W_2$ in general formula (E) may combine with each other to form a condensed ring.

Besides the high boiling organic solvents represented by the general formulae (A) to (E), compounds immiscible with water having a melting point of 100° C. or lower and a boiling point of 140° C. or above which are good coupler solvents can be used as such high boiling organic solvents. The melting point of such a high boiling organic solvent is preferably in the range of 80° C. or lower. The boiling point of such a high boiling organic solvent is preferably in the range of 160° C. or more, particularly 170° C. or more.

Examples of such a high boiling organic solvent include high boiling organic solvents with a boiling point of 160° C. such as a phthalic alkyl ester (e.g., dibutyl phthalate, dioctyl phthalate), a phosphoric ester (e.g., diphenyl phosphate, triphenyl phosphate, tricresyl phosphate, dioctylbutyl phosphate), a citric ester (e.g., tributyl acetylcitrate), a benzoic ester (e.g., octyl benzoate), an alkyl amide (e.g., diethyl laurylamide), an aliphatic ester (e.g., dibutoxyethyl succinate, dioctyl azerate), and a phenol (4-di-t-amylphenol). Examples of the above described water-insoluble high molecular weight compound include compounds as described in JP-B-60-18978 (18th column to 21st column)(The term "JP-B" as used herein means an "examined Japanese patent publication"), acrylamides, and vinyl polymers comprising methacrylamides as monomer components (including homopolymers and copolymers).

Specific examples of such a water-insoluble high molecular weight compound include polymethyl methacrylate, polyethyl methacrylate, polybutyl methacrylate, polycyclohexyl methacrylate, and poly-t-butylacrylamide. In addition to these high boiling organic solvents and/or water insoluble high molecular weight compounds, low boiling organic solvents with a boiling point of 30° to 150° C. such as a lower alkyl acetate (e.g., ethyl acetate, butyl acetate), propionic ethyl alcohol, secondary butyl alcohol, methylisobutyl ketone, β-ethoxyethyl acetate, and methylcellosolve acetate can be optionally used alone or in combination.

In the present invention, an ultraviolet absorbent can be incorporated in any layer. Preferably, such an ultraviolet absorbent can be incorporated in the layer containing a compound of the general formula (VI) or (VII) or its adjacent layers. Examples of an ultraviolet absorbent which can be used in the present invention include compounds as described in *Research Disclosure* No. 17643, Chapter VIII-C. Preferred examples of such an ultraviolet absorbent include benzotriazole derivatives represented by the following general formula (XI):

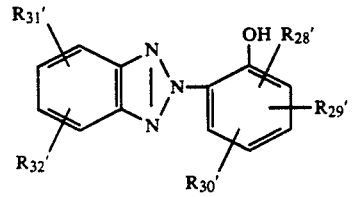

(XI)

wherein $R'_{28}$, $R'_{29}$, $R'_{30}$, $R'_{31}$ and $R'_{32}$ may be the same or different and each represents a hydrogen atom, a halogen atom, a nitro group, a hydroxyl group, an alkyl group, an alkenyl group, an aryl group, an alkoxy group, an acyloxy group, an aryloxy group, an alkylthio group, an arylthio group, a mono or dialkylamino group, an acylamino group, or 5- or 6-membered heterocyclic group containing oxygen or nitrogen atoms. $R'_{31}$ and $R'_{32}$ may together make ring closure to form a 5- or 6-membered aromatic ring containing carbon atoms. Among these groups, those which may contain substituents can be substituted by the substituents allowable for $R_1$.

Compounds represented by the general formula (XI) can be used alone or in combination.

Examples of the synthesis of the compound (XI) and other examples of the compound (XI) are described in JP-B-44-29620, JP-A-50-151149, JP-A-54-95233, JP-A-61-190537, U.S. Pat. No. 3,766,205, EP0057160, and *Research Disclosure* No. 22519 (1983). Alternatively, high molecular weight ultraviolet absorbents as described in JP-A-58-111942, and Japanese Patent Application No. 57-61937, 57-63602, 57-129780, and 57-133371 can be used. Low molecular weight ultraviolet absorbents and high molecular weight ultraviolet absorbents can be used in combination.

Like couplers, the above described ultraviolet absorbents can be dispersed in a hydrophilic colloid in the form of a solution in a high boiling organic solvent or a low boiling organic solvent or a mixture thereof. The amount of the high boiling organic solvent and ultraviolet absorbent to be incorporated is not specifically limited. The amount of the high boiling organic solvent to be incorporated is normally in the range of 0 to 300% based on the weight of the ultraviolet absorbent. These compounds which stay liquid at normal temperature can be preferably used alone or in combination.

In addition to a combination of the present couplers, an ultraviolet absorbent of the general formula (XI) can be used to improve the preservability of developed dyes, particularly cyan images, especially the fastness thereof to light. The ultraviolet absorbent and the cyan coupler can be coemulsified.

The coated amount of such an ultraviolet absorbent may be such that the resulting cyan dye images can be provided with light stability. However, if the ultraviolet absorbent is used excessively, it may cause yellowing of the unexposed portions (white background) of the color photographic light-sensitive material. Accordingly, the coated amount of the ultraviolet absorbent is normally set in the range of about $1\times10^{-4}$ to about $2\times10^{-3}$ mol/m$^2$ particularly about $5\times10^{-4}$ to about $1.5\times10^{-3}$ mol/m$^2$.

In the light-sensitive structure of commonly used color paper, such an ultraviolet absorbent can be incorporated in either, preferably both of opposite adjacent layers of the cyan coupler-containing red-sensitive emulsion layer. If the ultraviolet absorbent is incorporated in the intermediate layer between a green-sensitive layer and a red-sensitive layer, it may be coemulsified with a color mixing inhibitor. If the ultraviolet absorbent is incorporated in a protective layer, another protective layer may be coated as an outermost layer. This protective layer may contain a matt agent with an any suitable grain diameter.

In order to improve the preservability of developed dye images, particularly yellow and magenta images, various organic and metallic complex discoloration inhibitors can be used. Examples of organic discoloration inhibitors include hydroquinones, gallic acid derivatives, p-alkoxyphenols, and p-oxyphenols. Examples of dye stabilizers, stain inhibitors and oxidation inhibitors are described in the patents cited in *Research Disclosure* No. 17643, Chapter VII-I and J. Examples of metallic complex discoloration inhibitors are described in *Research Disclosure* No. 15162.

In order to improve the fastness of yellow images to heat and light, phenols, hydroquinones, hydroxychromans, hydroxycoumarans, hindered amines, alkyl or silyl ethers thereof, or many compounds belonging to hydrolyzable precursor derivatives can be used. Compounds represented by the general formulae (XVIII) and (XIX) are effective to improve the fastness of a yellow image obtained from a coupler of the general formula (VIII) to heat and light at the same time.

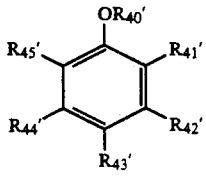

(XVIII)

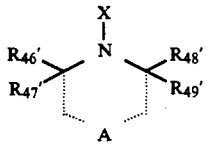

(XIX)

In the general formula (XVIII) or (XIX), R'40 represents a hydrogen atom, an aliphatic group, an aromatic group, a heterocyclic group or a substituted silyl group,

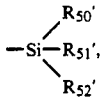

in which R'50, R'51 and R'52 may be the same or different and each represents an aliphatic group, an aromatic group, an aliphatic oxy group or an aromatic oxy group. These groups may contain substituents allowable for R'1. R'41, R'42, R'43, R'44 and R'45 may be the same or different and each represents a hydrogen atom, an alkyl group, an aryl group, an alkoxy group, a hydroxyl group, a mono or dialkylamino group, an imino group or an acylamino group. R'46, R'47, R'48 and R'49 may be the same or different and each represents a hydrogen atom or an alkyl group. X represents a hydrogen atom, an aliphatic group, an acyl group, an aliphatic or an aromatic sulfonyl group, aliphatic or aromatic sulfinyl group, an oxyradical group or a hydroxyl group. $A_1$ represents a nonmetallic atom group required for the formation of a 5-, 6- or 7-membered ring.

Examples of the synthesis of compounds represented by the general formulae (XVIII) and (XIX) and other examples of these compounds are described in British Patent Nos. 1,326,889, 1,354,313, and 1,410,846, U.S. Pat. No. 3,336,135, and 4,268,593, JP-B-51-1420, and JP-B-52-6623, and JP-A-58-114036, and JP-A-59-5246.

Compounds represented by the general formulae (XVIII) and (XIX) can be used in combination. These compounds can be used in combination with discoloration inhibitors which have heretofore been known.

The amount of the compound of the general formula (XVIII) or (XIX) to be used depends on the type of yellow coupler to be used in combination therewith. The compound of the general formula (XVIII) or (XIX) can be used in an amount of 0.5 to 200% by weight, preferably 2 to 150% by weight based on the weight of the yellow coupler to accomplish the desired objects of the invention. Preferably, the compound of the general formula (XVIII) or (XIX) may be coemulsified with a yellow coupler of the general formula (X).

The above described various dye stabilizers, stain inhibitors or oxidation inhibitors are also effective for the improvement in the preservability of magenta dye developed from a coupler represented by general formula (I). The group of compounds represented by the general formulae (XX), (XXI), (XXII), (XXIII), (XXIV) and (XXV) advantageously greatly improve the fastness of the light-sensitive material, particularly to light.

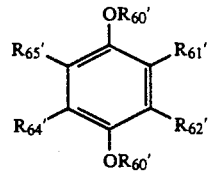

(XX)

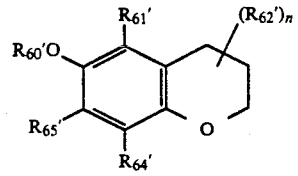

(XXI)

-continued (XXII)

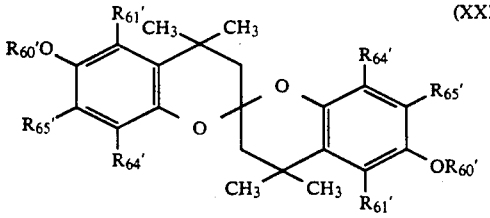

(XXIII)

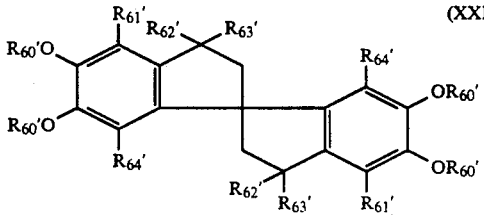

(XXIV)

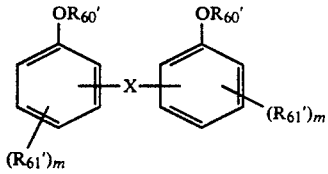

(XXV)

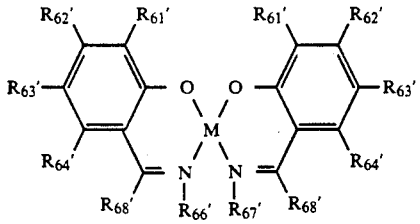

In the general formulae (XX) to (XXV), $R_{60}'$ has the same meaning as $R_{40}'$ in the general formula (XVIII). $R_{61}'$, $R_{62}'$, $R_{64}'$ and $R_{65}'$ may be the same or different and each represents a hydrogen atom, an aliphatic group, an aromatic group, an acylamino group, a mono or dialkylamino group, an aliphatic or an aromatic thio group, an acylamino group, an aliphatic or aromatic oxycarbonyl group, or $—OR_{40}'$. $R_{40}'$ and $R_{61}'$ may be bonded to each other to form a 5- or 6-membered ring. Alternatively, $R_{61}'$ and $R_{62}'$ may be bonded to each other to form a 5- or 6-membered ring. X represents a divalent connecting group. $R_{66}'$ and $R_{67}'$ may be the same or different and each represents a hydrogen atom, an aliphatic group, an aromatic group or a hydroxyl group. $R'_{68}$ represents a hydrogen atom, an aliphatic group or an aromatic group. $R_{66}'$ and $R_{67}'$ may together form a 5- or 6-membered ring. M represents Cu, Co, Ni, Pd or Pt. If the substituents $R_{61}'$ to $R_{68}'$ are aliphatic or aromatic groups, they may be substituted by substituents allowable for $R_1$. The suffix n represents an integer 0 to 3. The suffix m represents 0 to 4. The suffixes n and m each indicates the substituted number of $R_{62}'$ or $R_{61}'$. If this number is 2 or more, the plurality of $R_{62}$'s or $R_{61}$'s may be the same or different.

In the general formula (XXIV), typical examples of preferred groups represented by X include

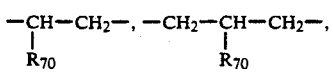

-continued

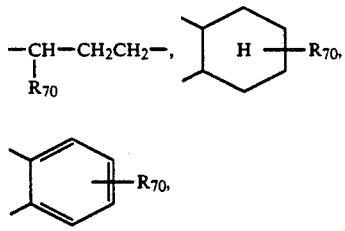

in which $R_{70}$ represents a hydrogen atom or an alkyl group.

In the general formula (XX V), $R_{61}$ is preferably a hydrogen-bondable group. A compound wherein at least one of the groups represented by $R_{62}$, $R_{63}$ and $R_{64}$ is a hydrogen atom, a hydroxyl group, an alkyl group or an alkoxy group may be preferably used. The substituents $R_{61}$ to $R_{68}$ each preferably contains a total of 4 or more carbon atoms.

Examples of the synthesis of these compounds and other examples of these compounds are described in U.S. Pat. Nos. 3,336,135, 3,432,300, 3,573,050, 3,574,627, 3,700,455, 3,764,337, 3,935,016, 3,982,944, 4,254,216 and 4,279,990, British Patent 1,347,556, 2,062,888, 2,066,975, and 2,077,455, JP-A-60-97353, JP-A-52-152225, JP-A-53-17729, JP-A-53-20327, JP-A-54-145530, JP-A-55-6321, JP-A-55-21004, JP-A-58-24141, and JP-A-59-10539, and JP-B-48-31625, and JP-B-54-12337.

Among discoloration inhibitors which can be advantageously used in the present invention, the compounds represented by the general formulae (XX) to (XXIV) each is used in an amount of about 10 to about 200 mol %, preferably about 30 to about 100 mol % based on the weight of magenta coupler to be used in the present invention. On the other hand, the compound represented by the general formula (XXV) is used in an amount of about 1 to about 100 mol %, preferably about 5 to about 40 mol % based on the weight of magenta coupler to be used in the present invention. These compounds may be preferably coemulsified with a magenta coupler.

For the inhibition of discoloration, a process is disclosed in JP-A-49-11330 and JP-A-50-57223 which comprises enclosing a dye image by an oxygen blocking layer comprising a substance with a low oxygen permeability. JP-A-85747 discloses a process which comprises providing a layer with an oxygen permeability of 200 $ml/m^2 \cdot hr \cdot atom$ or less on the support side of the dye-forming layer of the color photographic material. These processes can be applied to the present invention.

In the present invention, compounds as described later are preferably used in combination with the above described couplers, particularly with pyrazoloazole couplers.

In particular, Compound (Q) which undergoes chemical bonding to an aromatic amine developing agent remaining after color development to produce a chemically inert and substantially colorless compound and/or Compound (R) which undergoes chemical bonding to an oxidation product of an aromatic amine color developing agent to produce a chemically inert and substantially colorless compound may be preferably used to inhibit the generation of stains due to the production of developed dyes caused by the reaction of a color developing agent remaining in the film during storage after processing or its oxidation product with a coupler or other side effects.

As a suitable compound (Q) there can be used a compound which reacts with p-anisidine at a secondary reaction rate constant k2 (in trioctyl phosphate at 80° C.) of 1.0 l/mol sec to $1\times10^{-5}$ l/mol·sec. The measurement of the secondary reaction constant can be accomplished by a method as described in JP-A-63-158545.

If k2 exceeds this range, the compound becomes unstable itself, possibly causing it to undergo reaction with gelatin or water and decompose. On the other hand, if k2 is less than this range, the compound reacts with the remaining aromatic amine developing agent at a lower rate. As a result, the inhibition of side effects of the remaining aromatic amine developing agent, which is one of the objects of the present invention, cannot be accomplished.

Preferred examples of Compound (Q) can be represented by the general formula (QI) or (QII):

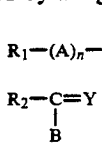

$$R_1-(A)_n-X \quad \text{(QI)}$$

$$R_2-\underset{\underset{B}{|}}{C}=Y \quad \text{(QII)}$$

wherein $R_1$ and $R_2$ each represents an aliphatic group, an aromatic group or a heterocyclic group; n represents 0 or 1; A represents a group which reacts with an aromatic amine developing agent to form a chemical bond; X represents a group which reacts with an aromatic amine developing agent to undergo elimination; B represents a hydrogen atom, an aliphatic group, an aromatic group, a heterocyclic group, an acyl group or a sulfonyl group; and Y represents a group which accelerates the addition of an aromatic amine developing agent to the compound of the general formula (QII). $R_1$ and X, or Y and $R_2$ or B may be bonded to each other to form a cyclic structure.

Typical among the reaction system by which A is chemically bonded to the remaining aromatic amine developing agent are substitution reactions and addition reactions.

Typical examples of preferred compounds represented by the general formulae (QI) and (QII) are described in JP-A-63-158545 and JP-A-62-283338, and Japanese Patent Application No. 63-18439 and 62-158342.

Preferred examples of Compound (R) which undergo chemical bonding to an oxidation product of an aromatic amine developing agent remaining after color development to produce a chemically inert and substantially colorless compound can be represented by the general formula (RI):

$$R-Z \quad \text{(RI)}$$

wherein R represents an aliphatic group, an aromatic group or a heterocyclic group; and Z represents a nucleophilic group or a group which undergoes decomposition in a light-sensitive material to release a nucleophilic group. The compound represented by the general formula (RI) is preferably a compound wherein Z is a group having a Pearson's nucleophilicity $^{n}CH_3I$ value (R. G. Pearson, et al., *J. Am. Chem. Soc.*, 90, 319(1968)) of 5 or more or a group derived therefrom.

Specific examples of preferred compounds represented by the general formula (RI) are described in European Patent 255722, JP-A-62-143048 and JP-A-62-229145, and Japanese Patent Application Nos. 63-18439, 63-136724, 62-214681, and 62-158342.

The combination of Compound (R) with Compound (Q) is further described in European Patent Disclosure No. 277589.

The light-sensitive material prepared according to the present invention may comprise a water-soluble dye as a filter dye in the hydrophilic colloid layer or for the purpose of inhibition of irradiation or other various purposes. Examples of such a dye include an oxonol dye, a hemioxonol dye, a styryl dye, a merocyanine dye, a cyanine dye, and an azo dye. Particularly preferred among these dyes are an oxonol dye, a hemioxonol dye and a merocyanine dye.

Examples of dyes which can be preferably used in the present invention can be represented by the general formulae (DI) to (DIII):

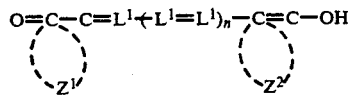

(DI)

wherein $Z^1$ and $Z^2$ may be the same or different and each represents a nonmetallic atom group required for the formation of a heterocyclic group; $L^1$ represents a methine group including substituted methine group and two or more $L^1$ are the same or different each other; and n represents an integer 0, 1 or 2.

The heterocyclic group formed by the nonmetallic atom group represented by $Z^1$ and $Z^2$ is preferably a 5- or 6-membered ring which may be single or condensed. Examples of such a heterocyclic group include a 5-pyrazolone ring, a barbituric acid, an isooxazolone, a thiobarbituric acid, a rhodanine, an imidazopyridine, a pyrazolopyrimidine and a pyrrolidone. These rings may be further substituted.

The heterocyclic group formed by $Z^1$ or $Z^2$ is preferably a 5-pyrazolone ring or a barbituric acid containing at least one sulfonic acid group or carboxylic acid group. Examples of oxonol dyes containing these pyrazolone or barbituric acid nuclei are described in British Patent 506,285, 1,177,429, 1,311,884, 1,338,799, 1,385,371, 1,467,214, 1,433,102, and 1,553,516, JP-A-48-85130, JP-A-49-114420, JP-A-55- 161233, and JP-A-59-111640, and U.S. Pat. No. 3,247,127, 3,469,985, and 4,078,933.

The methine group represented by $L^1$ may contain substituents such as an alkyl group (e.g., methyl, ethyl), an aryl group (e.g., phenyl) or a halogen atom (e.g., chlorine). Two or more L'(s) may be connected to each other to form a ring (e.g., 4,4-dimethyl-1-cyclohexene).

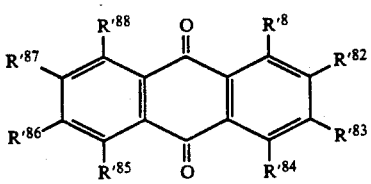

(DII)

wherein $R'^{81}$, $R'^{84}$, $R'^{85}$ and $R'^{88}$ may be the same or different and each represents a hydrogen atom, a hydroxyl group, an alkoxy group, an aryloxy group, a carbamoyl group or an amino group

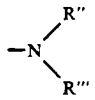

in which R'' and R''' may be the same or different and each represents a hydrogen atom or alkyl or aryl group containing at least one sulfonic acid group or carboxyl group.

$R'^{82}$, $R'^{83}$, $R'^{86}$ and $R'^{87}$ may be the same or different and each represents a hydrogen atom, sulfonic acid group, carboxyl group or alkyl or aryl group containing at least one sulfonic acid group or carboxyl group.

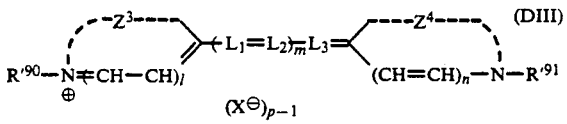

(DIII)

or

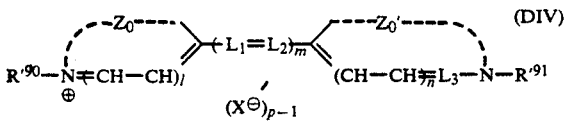

(DIV)

wherein $R'^{90}$ and $R'^{91}$ may be the same or different and each represents a substituted or unsubstituted alkyl group.

$L_1$, $L_2$ and $L_3$ may be the same or different and each represents a substituted or unsubstituted methine group as described above. The suffix m represents 0 to 3.

$Z_0$, $Z_0'$, $Z^3$ and $Z^4$ may be the same or different and each represents a nonmetallic atom group required for the formation of a substituted or unsubstituted 5- or 6-membered heterocyclic group. The suffixes l and n each represents an integer 0 or 1.

$X^{\ominus}$ represents an anion. P represents an integer of 1 or 2. When the compound forms an intramolecular salt, P is 1. .

The above described cyanine dyes are further described in U.S. Pat. Nos. 2,843,486, and 3,294,539.

Blue-sensitive emulsions, green-sensitive emulsions and red-sensitive emulsions used in the present invention are those spectrally sensitized so as to have color sensitivities using methine dyes or other dyes, respectively. Examples of dyes which can be used include cyanine dyes, merocyanine dyes, complex cyanine dyes, complex merocyanine dyes, holopolar cyanine dyes, hemicyanine dyes, styryl dyes and hemioxonol dyes. Of these dyes, cyanine dyes, merocyanine dyes and complex merocyanine dyes are particularly useful.

Waht respect to these dyes, any of the nuclei conventionally employed for cyanine dyes can be used as a basic heterocyclic nuclieus. That is, there are illustrated a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, or a pyridine nucleus; nuclei where alicyclic hydrocarbon rings are fused on the foregoing nuclei; and nuclei where aromatic hydrocarbon rings are fused on the foregoing nuclei, e.g., an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, and a quinoline nucleus. These nuclei may be substituted on a carbon atom.

With respect to merocyanine dyes or complex merocyanine dyes, 5- or 6-membered heterocyclic nuclei such as a pyrazolin-5-one nucleus, a thiohydantoin nucleus, a thiooxazolidin-2,4-dione nucleus, a thiazolidin-2,4-dione nucleus, a rhodanine nucleus, or a thiobarbituric acid nucleus may be applied as a nucleus having a ketomethylene structure.

These sensitizing dyes may be used alone or in combination thereof. Combinations of sensitizing dyes are, in particular, often used for the purpose of supersensitization. Typical examples thereof are described, for example, in U.S. Pat. Nos. 2,688,545, 2,977,229, 3,397,060, 3,522,052, 3,527,641, 3,617,293, 3,638,964, 3,666,480, 3,672,898, 3,679,428, 3,703,377, 3,769,301, 3,814,609, 3,837,862 and 4,026,707, British Patents 1,344,281 and 1,507,803, JP-B-43-4936, JP-B-53-12375, JP-A-52-110618 and JP-A-52-109925.

Dyes which do not themselves have a spectral sensitizing function but exhibit supersensitization or substances which do not substantially absorb a visible light but exhibit supersensitization may be incorporated into an emulsion in combination with the sensitizing dye.

As a binder or protective colloid to be incorporated in the emulsion in the present light-sensitive material there can be advantageously used gelatin. Other hydrophilic colloids can be used.

Examples of such hydrophilic colloids which can be used in the present invention include protein such as gelatin derivatives, graft polymers of gelatin with other high molecular weight compounds, albumine, and casein; saccharide derivatives such as hydroxyethyl cellulose, carboxymethyl cellulose, cellulose ester sulfate, sodium alginate, and starch derivatives; monopolymers or copolymers such as polyvinyl alcohol, polyvinyl alcohol partial acetal, poly-N-vinyl pyrrolidone, polyacrylic acid, polymethacrylic acid, polyacrylamide, polyvinyl imidazole, and polyvinyl pyrazole, and other various synthetic hydrophilic high molecular weight compounds.

As gelatin there can be used either lime-treated gelatin or acid-treated gelatin. The preparation of gelatin is further described in Arther Vice, *The Macromolecular Chemistry of Gelatin,* Academic Press, 1964.

The term "reflective support" as used herein means a material which improves the reflecting properties of the light-sensitive material to sharpen dye images formed in the silver halide emulsion layer. Examples of such a reflective support include a material comprising a dispersion of a light-reflecting substance such as titanium oxide, lead oxide, calcium carbonate or calcium sulfate in a hydrophobic resin coated on a support and a hydrophobic resin comprising a light-reflecting substance dispersed therein. Specific examples of such a reflective support include baryta paper, polyethylene-coated paper, polypropylene synthetic paper, transparent supports such as a glass plate comprising a reflective substance, polyester film such as polyethylene terephthalate, cellulose triacetate or cellulose nitrate, polyamide film, polycarbonate film, polystyrene film, and vinyl chloride resin. These support materials can be properly selected depending on the purpose or application of the color photographic material.

Preferably a white pigment as reflective substance is thoroughly kneaded in the presence of a surface active agent. The white pigment to be used is preferably treated with a divalent, trivalent or tetravalent alcohol on the surface thereof.

The percentage of the area of white pigment grain per specified unit area can be most normally determined by dividing the observed area into adjacent 5 $\mu m \times 6$ $\mu m$ unit areas, and then measuring the percentage of the projected area of finely divided grain (Ri) per the unit area. The coefficient of the fluctuation of the percentage area ratio can be determined by the ratio of the standard deviation s of Ri to the average $\bar{R}$ ($s/\bar{R}$). The number of the specified unit area (n) is preferably 6 or more. Therefore, the coefficient of fluctuation can be determined by the equation:

$$\sqrt{\frac{\sum_{n=1}^{n} (Ri - \bar{R})^2}{n-1}} \Big/ \frac{\sum_{i=1}^{n} Ri}{n}$$

In the present invention, the fluctuation coefficient of the percentage area ratio of finely divided pigment grain is preferably 0.15 or less, particularly 0.12 or less. The dispersibility of finely divided grains having a fluctuation coefficient of 0.08 or less as determined in this manner can be said to be "substantially uniform".

In the light-sensitive material of the present invention, if the hydrophilic colloid layer contains a dye or ultraviolet absorbent, it may be mordanted by a cationic polymer. Examples of such a cationic polymer which can be used in the present invention include those described in British Patent 685,475, U.S. Pat. Nos. 2,675,316, 2,839,401, 2,882,156, 3,048,487, 3,184,309, and 3,445,231, West German Patent Application (OLS) 1,914,362, and JP-A-50-47624, and JP-A-50-71332.

The light-sensitive material of the present invention may comprise as a color fog inhibitor a hydroquinone derivative, aminophenol derivative, gallic acid derivative, ascorbic acid derivative, or the like. Specific examples of such -.compounds are described in U.S. Pat. Nos. 2,360,290, 2,336,327, 2,403,721, 2,418,613, 2,675,314, 2,701,197, 2,704,713, 2,728,659, 2,732,300, and 2,735,765, JP-A-50-92988, JP-A-50-92989, JP-A-50-93928, JP-A-50-110337, and JP-A-52-146235, and JP-B-50-23813.

The silver halide emulsion layer or other hydrophilic colloid layer may contain fine grained silver halide emulsion being substantially light-insensitive (for example, a silver chloride, silver bromide or silver chlorobromide emulsion having 0.20 $\mu m$ or less of average grain size).

In the photographic light-sensitive material of the present invention, gelatin hardeners are employed. When conducting a rapid processing, hardening of the hydrophilic layers is a particularly important factor. Preferred examples of the hardeners used include compounds represented by the general formula (H-I) or (H-II) described below.

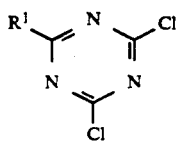

(H-I)

wherein $R^1$ represents a hydroxy group, —OM (wherein M represents a monovalent metal atom), an alkyl group,

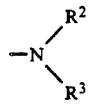

(wherein $R^2$ and $R^3$, which may be the same or different, each represents a hydrogen atom, an alkyl group or an aryl group), —$NHCOR^4$ (wherein $R^4$ represents a hydrogen atom, an alkyl group, an aryl group, an alkylthio group or an arylthio group), or an alkoxy group.

In general formula (H-I), the alkyl group represented by $R^1$ is preferably, for example, a methyl group, an ethyl group, or a butyl group. The alkoxy group is preferably, for example, a methoxy group, an ethoxy group or a butoxy group. Specific examples of

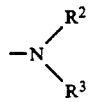

include —$NH_2$, —$NHCH_3$ or —$NHC_2H_5$. Specific examples of —$NHCOR^4$ include —$NHCOCH_3$ or —$NHCOC_6H_5$. M in —OM represented by $R^1$ is particularly preferably a sodium atom or a potassium atom.

The cyanuric chloride type hardeners represented by general formula (H-I) above are described in detail, for example, in JP-B-47-6151, JP-B-47-33380, JP-B-54-25411 and JP-A-56-130740. Further, compounds having similar structures to the compounds represented by the general formula (H-I) as described, for example, in JP-B- 53-2726, JP-A-50-61219, JP-A-56-27135, JP-A-56-60430 and JP-A-57-40244.

$$X^1—SO_2—L^2—SO_2—X^2 \qquad \text{(H-II)}$$

wherein $X^1$ and $X^2$, which may be the same or different, each represents —CH=$CH_2$ or —$CH_2CH_2Y$ (wherein Y represents a nucleophilic group or a group capable of being released by a base in the form of HY, for example, a halogen atom, a sulfonyloxy group, or a sulfuric acid monoester group); and $L^2$ represents a divalent linking group which may be substituted.

Specific examples of $X^1$ or $X^2$ include the following: —CH=$CH_2$, —$CH_2CH_2Cl$, —$CH_2CH_2Br$, —$CH_2CH_2OSO_2CH_3$,

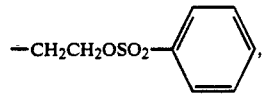

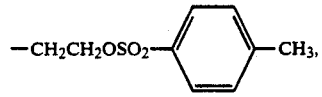

—$CH_2CH_2OSO_3Na$, —$CH_2CH_2OSO_3K$, —$CH_2CH_2OH$, —$CH_2CH_2OCOCH_3$, —$CH_2CH_2OCOCF_3$, —$CH_2CH_2OCOCHCl_2$.

Of these groups, —CH=$CH_2$, —$CH_2CH_2Cl$, —$CH_2CH_2Br$, —$CH_2CH_2OSO_2CH_3$ and —$CH_2CH_2OSO_3Na$ are particularly preferred.

The divalent linking group represented by $L^2$ in formula (H-II) includes an alkylene group, an arylene group, and a divalent group formed by combination of the above described groups and one or more bonds selected from $$-O-,\ -\underset{\underset{R^1}{|}}{N}-,\ -CO-,\ -SO-,\ -SO_2-.\ -SO_3-,$$

$$-SO_2\underset{\underset{R^1}{|}}{N}-,\ -COO-,\ -\underset{\underset{R^1}{|}}{CON}-,\ -\underset{\underset{R^1}{|}}{N}\underset{\underset{R^1}{|}}{CON}-\ \text{and}$$

$$-\underset{\underset{R^1}{|}}{NCO_2}-$$

(wherein $R^1$ represents a hydrogen atom, an alkyl or aralkyl group having from 1 to 15 carbon atoms). When $L^2$ include two or more of $$-\underset{\underset{R^1}{|}}{N}-,\ -SO_2\underset{\underset{R^1}{|}}{N}-,\ -\underset{\underset{R^1}{|}}{CON}-\ \text{or}\ -\underset{\underset{R^1}{|}}{NCO_2}-,$$

two or more of $R^1$ may be combined with each other to form a ring.

Suitable examples of the substituents for for $L^2$ in formula (H-II) include a hydroxy group, an alkoxy group, a carbamoyl group, a sulfamoyl group, an alkyl group and an aryl group. The substituent may be further substituted with one or more groups represented by $X^3—SO_2—$ (wherein $X^3$ has the same meaning as defined for $X^1$ or $X^2$ above).

Representative examples of $L^2$ are set forth below, wherein a to v each represents an integer from 1 to 6 and only d may represents 0.

$$-(CH_2)_a-O-(CH_2)_b-,$$

$$-(CH_2)_c-\overset{\overset{R^1}{|}}{CON}(CH_2)_d-\overset{\overset{R^1}{|}}{N}CO(CH_2)_e-,$$

$$-(CH_2)_f-SO_2(CH_2)_g-,\ -(CH_2)_h-\overset{\overset{R^1}{|}}{N}-(CH_2)_i-,$$

$$-(CH_2)_j-\overset{\overset{R^1}{|}}{CON}(CH_2)_k-O(CH_2)_l-\overset{\overset{R^1}{|}}{N}CO(CH_2)_m-,$$

$$-(CH_2)_n-CO_2(CH_2)_p-OCO(CH_2)_q-,$$

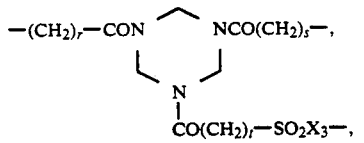

$$-(CH_2)_r-CON\ \underset{\underset{CO(CH_2)_t-SO_2X_3-}{|}}{N}\ NCO(CH_2)_s-,$$

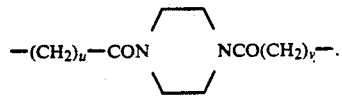

$$-(CH_2)_u-CON\ \ NCO(CH_2)_v-.$$

In the above formulae, d, k, l and p each preferably represents an integer from 1 to 3, and thet integers a to v other than d, k, l and p each preferably represents an integer from 1 to 2. Further, $R^1$ preferably represents a hydrogen atom or an alkyl group having from 1 to 6 carbon atoms, and particularly preferably a hydrogen atom, a methyl group or an ethyl group.

The vinylsulfone type hardeners represented by general formula (H-II) above are described in detail, for example, in JP-B-47-24259, JP-B-50-35807, JP-A-49-24435, JP-A-53-41221 and JP-A-59-18944.

The amount of the hardener used in the present invention is from about 0.01 to about 20 wt %, preferably from about 0.05 to about 10 wt % , based on gelatin.

The color developing solution to be used in the present invention is preferably an alkaline aqueous solution containing as a main component an aromatic primary amine color developing agent. As such a color developing agent there can be effectively used, p-phenylenediamine compounds can be more preferably used. Typical examples of such p-phenylenediamine compounds include 3-methyl-4-amino-N,N-diethylaniline, 3-methyl-4-amino-N-ethyl-N-β-hydroxyethylaniline, 3-methyl-4-amino-N-ethyl-N-(β-methanesulfonamidoethyl)aniline, 3-methyl-4-amino N-ethyl-N-β-methoxyethylaniline, and sulfates, hydrochlorides and p-toluenesulfonates thereof. Two or more of these compounds can be used in combination depending on the purpose or application of the color photographic material.

The color developing solution normally comprises a pH buffer such as a carbonate, borate or phosphate of alkaline metals, a development inhibitor such as bromide, iodide, benzimidazoles, benzothiazoles or mercapto compounds or a fog inhibitor. Typical examples of other additives which can be incorporated in the color developing solution as necessary include preservatives such as hydroxylamine, diethylhydroxylamine, sulfites, hydrazines, phenylsemicarbazides, triethanolamine, catecholsulfonic acids and triethylenediamine( 1,4-diazabicyclo[2,2,2]octane), or9anic solvents such as ethylene glycol and diethylene glycol, development accelerators such as benzyl alcohol, polyethylene glycol, quaternary ammonium salts and amines, dye-forming couplers, competing couplers, fogging agents such as sodium boron hydride, auxiliary developing agents such as 1-phenyl-3-pyrazolidone, thickening agents, chelating agents such as aminopolycarboxylic acids, aminopolyphosphonic acids, alkylphosphonic acids and phosphonocarboxylic acids (e.g., ethylenediaminetetraacetic acid, nitrilotriacetic acid, diethylenetriaminepentaacetic acid, cyclohexanediaminetetraacetic acid, hydroxyethylimidioacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid) and salts thereof).

Reversal processing is usually carried out by black-and-white development followed by color development. Black-and-white developers to be used can contain one or more of known black-and-white developing agents, such as dihydroxybenzenes, e.g., hydroquinones, 3-pyrazolidones, e.g., 1-phenyl-3-pyrazolidone, and aminophenols, e.g., N-methyl-p-aminophenol.

The replenishment rate of the developer is usually 3 l or less per $m^2$ of the light-sensitive material, though depending on the type of the color photographic material to be processed. The replenishment rate may be reduced to 500 ml/$m^2$ or less by decreasing the bromide ion concentration in the replenisher. When the replenishment rate is reduced, it is preferable to reduce the area of the liquid surface in contact with air in the processing tank to thereby prevent evaporation and air-oxidation of the liquid. The replenishment rate can also be reduced by a means for suppressing accumulation of the bromide ion in the developer.

The photographic emulsion layer after color development is usually subjected to bleach. Bleach may be effected simultaneously with fixation (i.e., blix), or these two steps may be carried out separately. For speeding up of processing, bleach may be followed by blix. Further, any of an embodiment wherein two blix baths connected in series are used, an embodiment wherein blix is preceded by fixation, and an embodiment wherein blix is followed by bleach may be selected arbitrarily according to the purpose or application of the color photographic material. Bleaching agents to be used include compounds of polyvalent metals, e.g., iron(III), cobalt(III), chromium(VI), and copper(II), peracids, quinones, nitroso compounds, and the like. Typical examples of these bleaching agents are ferricyanides; bichromates; organic complex salts of iron(III) or cobalt(III), such as complex salts with aminopolycarboxylic acids, e.g., ethylenediaminetetraacetic acid, diethylenetriaminepentaacetic acid, cyclohexanediaminepentaacetic acid, cyclohexanediaminetetraacetic acid, methyliminodiacetic acid, 1,3-diaminopropanetetraacetic acid, and glycol ether diaminetetraacetic acid, or citric acid, tartaric acid, malic acid, etc.; persulfates; hydrobromic acid salts; permanganates; nitrobenzenes; and so on. Of these, aminopolycarboxylic acid-iron(III) complex salts such as (ethylenediaminetetraacetato)iron(III) complex salts and persulfates are preferred in view of the environment pollution. Further aminopolycarboxylic acid-icon (III) complex salt is useful in both of a bleaching and a blix solution.

The bleaching bath, blix bath or a prebath thereof can contain, if desired, a bleaching accelerator. Examples of useful bleaching accelerators are compounds having a mercapto group or a disulfide group as described in U.S. Pat. No. 3,893,858, West German Patents 1,290,812 and 2,059,988, JP-A-53-32736, JP-A-53- 57831, JP-A-53-37418, JP-A-53-72623, JP-A-53-95630, JP-A-53-104232, JP-A-53-124424, JP-A-53-141623 and JP-A-53-28426, *Research Disclosure,* No. 17129 (Jul., 1978); thiazolidine derivatives as described in JP-A-50-140129; thiourea derivatives as described in JP-B-45-8506, JP-A-52-20832 and JP-A-53-32735, and U.S. Pat. No. 3,706,561; iodides as described in West German Patent 1,127,715 and JP-A-58-16235; polyoxyethylene compounds as described in West German Patents 966,410 and 2,748,430; polyamine compounds as described in JP-B-45-8836; the compounds described in JP-A-49-42434, JP-A-49-59644, JP-A-53-94927, JP-A-54-35727, JP-A-55-26506, and JP-A-58-163940; and bromine ions. Preferred among them are compounds having a mercapto group or a disulfide group because of their great acceleratory effects. In particular, the compounds disclosed in U.S. Pat. No. 3,893,858, West German Patent 1,290,812 and JP-A-53-95630 are preferred. The compounds disclosed in U.S. Pat. No. 4,552,834 are also preferred. These bleaching accelerators may be incorporated into the light-sensitive material.

Fixing agents to be used for fixation include thiosulfates, thiocyanates, thioethers, thioureas, and a large amount of iodides. The thiosulfates are usually employed, with ammonium thiosulfate being applicable most broadly. Sulfites, bisulfites or carbonyl bisulfite adducts are suitably used as preservatives of the blix bath.

It is usual that the thus desilvered silver halide color photographic materials of the invention are subjected to washing and/or stabilization. The quantity of water to be used in the washing can be selected from a broad range depending on the characteristics of the light-sensitive material (for example, the kind of couplers, etc.), the end use of the light-sensitive material, the temperature of the washing water, the number of washing tanks (number of stages), the replenishment system (e.g., counter-flow system or direct-flow system), and other various factors. Of these factors, the relationship between the number of washing tanks and the quantity of water in a multistage counter-flow system can be obtained according to the method described in *Journal of the Society of Motion Picture and Television Engineers,* Vol. 64, pp. 248–253 (May, 1955).

According to the multi-stage counter-flow system described in the above reference, although the requisite amount of water can be greatly reduced, bacteria would grow due to an increase of the retention time of water in the tank, and floating masses of bacteria stick to the light-sensitive material. In the present invention, in order to cope with this problem, the method of reducing calcium and magnesium ion concentrations described in Japanese Patent Application No. 61-131632 can be used very effectively. Further, it is also effective to use isothiazolone compounds or thiabenzazoles as described in JP-A-578542, chlorine type bactericides, e.g., chlorinated sodium isocyanurate, benzotriazole, and bacteriocides described in Hiroshi Horiguchi, *Bokinbobaizai no Kagaku,* Eisei Gijutsu Gakkai (ed.), *Biseibutsu no Mekkin, Sakkin, Bobaigijutsu,* and Nippon Bokin Bobai Gakkai (ed.), *Bokin Bobaizai Jiten.*

The washing water has a pH of from 4 to 9, preferably from 5 to 8. The temperature of the water and the washing time can be selected from broad ranges depending on the characteristics and end use of the light-sensitive material, but usually ranges from 15° to 45° C. in temperature and from 20 seconds to 10 minutes in time, preferably from 25° to 40° C. in temperature and from 30 seconds to 5 minutes in time. The light-sensitive material of the invention may be directly processed with a stabilizer in place of the washing step. For the stabilization, any of the known techniques as described in JP-A-57-8543, JP-A-58-14834, and JP-A-60-220345 can be used.

The aforesaid washing step may be followed by stabilization in some cases. This stabilizing bath may also contain various chelating agents or bacteriocides. The overflow accompanying replenishment of the washing bath and/or stabilizing bath can be reused in other steps such as desilvering.

The silver halide color light-sensitive material of the present invention may comprise a color developing agent for the purpose of simplifying and speeding up processing. Such a color developing agent is preferably incorporated in the color light-sensitive material in the form of a precursor thereof. Examples of such a precursor include indoaniline compounds as described in U.S. Pat. No. 3,342,597, Schiff's base type compounds as described in U.S. Pat. No. 3,342,599, and *Research Disclosure* Nos. 14,850 and 15,159, aldol compounds as described in *Research Disclosure* No. 13,924, metal salt complexes as described in U.S. Pat. No. 3,719,492, and urethane compounds as described in JP-A-53-135628.

The silver halide color light-sensitive material of the present invention may optionally comprise various 1-phenyl-3-pyrazolidones for the purpose of accelerating color development. Typical examples of such a compound are described in JP-A-56-64339, JP-A-57-144547, and JP-A-58-115438.

In the present invention, the various processing solutions can be used at a temperature of from 10° C. to 50° C. The standard temperature range is from 33° C. to 38° C. However, the temperature range can be raised to accelerate processing, reducing the processing time. On the contrary, the temperature range can be lowered to improve image quality or stability of the processing solution. In order to save silver to be incorporated in the light-sensitive material, a processing utilizing cobalt or hydrogen peroxide intensification as described in West German Patent 2,226,770 and U.S. Pat. No. 3,674,499 may be employed.

Each processing bath can be optionally provided with a heater, temperature sensor, liquid level sensor, circulating pump, filter, various floating cover, various squeegees, or the like.

The present invention will be further described in the following examples, but the present invention should not be construed as being limited thereto.

EXAMPLE 1

Silver Halide Emulsion (A) used in a blue-sensitive silver halide emulsion layer was prepared in the following manner.

| | |
|---|---|
| Solution 1 | |
| $H_2O$ | 1,000 ml |
| NaCl | 9.07 g |
| KBr | 0.07 g |
| Gelatin | 25.8 g |
| Sulfuric acid (1N) | 19.7 ml |
| Solution 2 | |
| An aqueous solution containing 1% by weighy of a compound of the formula: | 3 ml |

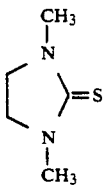

| | |
|---|---|
| Solution 3 | |
| KBr | 17.0 g |
| NaCl | 0.25 g |
| $H_2O$ to make | 129.3 ml |
| Solution 4 | |
| $AgNO_3$ | 25 g |
| $NH_4NO_3$ (50%) | 0.5 ml |
| $H_2O$ to make | 133.3 ml |
| Solution 5 | |
| KBr | 52.07 g |
| NaCl | 5.4 g |
| $K_2IrCl_6$ (0.001%) | 2.0 ml |
| $H_2O$ to make | 283.3 ml |
| Solution 6 | |
| $AgNO_3$ | 100 g |
| $NH_4NO_3$ (50%) | 1.5 ml |
| $H_2O$ to make | 286 ml |

Solution 1 was heated at 70° C., Solution 2 was added thereto, and then Solution 3 and Solution 4 were added simultaneously over a period of 40 minutes thereto. After 10 minutes, Solution 5 and Solution 6 were added simultaneously over a period of 25 minutes. Five minutes after the addition was completed, the temperature was lowered and the mixture was de-salted. Water and gelatin for dispersion were added thereto and the pH was adjusted to 6.15, whereby a monodisperse cubic silver chlorobromide emulsion (having an average grain size of 0.88 μm, a coefficient of variation [a value obtained by dividing the standard deviation with the average grain size: s/$\bar{d}$] of 0.06 and a silver bromide content of 79 mol %) was obtained. The emulsion was subjected to an optimum chemical sensitization using triethylthiourea, whereby Silver Halide Emulsion (A) was prepared.

Silver Halide Emulsion (B) used in the blue-sensitive silver halide emulsion layer, Silver Halide Emulsions (C) and (D) used in a green-sensitive silver halide emulsion layer and Silver Halide Emulsions (E) and (F) used in a red-sensitive silver halide emulsion layer were prepared in the same manner as described above except changing the amounts of chemicals, temperature and time for addition, respectively.

The crystal form, average grain size, halogen composition and coefficient of variation of each of Silver Halide Emulsions (A) to (F) are shown below.

| Emulsion | Crystal Form | Average Grain Size (μm) | Halogen Composition (Br mol %) | Coefficient of Variation |
|---|---|---|---|---|
| (A) | cubic | 0.88 | 79 | 0.06 |
| (B) | cubic | 0.65 | 80 | 0.06 |
| (C) | cubic | 0.46 | 90 | 0.09 |
| (D) | cubic | 0.35 | 90 | 0.09 |
| (E) | cubic | 0.48 | 74 | 0.10 |
| (F) | cubic | 0.34 | 74 | 0.10 |

On a paper support, both surfaces of which were laminated with polyethylene, were coated layers as shown below in order to prepare a multilayer color photographic light-sensitive material which was designated Sample 101. The coating solutions were prepared in the following manner.

Preparation of Coating Solution for First Layer 19.1 g of Yellow Coupler (Y-1), 0.17 g of Antifogging Agent (Cpd-1) and 1.91 g of Color Image Stabilizer (Cpd-2) were dissolved in a mixture of 29.9 ml of ethyl acetate, 3.8 ml of Solvent (Solv-1) and 3.8 ml of Solvent (Solv-2), and the resulting solution was emulsified and dispersed in 135 ml of a 10% aqueous solution of gelatin containing 8 ml of a 10% aqueous solution of sodium dodecylbenzenesulfonate. Separately, 102.5 g of a mixture of Silver Halide Emulsion (A) and Silver Halide Emulsion (B) in a mixing ratio of 3:7 (by weight) and 130 g of a 10% aqueous solution of gelatin were mixed and to the resulting emulsion were added 26.7 ml of a 0.1% methanol solution of a blue-sensitive sensitizing dye shown below and 6.9 ml of a 2% aqueous solution of 4-hydroxy-6-methyl-1,3,3a,7-tetraazaindene. Then, the above described emulsified dispersion was added thereto, and the pH and viscosity thereof were adjusted to prepare a coating solution for the first layer. Poly(potassium styrenesulfonate) was used for adjusting the viscosity thereof.

Coating solutions for the second layer to the seventh layer were prepared in a similar manner as described for the coating solution for the first layer.

1-Oxy-3,5-dichloro-s-triazine sodium salt was used as a gelatin hardener in each layer.

The following spectral sensitizing dyes were employed in the emulsion layers, respectively.

Blue-Sensitive Emulsion Layer (ExS-1)

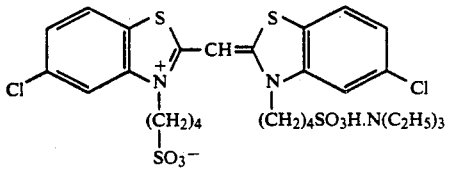

(Amount added: $3.8 \times 10^{-4}$ mol per mol of silver halide)

Green-Sensitive Emulsion (ExS-2)

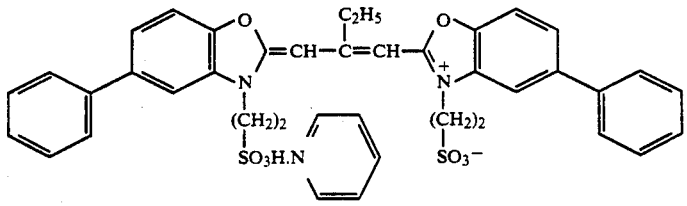

(Amount added: $2.1 \times 10^{-4}$ mol per mol of silver halide)

and (ExS-3)

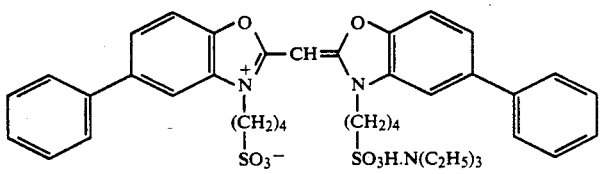

(Amount added: $4.2 \times 10^{-5}$ mol per mol of silver halide)

Red Sensitive Emulsion Layer (ExS-4)

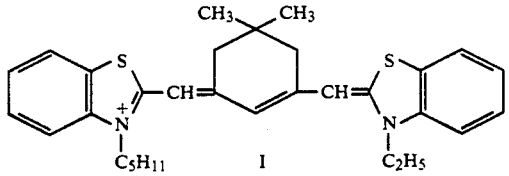

(Amount added: $6.1 \times 10^{-5}$ mol per mol of silver halide)

To the red-sensitive emulsion layer was added the compound described below in an amount of $2.3 \times 10^{-3}$ mol per mol of silver halide.

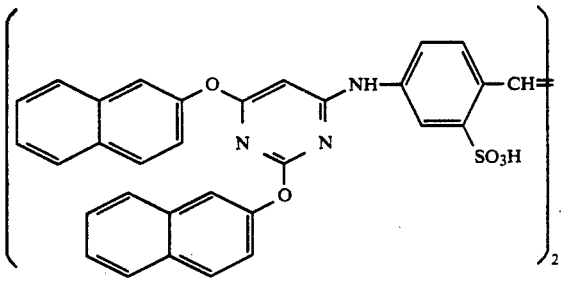

Also, to the blue-sensitive emulsion layer and green-sensitive emulsion layer, was added 4-hydroxy-6-methyl-1,3,3a,7-tetraazaindene in amounts of $1.2 \times 10^{-2}$ and $1.3 \times 10^{-3}$ mol per mol of silver halide, respectively.

Further, to the green-sensitive emulsion layer, was added 1-(5-methylureidophenyl)-5-mercaptotetrazole in an amount of $5.0 \times 10^{-4}$ mol per mol of silver halide.

Furthermore, as irradiation preventing dyes, the following dyes were employed.

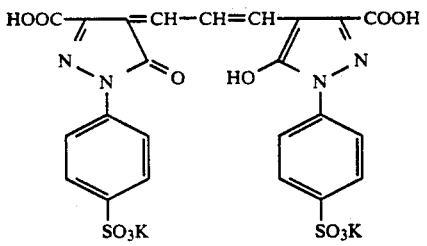

and

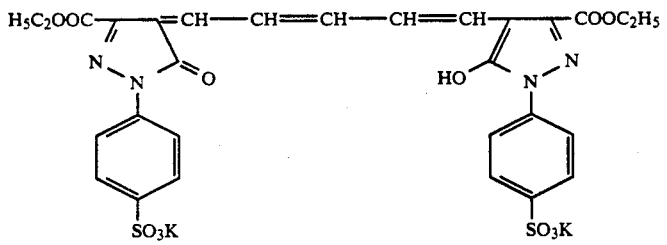

Layer Construction

The composition of each layer is shown below. The numerical values denote the coating amounts of components in the unit of g/m². The coating amount of silver halide emulsion is indicated in terms of silver coating amount.

| | | |
|---|---|---|
| Support | Paper support, both surfaces of which were laminated with polyethylene (the polyethylene coating containing a white pigment ($TiO_2$) and a bluish dye (ultramarine) on the first layer side) | |
| First Layer (Blue-sensitive layer) | Silver Halide Emulsion (A) | 0.09 |
| | Silver Halide Emulsion (B) | 0.21 |
| | Gelatin | 1.28 |
| | Yellow Coupler (Y-1) | 0.68 |
| | Color Image Stabilizer (Cpd-2) | 0.07 |
| | Antifogging Agent (Cpd-1) | |
| | Solvent (Solv-1) | 0.12 |
| | Solvent (Solv-2) | 0.12 |
| Second Layer (Color mixing Preventing layer) | Gelatin | 1.34 |
| | Color Mixing Preventing Agent (Cpd-3) | 0.04 |
| | Solvent (Solv-3) | 0.10 |
| | Solvent (Solv-4) | 0.10 |
| Third Layer (Green-Sensitive layer) | Silver Halide Emulsion (C) | 0.075 |
| | Silver Halide Emulsion (D) | 0.05 |
| | Gelatin | 1.47 |
| | Magenta Coupler (M-11) | 0.32 |
| | Color Image Stabilizer (Cpd-4) | 0.10 |
| | Color Image Stabilizer (Cpd-5) | 0.08 |
| | Color Image Stabilizer (Cpd-6) | 0.03 |
| | Color Image Stabilizer (Cpd-7) | 0.004 |
| | Solvent (Solv-3) | 0.25 |
| | Solvent (Solv-5) | 0.40 |
| Fourth Layer (Ultraviolet light Absorbing layer) | Gelatin | 1.43 |
| | Ultraviolet Light Absorbing Agent (UV-1) | 0.47 |
| | Color Mixing Preventing Agent (Cpd-3) | 0.05 |
| | Solvent (Solv-6) | 0.24 |
| Fifth Layer (Red-sensitive layer) | Silver Halide Emulsion (E) | 0.06 |
| | Silver Halide Emulsion (F) | 0.14 |
| | Gelatin | 0.85 |
| | Cyan Coupler (C-4) | 0.13 |
| | Cyan Coupler (C-5) | 0.15 |
| | Color Image Stabilizer (Cpd-2) | 0.25 |
| | Antifogging Agent (Cpd-1) | $5.2 \times 10^{-4}$ mol/mol Ag |
| | Color Image Stabilizer (Cpd-5) | 0.004 |
| | Color Image Stabilizer (Cpd-6) | 0.007 |

-continued

| | | |
|---|---|---|
| | Color Image Stabilizer (Cpd-8) | 0.067 |
| | Solvent (Solv-1) | 0.16 |
| Sixth Layer (Ultraviolet light Absorbing layer) | Gelatin | 0.38 |
| | Ultraviolet Light Absorbing Agent (UV-1) | 0.13 |
| | Solvent (Solv-6) | 0.06 |
| Seventh Layer (Protective layer) | Gelatin | 1.25 |
| | Acryl-modified Polyvinyl Alcohol Copolymer (Degree of modification: 17%) | 0.05 |
| | Liquid Paraffin | 0.02 |

The compounds used in the above-described layers have the structures shown below, respectively.

Antifogging Agent (Cpd-1)

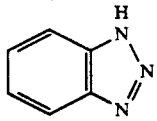

Color Image Stabilizer (Cpd-2)

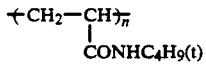

(average molecular weight: 60,000)

Color Mixing Preventing Agent (Cpd-3)

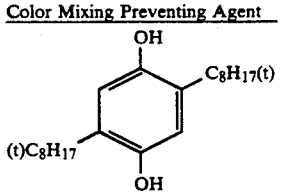

Color Image Stabilizer (Cpd-4)

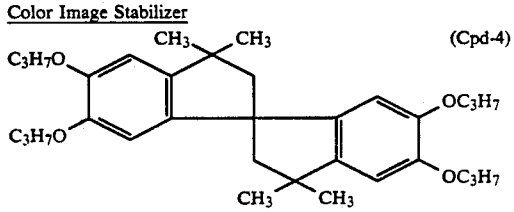

-continued (Cpd-5)

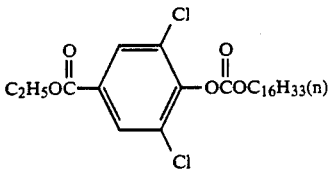

(Cpd-6)

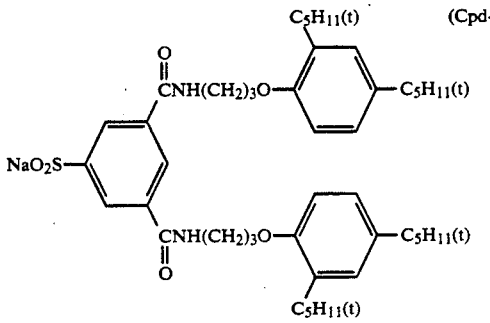

(Cpd-7)

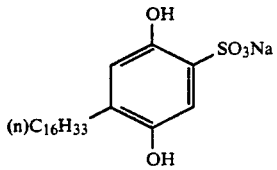

A mixture of (Cpd-8)

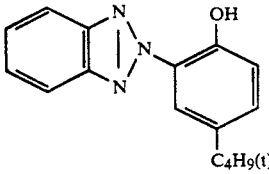

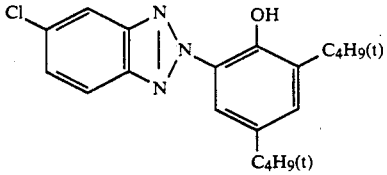

and

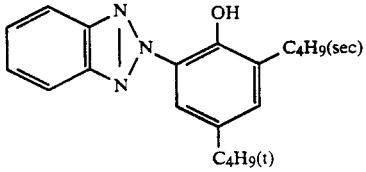

in a weight ratio of 4:2:5.

Ultraviolet Light Absorbing Agent

A mixture of

-continued (UV-1)

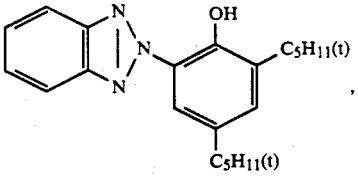

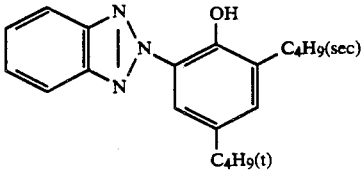

and

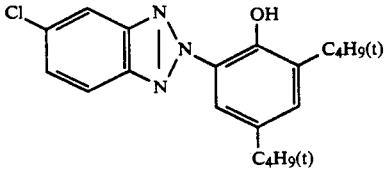

in a weight ratio of 12:10:3.

Solvent (Solv-1)

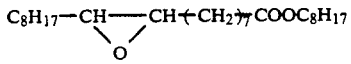

(Solv-2)

(Solv-3)

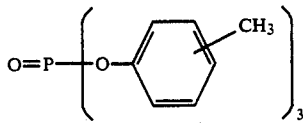

(Solv-4)

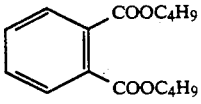

(Solv-5)

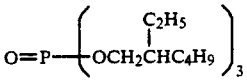

(Solv-6)

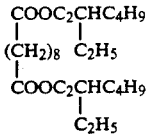

Samples 102 to 110 were prepared in the same manner as described for Sample 101 above, except for changing the red-sensitive sensitizing dye and the antifogging agent used in the fifth layer (red-sensitive layer), the coupler used in the third layer (green-sensitive layer) and the pH of the layers to those shown in Table 1.

TABLE 1

| Sample No. | Third Layer (Green-Sensitive Layer) Magenta Coupler | Fifth Layer (Red-Sensitive Layer) Red Sensitive Sensitizing Dye | Fifth Layer (Red-Sensitive Layer) Antifogging Agent | pH of Layers |
|---|---|---|---|---|
| 101 | M-11 (0.32 g/m$^2$) | ExS-4 ($6.1 \times 10^{-5}$ mol/mol Ag) | Cpd-1 ($5.2 \times 10^{-4}$ mol/mol Ag) | 6.2 |
| 102 | M-11 | ExS-4 | E-1 | 6.2 |

TABLE 1-continued

| Sample No. | Third Layer (Green-Sensitive Layer) Magenta Coupler | Fifth Layer (Red-Sensitive Layer) Red Sensitive Sensitizing Dye | Antifogging Agent | pH of Layers |
|---|---|---|---|---|
| 103 | M-11 | III-2 | Cpd-1 | 6.2 |
| 104 | M-11 | III-2 | E-1 | 5.0 |
| 105 (Present Invention) | M-11 | III-2 | E-1 | 5.7 |
| 106 (Present Invention) | M-11 | III-2 | E-1 | 6.2 |
| 107 (Comparison) | M-11 | III-2 | E-1 | 7.0 |
| 108 (Comparison) | M-57 | III-2 | E-1 | 6.2 |
| 109 (Comparison) | M-11 | III-2 | E-1 ($3.5 \times 10^{-4}$ mol/mol Ag) D-25 ($1.7 \times 10^{-4}$ mol/mol Ag) | 6.2 |
| 110 (Comparison) | M-57 | III-2 | E-1 ($3.5 \times 10^{-4}$ mol/mol Ag) D-25 ($3.5 \times 10^{-4}$ mol/mol Ag) | 6.2 |

The amounts were the same as those in Sample 101 unless otherwise indicated in Table 1.

The samples thus-prepared were evaluated in the following manner. More specifically, each sample was divided into two portions, and one was stored at room temperature for 5 days and the other was stored under the condition of 35° C. and 60% relative humidity (RH) for 1 month. Then, these samples were subjected to stepwise exposure for sensitometry through a three color separation filter using a sensitometer (FWH Type manufactured by Fuji Photo Film Co., Ltd, color temperature of light source: 3200° K.). The exposure was conducted at an exposure time of 0.1 second in an exposure amount of 250 CMS.

The exposed samples were continuously processed according to Processing Schemes A, B and C as shown below, respectively.

Processing A:

| Processing Step | Temperature (°C.) | Time |
|---|---|---|
| Color Development | 33 | 3 min. 30 sec. |
| Bleach-Fixing | 33 | 1 min. 30 sec. |
| Washing with Water (1) | 30 to 34 | 60 sec. |
| Washing with Water (2) | 30 to 34 | 60 sec. |
| Washing with Water (3) | 30 to 34 | 60 sec. |
| Drying | 70 to 80 | 50 sec. |

The washing with water steps were carried out by a three-tank countercurrent system from a Washing with Water (3) to a Washing with Water (1).

The composition of each processing solution used was as follows.

| | |
|---|---|
| Color Developing Solution: | |
| Water | 800 ml |
| Diethylenetriaminepentaacetic acid | 1.0 g |
| Nitrilotriacetic acid | 1.5 g |
| Benzyl alcohol | 15 ml |
| Diethylene glycol | 10 ml |
| Sodium sulfite | 2.0 g |
| Potassium bromide | 0.5 g |
| Potassium carbonate | 30 g |
| N-Ethyl-N-(β-methanesulfonamidoethyl)-3-methyl-4-aminoaniline sulfate | 5.0 g |
| Hydroxylamine sulfate | 4.0 g |
| Fluorescent brightening agent (WHITEX 4B manufactured by Sumitomo Chemical Co., Ltd.) | 1.0 g |
| Water to make | 1000 ml |
| pH (25° C.) | 10.20 |
| Bleach-Fixing Solution: | |
| Water | 400 ml |

-continued

| | |
|---|---|
| Ammonium thiosulfate (70% aqueous solution) | 150 ml |
| Sodium sulfite | 18 g |
| Ammonium iron(III) ethylenediamine-tetraacetate | 55 g |
| Disodium ethylenediamine-tetraacetate | 5 g |
| Water to make | 1000 ml |
| pH (25° C.) | 6.70 |

Processing B:

| Processing Step | Temperature (°C.) | Time |
|---|---|---|
| Color Development | 37 | 3 min. 30 sec. |
| Bleach-Fixing | 33 | 1 min. 30 sec. |
| Washing with Water (1) | 30 to 34 | 60 sec. |
| Washing with Water (2) | 30 to 34 | 60 sec. |
| Washing with Water (3) | 30 to 34 | 60 sec. |
| Drying | 70 to 80 | 60 sec. |

The washing with water steps were carried out by a three-tank countercurrent system from a Washing with Water (3) to a Washing with Water (1).

The composition of each processing solution used was as follows.

| | |
|---|---|
| Color Developing Solution: | |
| Water | 800 ml |
| Diethylenetriaminepentaacetic acid | 1.0 g |
| Nitrilotriacetic acid | 2.0 g |
| Benzyl alcohol | 15 ml |
| Diethylene glycol | 10 ml |
| Sodium sulfite | 2.0 g |
| Potassium bromide | 1.0 g |
| Potassium carbonate | 30 g |
| N-Ethyl-N-(β-methanesulfonamidoethyl)-3-methyl-4-aminoaniline sulfate | 4.5 g |
| Hydroxylamine sulfate | 3.0 g |
| Fluorescent brightening agent (WHITEX 4B manufactured by Sumitomo Chemical Co., Ltd.) | 1.0 g |
| Water to make | 1000 ml |
| pH (25° C.) | 10.25 |
| Bleach-Fixing Solution: | |
| Water | 400 ml |
| Ammonium thiosulfate (70% aqueous solution) | 150 ml |
| Sodium sulfite | 18 g |
| Ammonium iron(III)ethylenediamine-tetraacetate | 55 g |
| Disodium ethylenediamine-tetraacetate | 5 g |
| Water to make | 1000 ml |
| pH (25° C.) | 6.70 |

-continued

| Processing C: | | |
|---|---|---|
| Processing Step | Temperature (°C.) | Time |
| Color Development | 38 | 1 min. 40 sec. |
| Bleach-Fixing | 35 | 60 sec. |
| Rinse (1) | 33 to 35 | 20 sec. |
| Rinse (2) | 33 to 35 | 20 sec. |
| Rinse (3) | 33 to 35 | 20 sec. |
| Drying | 70 to 80 | 50 sec. |

The composition of each processing solution used was as follows:

| | |
|---|---|
| Color Developing Solution: | |
| Water | 800 ml |
| Diethylenetriaminepentaacetic acid | 1.0 g |
| Nitrilotriacetic acid | 2.0 g |
| 1-Hydroxyethylidene-1,1-disulfonic acid | 2.0 g |
| Benzyl alcohol | 16 ml |
| Diethylene glycol | 10 ml |
| Sodium sulfite | 2.0 g |
| Potassium bromide | 0.5 g |
| Potassium carbonate | 30 g |
| N-Ethyl-N-(β-methanesulfonamidoethyl)-3-methyl-4-aminoaniline sulfate | 5.5 g |
| Hydroxylamine sulfate | 2.0 g |
| Fluorescent brightening agent (WHITEX 4B manufactured by Sumitomo Chemical Co., Ltd.) | 1.5 g |
| Water to make | 1000 ml |
| pH (25° C.) | 10.20 |
| Bleach-Fixing Solution: | |
| Water | 400 ml |
| Ammonium thiosulfate (70% aqueous solution) | 80 ml |
| Sodium sulfite | 24 g |
| Ammonium iron(III) ethylenediamine-tetraacetate | 30 g |
| Disodium ethylenediamine-tetraacetate | 5 g |
| Water to make | 1000 ml |
| pH (25° C.) | 6.50 |

Rinse Solution

Ion exchanged water (the amount of calcium and magnesium each being not more than 3 ppm).

The samples thus-processed were subjected to density measurement by an automatically recording densitometer, and fog density and relative sensitivity of the red-sensitive layer in each sample were determined. The relative sensitivity was determined using a reciprocal of the exposure amount required for obtaining an optical density of fog density +0.5.

The results obtained by Processing A are shown in Table 2 below.

TABLE 2

| | Storage at Room Temperature for 5 Days | | Storage at 35° C. and 60% RH for 1 Month | |
|---|---|---|---|---|
| Sample No. | Fog | Relative Sensitivity | Fog | Relative Sensitivity |
| 101 | 0.12 | 100 (standard) | 0.19 | 72 |
| 102 | 0.10 | 95 | 0.12 | 68 |
| 103 | 0.12 | 120 | 0.20 | 115 |
| 104 | 0.10 | 118 | 0.12 | 98 |
| 105 (Present Invention) | 0.10 | 120 | 0.12 | 115 |
| 106 (Present Invention) | 0.10 | 121 | 0.12 | 118 |
| 107 | 0.12 | 123 | 0.16 | 103 |
| 108 (Present Invention) | 0.10 | 121 | 0.10 | 118 |
| 109 (Present Invention) | 0.10 | 119 | 0.11 | 119 |
| 110 (Present Invention) | 0.10 | 118 | 0.10 | 119 |

From the results shown in Table 2, it is apparent that Samples 105, 106, and 108 to 110 according to the present invention exhibit a high red-sensitivity, and slight changes in sensitivity and fog during the storage for a long period of time. These superior results can be obtained only by the samples according to the present invention.

Substantially the same results were obtained in case of using Processing B and Processing C.

EXAMPLE 2

Silver halide Emulsions (G) to (I) prepared.

The crystal form, average grain size, halogen composition and coefficient of variation of each of Silver Halide Emulsions (G) to (I) are shown below.

The remeinder of the halogen composition was silver bromide which was localized at a part of grain.

| Emulsion | Crystal Form | Average Grain Size (μm) | Halogen Composition (Cl mol %) | Coefficient of Variation |
|---|---|---|---|---|
| (G) | cubic | 0.90 | 99.4 | 0.08 |
| (H) | cubic | 0.42 | 98.8 | 0.07 |
| (I) | cubic | 0.37 | 98.3 | 0.08 |

Silver Halide Emulsion (G) was used in a blue-sensitive silver halide emulsion layer together with a combination of Blue-Sensitive Sensitizing Dyes (Sens-1) shown below, Silver Halide Emulsion (H) was used in a green-sensitive silver halide emulsion layer together with a combination of Green-Sensitive Sensitizing Dyes (Sens-2) shown below, and Silver Halide Emulsion (I) was used in a red-sensitive silver halide emulsion layer together with Red-Sensitive Sensitizing Dye (Sens-3) shown below.

(Sens-1)

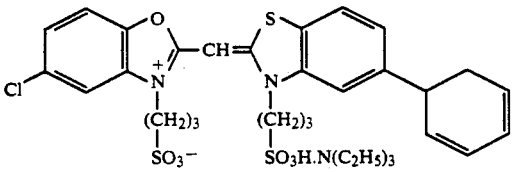

(Amount added: $1.6 \times 10^{-4}$ mol per mol of silver halide)

and

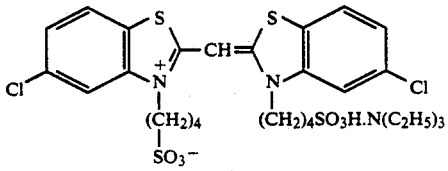

(Amount added: $1.7 \times 10^{-4}$ mol per mol of silver haide)

(Sens-2)

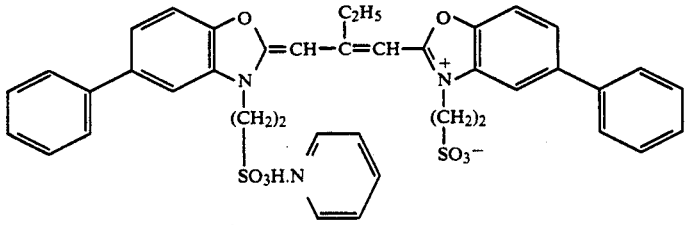

(Amount added: $4.0 \times 10^{-4}$ mol per mol of silver halide)

and

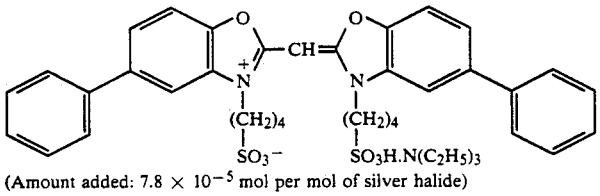

(Amount added: $7.8 \times 10^{-5}$ mol per mol of silver halide)

(Sens-3)

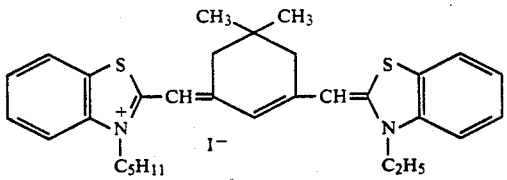

(Amount added: $7.8 \times 10^{-5}$ mol per mol of silver halide)

On a paper support, both surface of which were laminated with polyethylene, were coated layers as shown below in order to prepare a multilayer color photographic light-sensitive material which was designated Sample 201. The coating solutions were prepared in a similar manner as described in Example 1.

1-Oxy-3,5-dichloro-s-triazine sodium salt was used as a gelatin hardener in each layer.

To the red-sensitive emulsion layer, was added the compound described below in an amount of $6.9 \times 10^{-4}$ mol per mol of silver halide.

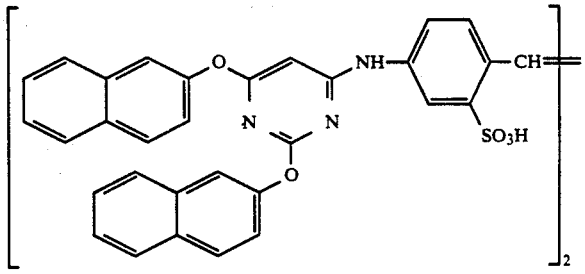

Further, as irradiation preventing dyes, the following dyes were employed.

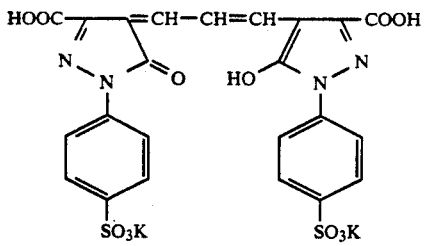

and

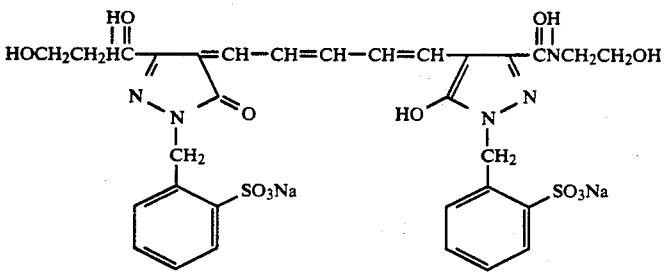

Layer Construction

The composition of each layer is shown below. The numerical values denote the coating amounts of components in the unit of g/m². The coating amount of silver halide emulsion is indicated in terms of silver coating amount.

| | | |
|---|---|---|
| Support | Paper support, both surfaces of which were laminated with polyethylene (the polyethylene coating containing a white pigment ($TiO_2$) and a bluish dye (ultramarine) on the first layer side) | |
| First Layer (Blue-sensitive layer) | Silver Halide Emulsion (G) | 0.26 |
| | Gelatin | 1.13 |
| | Yellow Coupler (Y-1) | 0.66 |
| | Color Image Stabilizer (Cpd-2) | 0.01 |
| | Solvent (Solv-4) | 0.28 |
| Second Layer (Color mixing Preventing layer) | Gelatin | 0.89 |
| | Color Mixing Preventing Agent (Cpd-3) | 0.08 |
| | Solvent (Solv-3) | 0.20 |
| | Solvent (Solv-4) | 0.20 |
| Third Layer (Green-Sensitive layer) | Silver Halide Emulsion (H) | 0.30 |
| | Gelatin | 1.04 |
| | Magenta Coupler (M-11) | 0.32 |
| | Color Image Stabilizer (Cpd-4) | 0.10 |
| | Color Image Stabilizer (Cpd-9) | 0.05 |
| | Color Image Stabilizer (Cpd-10) | 0.01 |
| | Color Image Stabilizer (Cpd-11) | 0.08 |
| | Solvent (Solv-3) | 0.20 |
| | Solvent (Solv-5) | 0.16 |
| Fourth Layer (Ultraviolet light Absorbing layer) | Gelatin | 1.42 |
| | Ultraviolet Light Absorbing Agent (UV-1) | 0.47 |
| | Color Mixing Preventing Agent (Cpd-3) | 0.05 |
| | Solvent (Solv-6) | 0.24 |
| Fifth Layer (Red-sensitive layer) | Silver Halide Emulsion (I) | 0.21 |
| | Gelatin | 0.85 |
| | Cyan Coupler (C-3) | 0.18 |
| | Cyan Coupler (C-2) | 0.08 |
| | Cyan Coupler (C-1) | 0.02 |
| | Cyan Coupler (C-4) | 0.02 |
| | Color Image Stabilizer (Cpd-2) | 0.27 |
| | Color Image Stabilizer (Cpd-12) | 0.04 |
| | Color Image Stabilizer (Cpd-7) | 0.17 |
| | Antifogging Agent (Cpd-1) | $5.2 \times 10^{-4}$ mol/mol Ag |
| | Solvent (Solv-7) | 0.30 |
| Sixth Layer (Ultraviolet) light Absorbing layer) | Gelatin | 0.48 |
| | Ultraviolet Light Absorbing Agent (UV-1) | 0.16 |
| | Solvent (Solv-6) | 0.08 |
| Seventh Layer (Protective layer) | Gelatin | 1.22 |
| | Acryl-modified Polyvinyl Alcohol Copolymer (Degree of modification: 17%) | 0.05 |
| | Liquid Paraffin | 0.02 |

The compounds used in the above-described layers have the structures shown in Example 1 for the compounds which have the same identifying number, and have the structure shown below for the compounds which were not identified in Example 1, respectively.

Color Image Stabilizer

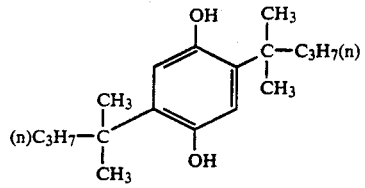

(Cpd-9)

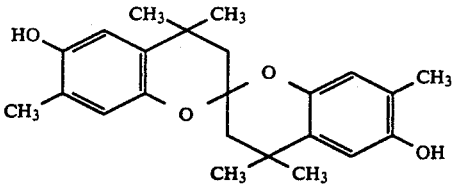

(Cpd-10)

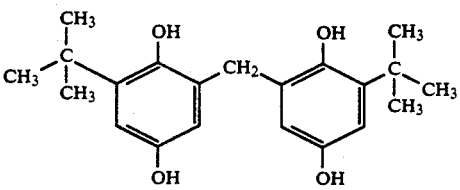

(Cpd-11)

-continued

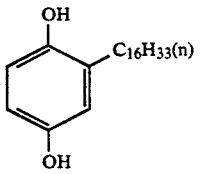

(Cpd-12)

Solvent

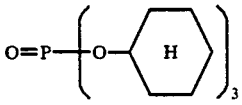

(Solv-7)

Samples 202 to 210 were prepared in the same manner as described for Sample 201 above, except for changing the red-sensitive sensitizing dye and the antifogging agent used in the fifth layer (red-sensitive layer), the magenta coupler in the third layer (green-sensitive layer) and the pH of the layers to those shown in Table 3.

TABLE 1

| Sample No. | Third Layer (Green-Sensitive Layer) Magenta Coupler | Fifth Layer (Red-Sensitive Layer) Red Sensitive Sensitizing Dye | Antifogging Agent | pH of Layers |
|---|---|---|---|---|
| 201 | M-11 (0.32 g/m$^2$) | Sens-3 ($7.8 \times 10^{-5}$ mol/mol Ag) | Cpd-1 ($5.2 \times 10^{-4}$ mol/mol Ag) | 6.2 |
| 202 | M-11 | Sens-3 | E-1 | 6.2 |
| 203 | M-11 | III-2 | Cpd-1 | 6.2 |
| 204 | M-11 | III-2 | E-1 | 5.0 |
| 205 (Present Invention) | M-11 | III-2 | E-1 | 5.7 |
| 206 (Present Invention) | M-11 | III-2 | E-1 | 6.2 |
| 207 | M-11 | III-2 | E-1 | 7.0 |
| 208 | M-57 | III-2 | E-1 | 6.2 |
| 209 | M-11 | III-2 | E-1 ($3.5 \times 10^{-4}$ mol/mol Ag) D-25 ($1.7 \times 10^{-4}$ mol/mol Ag) | 6.2 |
| 210 | M-57 | III-2 | E-1 ($3.5 \times 10^{-4}$ mol/mol Ag) D-25 ($3.5 \times 10^{-4}$ mol/mol Ag) | 6.2 |

The amounts were the same as those in Sample 201 unless otherwise indicated in Table 2.

The samples thus-prepared were evaluated in the following manner. More specifically, each sample was divided into two portions, and one was stored at room temperature for 5 days and the other was stored under the condition of 35° C. and 60% RH for 1 month. Then, these samples were subjected to stepwise exposure for sensitometry through a three color separation filter using a sensitometer (FWH Type manufactured by Fuji Photo Film Co., Ltd, color temperature of light source: 3200° K.). The exposure was conducted at an exposure time of 0.1 second in an exposure amount of 250 CMS.

The exposed samples were continuously processed according to Processing Scheme D shown below.

| Processing D: Processing Step | Temperature (°C.) | Time |
|---|---|---|
| Color Development | 38 | 45 sec. |
| Bleach-Fixing | 30 to 36 | 45 sec. |
| Rinse (1) | 30 to 37 | 30 sec. |
| Rinse (2) | 30 to 37 | 30 sec. |
| Rinse (3) | 30 to 37 | 30 sec. |
| Drying | 70 to 80 | 60 sec. |

The composition of each processing solution used was as follows:

| | |
|---|---|
| Color Developing Solution: | |
| Water | 800 ml |
| Ethylenediamine-N,N,N,N-tetramethylene-phosphonic acid | 3.0 g |
| N,N-Di(carboxymethyl)hydrazine | 4.5 g |
| Sodium chloride | 3.5 g |
| Potassium bromide | 0.025 g |
| Potassium carbonate | 25.0 g |
| N-Ethyl-N-(β-methanesulfonamidoethyl)-3-methyl-4-aminoaniline sulfate | 5.0 g |
| Fluorescent brightening agent (WHITEX 4 manufactured by Sumitomo Chemical Co., Ltd.) | 1.2 g |
| Water to make | 1000 ml |
| pH (25° C.) | 10.05 |
| Bleach-Fixing Solution: | |
| Water | 400 ml |
| Ammonium thiosulfate (55% aqueous solution) | 100 ml |
| Sodium sulfite | 17 g |
| Ammonium iron(III) ethylenediamine-tetraacetate | 55 g |
| Disodium ethylenediamine-tetraacetate | 5 g |
| Ammonium bromide | 40 g |
| Glacial acetic acid | 9 g |
| Water to make | 1000 ml |
| pH (25° C.) | 5.80 |

Rinse Solution

Ion exchanged water (the amount of calcium and magnesium each being not more than 3 ppm).

The samples thus-processed were subjected to density measurement by an automatically recording densitometer, and fog density and relative sensitivity of the red-sensitive layer in each sample were determined. The relative sensitivity was determined using a reciprocal of the exposure amount required for obtaining an optical density of fog density +0.5.

The results obtained by Processing D are shown in Table 4 below.

TABLE 4

| Sample No. | Storage at Room Temperature for 5 Days | | Storage at 35° C. and 60% RH for 1 Month | |
|---|---|---|---|---|
| | Fog | Relative Sensitivity | Fog | Relative Sensitivity |
| 201 | 0.12 | 100 (standard) | 0.20 | 70 |
| 202 | 0.10 | 95 | 0.12 | 65 |
| 203 | 0.12 | 121 | 0.21 | 113 |
| 204 | 0.10 | 119 | 0.12 | 95 |
| 205 (Present Invention) | 0.10 | 121 | 0.11 | 119 |
| 206 (Present Invention) | 0.10 | 120 | 0.12 | 119 |
| 207 | 0.12 | 124 | 0.16 | 105 |
| 208 (Present Invention) | 0.10 | 120 | 0.10 | 118 |
| 209 (Present Invention) | 0.10 | 118 | 0.10 | 117 |
| 210 (Present Invention) | 0.10 | 119 | 0.11 | 119 |

From the results shown in Table 4, it is apparent that Samples 205, 206, and 208 to 210 according to the present invention exhibit a high red-sensitivity, and slight changes in sensitivity and fog during the preservation for a long period of time. These superior results can be obtained only by the samples according to the present invention.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least three silver halide emulsion layers which have different color sensitivities from each other, wherein at least one of the silver halide emulsion layers contains at least one magenta coupler represented by general formula (I) described below, at least one of the silver halide emulsion layers contains at least one compound represented by general formula (II) described below, at least one of the silver halide emulsion layers contains at least one compound represented by general formula (III) described below and the pH of the layers of the silver halide color photographic material is 5.0 to 6.5:

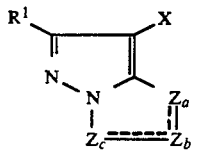

(I)

wherein $R_1$ represents a hydrogen atom or a substituent; X in formula (I) represents a hydrogen atom or a group capable of being released upon a coupling reaction with an oxidation product of an aromatic primary amine developing agent; Za, Zb and Zc each represents a methine group, a substituted methine group, =N— or —NH—, one of the Za—Zb bond and the Zb—Zc bond is a double bond and the other is a single bond; when the Zb—Zc bond is a carbon-carbon double bond, it may form a part of a condensed aromatic ring; $R^1$ or X may form a part of a polymer including a dimer or higher polymer; or when Za, Zb or Zc is a substituted methine group, the substituted methine group may form a part of a polymer including a dimer or a higher polymer,

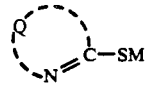

(II)

wherein Q represents an atomic group necessary to form a 5-membered or 6-membered heterocyclic ring which may be condensed with a benzene ring; and M represents a hydrogen atom, an alkali metal atom, an ammonium group or a precursor thereof,

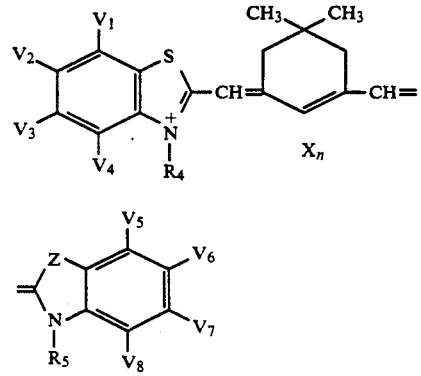

(III)

wherein Z represents an oxygen atom or a sulfur atom; $R_4$ and $R_5$ each represents an unsubstituted or substituted alkyl group; $V_1$, $V_2$, $V_3$, $V_4$, $V_5$, $V_6$, $V_7$ and $V_8$ each represents a hydrogen atom, a halogen atom, an alkyl group, an acyl group, an acyloxy group, an alkoxycarbonyl group, a carbamoyl group, a sulfamoyl group, a carboxy group, a cyano group, a hydroxy group, an amino group, an acylamino group, an alkoxy group, an alkylthio group, an alkylsulfonyl group, a sulfonic acid group, or an aryl group, provided that adjacent groups represented by $V_1$ to $V_8$ can not bond to each other to form a condensed ring, and further provided that Y is not larger than −0.08 when Z represents an oxygen atom or Y is not larger than −0.15 when Z represents a sulfur atom, wherein Y represents the total of $\sigma_{p1}$, $\sigma_{p2}$, $\sigma_{p3}$, $\sigma_{p4}$, $\sigma_{p5}$, $\sigma_{p6}$, $\sigma_{p7}$ and $\sigma_{p8}$, which are the Hammett's $\sigma_p$ values of $V_1$ to $V_8$ respectively; X in formula (III) represents a charged ion to neutralize the electrical charge of the compound; and n represents a value necessary to neutralize the electrical charge of the compound.

2. A silver halide color photographic material as claimed in claim 1, wherein the magenta coupler is represented by the following general formula (Ia), (Ib), (Ic), (Id), (Ie) (If) or (Ig):

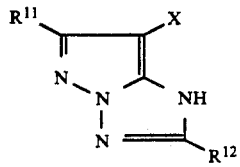

(Ia)

-continued (Ib)

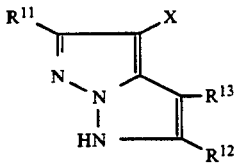

(Ic)

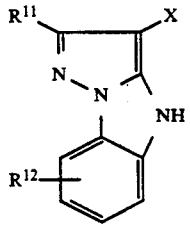

(Id)

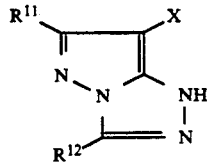

(Ie)

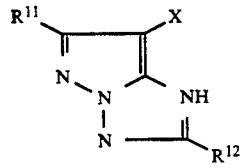

(If)

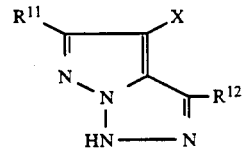

(Ig)

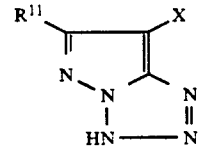

wherein $R^{11}$, $R^{12}$ and $R^{13}$, which may be the same or different, each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group, or $R^{12}$ and $R^{13}$ in general formula (Ia) or (Ib) may combine with each other to form a 5-membered, 6-membered or 7-membered ring; X represents a hydrogen atom, a halogen atom, a carboxy group or a group capable of being released upon coupling which is bonded to the carbon atom at the coupling position of the coupler through an oxygen atom, a nitrogen atom or a sulfur atom; or $R^{11}$, $R^{12}$, $R^{13}$ or X is formulas (Ia) to (Ig) may form a polymer coupler including a dimer or higher polymer.

3. A silver halide color photographic material as claimed in claim 2, wherein the magenta coupler is represented by general formula (Ia), (Id) or (Ie).

4. A silver halide color photographic material as claimed in claim 2, wherein the magenta coupler is represented by general formula (Ie).

5. A silver halide color photographic material as claimed in claim 2, wherein X in formulas (Ia) to (Ig) is a halogen atom or a group capable of being released upon coupling which is bonded to the coupling position through a sulfur atom.

6. A silver halide color photographic material as claimed in claim 1, wherein the magenta coupler is a pyrazolotriazole coupler having a branched chain alkyl group at the 2-, 3- or 6-position and a halogen atom as a group capable of being released.

7. A silver halide color photographic material as claimed in claim 1, wherein the magenta coupler is a pyrazolotriazole coupler having an alkyl group or an aryl group at the 2- or 3-position, an alkoxy group or an aryloxy group at the 6-position and a group capable of being released bonded to the coupling position through a sulfur atom.

8. A silver halide color photographic material as claimed in claim 1, wherein the magenta coupler is present in a green-sensitive silver halide emulsion layer.

9. A silver halide color photographic material as claimed in claim 1, wherein the heterocyclic ring formed with Q is imidazole, tetrazole, thiazole, thiadiazole, oxazole, selenazole, benzimidazole, naphthoimidazole, benzothiazole, naphthothiazole, benzoselenazole, naphthoselenazole, benzoxazole, pyridine, pyrimidine, or quinoline.

10. A silver halide color photographic material as claimed in claim 9, wherein the heterocyclic ring formed Q with is tetrazole, thiadiazole, benzimidazole, benzoxazole, or benzothiazole.

11. A silver halide color photographic material as claimed in claim 1, wherein the compound represented by general formula (II) is a compound represented by the following general formula (B):

(B)

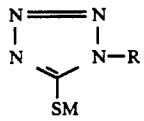

wherein R represents an alkyl group, an alkenyl group or an aryl group; and M represents a hydrogen atom, an alkali metal atom, an ammonium group or a precursor thereof.

12. A silver halide color photographic material as claimed in claim 1, wherein the compound represented by general formula (II) is a compound represented by the following general formula (E):

(E)

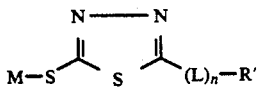

wherein L represents a divalent connecting group; R′ represents a hydrogen atom, an alkyl group, an alkenyl group or an aryl group; M represents a hydrogen atom, an alkali metal atom, an ammonium group or a precursor thereof; and n represents 0 or 1.

13. A silver halide color photographic material as claimed in claim 12, wherein L represents

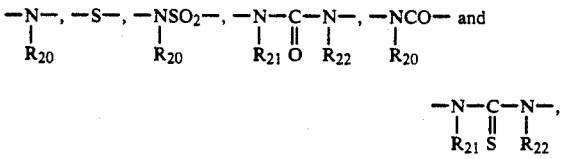

wherein $R_{20}$, $R_{21}$ and $R_{22}$ each represents a hydrogen atom, an alkyl group or an aralkyl group.

14. A silver halide color photographic material as claimed in claim 1, wherein the compound represented by general formula (II) is a compound represented by the following general formula (D):

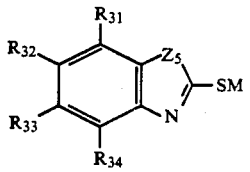

(D)

wherein $Z_5$ represents —O—,

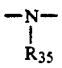

or —S—; $R_{31}$, $R_{32}$, $R_{33}$, $R_{34}$ and $R_{35}$ each represents a hydrogen atom or a substituent; and M represents a hydrogen atom, an alkali metal atom, an ammonium group or a precursor thereof.

15. A silver halide color photographic material as claimed in claim 14, wherein the substituent represented by $R_{31}$, $R_{32}$, $R_{33}$, $R_{34}$ or $R_{35}$ is a halogen atom, a substituted or unsubstituted alkyl group, a substituted or unsubstituted aryl group, a substituted or unsubstituted alkoxy or aryloxy group, a substituted or unsubstituted sulfonyl group, a substituted or unsubstituted sulfonamido group, a substituted or unsubstituted sulfamoyl group, a substituted or unsubstituted carbamoyl group, a substituted or unsubstituted amido group, a substituted or unsubstituted ureido group, a substituted or unsubstituted aryloxycarbonylamino or alkoxycarbonylamino group, a substituted or unsubstituted aryloxycarbonyl or alkoxycarbonyl group, a substituted or unsubstituted arylcarbonyloxy or alkylcarbonyloxy group, a substituted or unsubstituted arylaminocarbonyloxy or alkylaminocarbonyloxy group, a cyano group, a substituted or unsubstituted arylthio or alkylthio group, a substituted or unsubstituted carbonyl group, a substituted or unsubstituted amino group, a carboxy group, a sulfo group, a hydroxy group or a nitro group.

16. A silver halide color photographic material as claimed in claim 1, wherein the compound represented by general formula (II) is present in a red-sensitive silver halide emulsion layer.

17. A silver halide color photographic material as claimed in claim 1, wherein $R_4$ and $R_5$ in general formula (III) each represents an unsubstituted alkyl group or a sulfoalkyl group.

18. A silver halide color photographic material as claimed in claim 1, wherein $V_1$, $V_2$, $V_3$, $V_4$, $V_5$, $V_6$, $V_7$ and $V_8$ in general formula (III) each represents a hydrogen atom, an unsubstituted alkyl group or an alkoxy group, with the proviso that $V_1$, $V_2$, $V_3$, $V_4$, $V_5$, $V_6$, $V_7$ and $V_8$ are not a hydrogen atom at the same time.

19. A silver halide color photographic material as claimed in claim 1, wherein the compound represented by general formula (III) is present in a red-sensitive silver halide emulsion layer.

20. A silver halide color photographic material as claimed in claim 19, wherein the red-sensitive layer further contains a compound represented by the following general formula (IV):

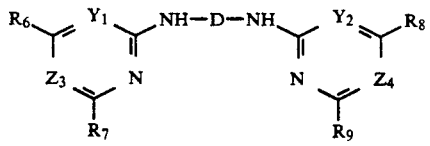

(IV)

wherein D represents a divalent aromatic group; $R_6$ $R_7$, $R_8$ and $R_9$ each represents a hydrogen atom, a hydroxy group, an alkoxy group, an aryloxy group, a halogen atom, a heterocyclic group, a mercapto group, an alkylthio group, an arylthio group, a heterocyclic thio group, an amino group, an alkylamino group, a cyclohexylamino group, an aryl amino group, a heterocyclic amino group, an aralkylamino group or an aryl group; $Y_1$ and $Z_3$ each represents —N= or —CH=, provided that at least one of $Y_1$ and $Z_3$ must represent —N=; and $Y_2$ and $Z_4$ have the same meaning as defined for $Y_1$ and $Z_3$, respectively.

21. A silver halide color photographic material as claimed in claim 20, wherein at least one of $R_6$ to $R_9$ in general formula (IV) is an aryloxy group, a heterocyclic thio group or a heterocyclic amino group.

22. A silver halide color photographic material as claimed in claim 1, wherein the silver halide used in the silver halide emulsion layers is silver chlorobromide containing 90 mol % or more of silver chloride.

* * * * *